US007522864B2

(12) United States Patent
Sakatani et al.

(10) Patent No.: US 7,522,864 B2
(45) Date of Patent: Apr. 21, 2009

(54) IMAGE FORMING APPARATUS AND IMAGE FORMING METHOD

(75) Inventors: Kazuomi Sakatani, Toyokawa (JP); Soh Hirota, Hoi-gun (JP); Masahiro Kouzaki, Toyohashi (JP); Mitsuru Obara, Toyohashi (JP); Masaki Tanaka, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 173 days.

(21) Appl. No.: 11/600,087

(22) Filed: Nov. 16, 2006

(65) Prior Publication Data

US 2007/0122198 A1 May 31, 2007

(30) Foreign Application Priority Data

Nov. 30, 2005 (JP) ..... 2005-346864
Nov. 30, 2005 (JP) ..... 2005-346865

(51) Int. Cl.
*G03G 15/01* (2006.01)

(52) U.S. Cl. ..... 399/223

(58) Field of Classification Search ..... 399/39, 399/40, 223, 252, 299; 430/45.5, 107.1
See application file for complete search history.

(56) References Cited

U.S. PATENT DOCUMENTS 5,978,628 A * 11/1999 Rees ..... 399/223 X
6,853,829 B2 * 2/2005 Hoshi et al. ..... 399/299

FOREIGN PATENT DOCUMENTS

| | | | |
|---|---|---|---|
| JP | 63-097981 | * | 4/1988 |
| JP | 63-306477 | * | 12/1988 |
| JP | 5-080628 A | | 4/1993 |
| JP | 5-301382 A | | 11/1993 |
| JP | 06-324541 | * | 11/1994 |
| JP | 08-152758 | * | 6/1996 |
| JP | 08-262692 | * | 10/1996 |
| JP | 09-314912 | * | 12/1997 |
| JP | 10-3014912 | * | 11/1998 |
| JP | 2003-270897 | * | 9/2003 |
| JP | 2004-058450 | * | 2/2004 |
| JP | 2004-170866 | * | 6/2004 |
| JP | 2005-107357 | * | 4/2005 |

OTHER PUBLICATIONS

Notification of Reason for Refusal in JP 2005-346864 dated Sep. 30, 2008, and a English Translation thereof.*
Notification of Reason for Refusal in JP 2005-346865 dated Sep. 30, 2008, and a English Translation thereof.*

* cited by examiner

*Primary Examiner*—Sandra L Brase
(74) *Attorney, Agent, or Firm*—Buchanan Ingersoll & Rooney PC

(57) ABSTRACT

In an image forming apparatus of the present invention, a developing unit for magenta contains magenta-type toner for pseudo full-color image forming whose chromaticity point is shifted closer to yellow hue on a chromaticity diagram, in comparison with genuine-magenta toner for full-color image forming, and likewise, a developing unit for cyan contains cyan-type toner for the pseudo full-color image forming whose chromaticity point is shifted closer to yellow hue on the chromaticity diagram, in comparison with genuine-cyan toner for the full-color image forming.

6 Claims, 36 Drawing Sheets

FIG.6

1004 1003 1002

| | | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|
| | | | | | | | | | | | | | | | | ○ | ○ | ○ | ○ | ○ | ○ | ○ | | | | | | | | ○ | | Y | IMAGE FORMING UNIT (DEVELOPING UNIT) |
| | | | | | | | | ○ | ○ | ○ | ○ | ○ | ○ | ○ | ○ | | | | | | ○ | ○ | | | | | | ○ | ○ | | | M | |
| | | | | ○ | ○ | ○ | ○ | | | | | ○ | ○ | ○ | ○ | | | | | ○ | | ○ | | | | | ○ | | ○ | | | C | |
| | ○ | ○ | ○ | | | ○ | ○ | | | ○ | ○ | | | | ○ | | | ○ | ○ | | | | | | ○ | ○ | | | | | | M' | |
| ○ | | ○ | ○ | | ○ | | ○ | | ○ | | ○ | | | ○ | | | ○ | | ○ | | | | | ○ | | ○ | | | | | | C' | |
| ○ | ○ | | ○ | ○ | ○ | ○ | | ○ | ○ | ○ | | | ○ | | | ○ | ○ | ○ | | ○ | ○ | | ○ | ○ | ○ | | ○ | ○ | | ○ | ○ | K | |
| ○ | ○ | ○ | | ○ | | | | ○ | | | | ○ | | | | ○ | | | | | | | ○ | | | | | | | | | WASTE TONER COLLECTION UNIT | |
| | | | | | | | | | | | | | | | | | | | | | | ○ | | | | | | | | | | FULL-COLOR MODE | |
| | | ○ | ○ | | | | ○ | | | | ○ | ○ | ○ | ○ | ○ | | | | ○ | | | ○ | | | | ○ | | | ○ | | | PSEUDO FULL-COLOR MODE | |
| ○ | ○ | | ○ | ○ | ○ | ○ | | ○ | ○ | ○ | | | ○ | | | ○ | ○ | ○ | | ○ | ○ | | ○ | ○ | ○ | | ○ | ○ | | ○ | ○ | MONOCHROME MODE | |
| | | | | | | | | | | | | | | | | ○ | ○ | ○ | ○ | ○ | ○ | ○ | ○ | ○ | ○ | ○ | ○ | ○ | ○ | ○ | ○ | Y | IMAGE FORMING UNIT (DEVELOPING UNIT) |
| | | | | | ○ | ○ | ○ | ○ | ○ | ○ | ○ | ○ | ○ | ○ | ○ | | | | | | | | ○ | ○ | ○ | ○ | ○ | ○ | ○ | ○ | M | |
| | ○ | ○ | ○ | ○ | | | | | ○ | ○ | ○ | ○ | ○ | ○ | ○ | | | | | ○ | ○ | ○ | ○ | | | | | ○ | ○ | ○ | ○ | C | |
| ○ | | ○ | ○ | ○ | | ○ | ○ | ○ | | | | ○ | ○ | ○ | | ○ | ○ | ○ | | | | ○ | ○ | | | ○ | ○ | | | | ○ | M' | |
| ○ | ○ | | ○ | ○ | ○ | | ○ | ○ | | ○ | ○ | | | ○ | ○ | ○ | | ○ | ○ | | ○ | | ○ | | ○ | | ○ | | | ○ | | C' | |
| ○ | ○ | ○ | | ○ | ○ | ○ | | ○ | ○ | | ○ | | ○ | | ○ | ○ | ○ | | ○ | ○ | ○ | ○ | | ○ | ○ | ○ | | | ○ | | | K | |
| ○ | ○ | ○ | ○ | | ○ | ○ | ○ | | ○ | ○ | | ○ | | ○ | | ○ | ○ | ○ | | ○ | | | | ○ | | | | ○ | | | | WASTE TONER COLLECTION UNIT | |
| | | | | | | | | | | | | | | | | | | | | | | | | | | | | ○ | ○ | ○ | ○ | FULL-COLOR MODE | |
| ○ | | | ○ | ○ | | | ○ | ○ | ○ | ○ | ○ | ○ | ○ | ○ | | | ○ | ○ | | | | ○ | | | | ○ | ○ | ○ | ○ | ○ | | PSEUDO FULL-COLOR MODE | |
| ○ | ○ | ○ | | ○ | ○ | ○ | | ○ | ○ | | ○ | | ○ | | ○ | ○ | | ○ | ○ | ○ | ○ | | ○ | ○ | ○ | | | ○ | | | | MONOCHROME MODE | |

1001

111

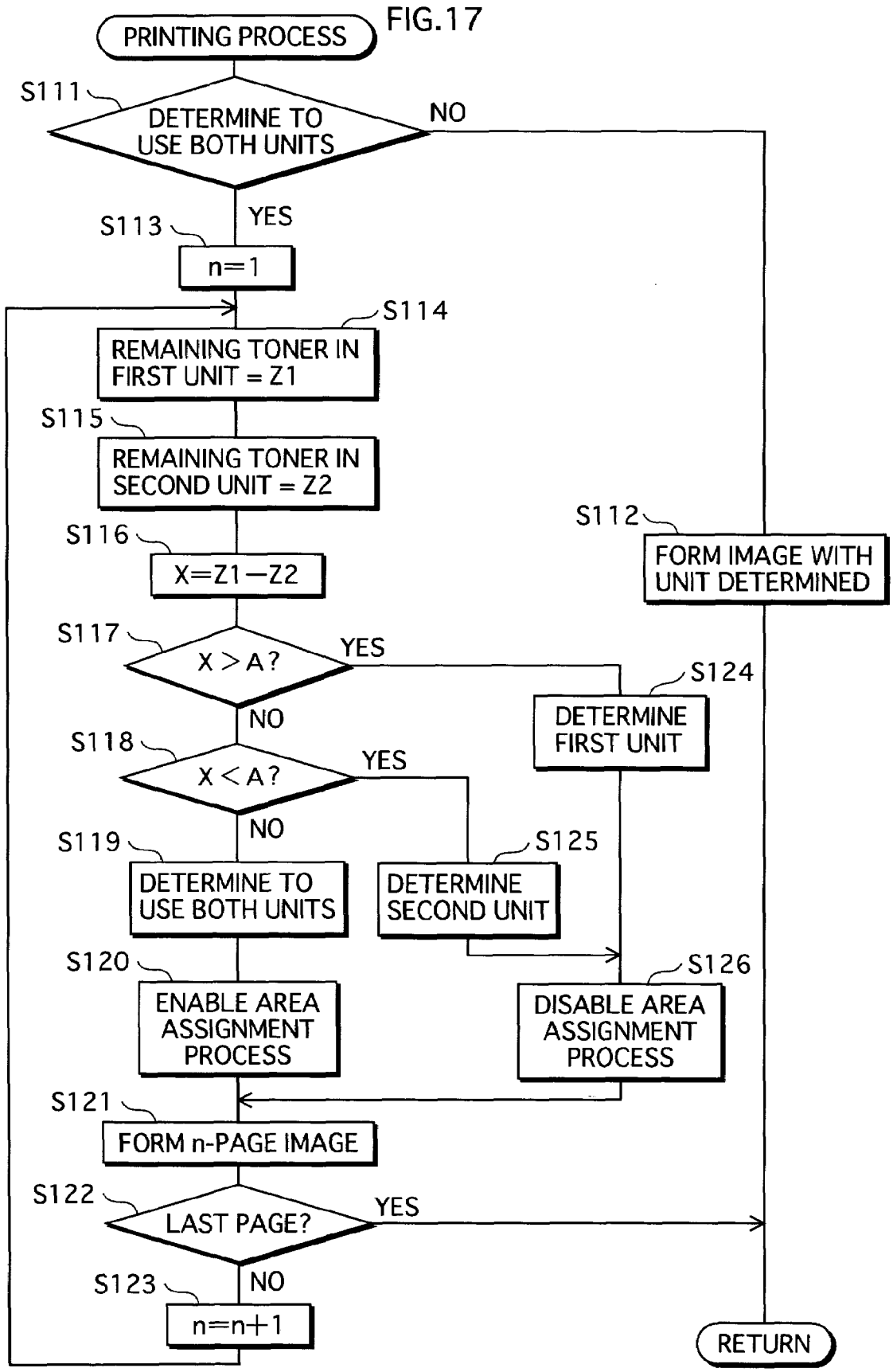
FIG.17
PRINTING PROCESS
S111
DETERMINE TO USE BOTH UNITS
NO
YES
S113
n=1
S114
REMAINING TONER IN FIRST UNIT = Z1
S115
REMAINING TONER IN SECOND UNIT = Z2
S116
X=Z1−Z2
S112
FORM IMAGE WITH UNIT DETERMINED
S117
X > A?
YES
S124
DETERMINE FIRST UNIT
NO
S118
X < A?
YES
NO
S119
DETERMINE TO USE BOTH UNITS
S125
DETERMINE SECOND UNIT
S120
ENABLE AREA ASSIGNMENT PROCESS
S126
DISABLE AREA ASSIGNMENT PROCESS
S121
FORM n-PAGE IMAGE
S122
LAST PAGE?
YES
S123
NO
n=n+1
RETURN

FIG.28

| # OF CYCLES | # OF DEVELOPING UNITS | FEATURES | | WASTE TONER COLLECTION UNIT |
|---|---|---|---|---|
| | | SPEED | MAINTENANCE FREQUENCY | |
| 4 CYCLES | 4 UNITS | 1 | NORMAL | UNATTACHED |
| 3 CYCLES | 3 UNITS | 4/3 | REDUCED | ATTACHED |
| | 4 UNITS | | | UNATTACHED |

| PATTERN # | COMBINATION | | |
|---|---|---|---|
| | LEFT | MIDDLE | RIGHT |
| 1 | M' | C' | K |
| 2 | M | C | K |

FIG.35A

801

| SETTING STATE OF IMAGE FORMING UNITS |
| --- |
| UNITS ARE IN ORDER OF MAGENTA', BLACK, CYAN' FROM LEFT |

FIG.35B

802

| SETTING STATE OF IMAGE FORMING UNITS |
| --- |
| IMAGE FORMING UNITS ARE IN ORDER OF MAGENTA, CYAN FROM LEFT |

FIG.35C

803

| SETTING STATE OF IMAGE FORMING UNITS |
| --- |
| UNITS ARE NOT SET IN RIGHT ORDER<br>REPLACE BLACK UNIT WITH CYAN' UNIT |

FIG.35D

804

| SETTING STATE OF IMAGE FORMING UNITS |
| --- |
| UNITS ARE NOT IN BEST COMBINATION<br><br>REPLACE CYAN WITH CYAN',<br>MAGENTA WITH MAGENTA' |

IMAGE FORMING APPARATUS AND IMAGE FORMING METHOD

This application is based on application No. 2005-346864 and No. 2005-346865 filed in Japan, the contents of which are hereby incorporated by reference.

BACKGROUND OF THE INVENTION (1) Field of the Invention

The present invention relates to image forming apparatuses and methods of an electrophotograph type that are capable of forming color images.

(2) Description of the Related Art

It has been a trend in the particular technical field of color image forming apparatuses to develop facsimiles, printers and the like capable of forming color images by means of subtractive color mixing, using four or more color toners including the three primaries of cyan, magenta, and yellow on top of the key color black (also known as CMYK) ("Electrophotography—Bases and Applications II," edited by the Society of Electrophotography of Japan, published by Corona Publishing Co. Ltd., Nov. 15, 1996, pp 31, 55).

By the four-color process printing with the general CMYK color toners, as in most of the commercial applications, reproduction of an image or text in color produces a final result precisely faithful to the original. When it comes to charts or graphs, faithful reproduction of original colors is not required in many occasions, and for users considering the color reproducibility to be less important, it is preferable to achieve costs-savings by suppressing the toner consumption. However, there is no image forming apparatuses at present that satisfy such users' needs.

SUMMARY OF THE INVENTION

In order to respond to the above-mentioned needs, the present invention aims to provide image forming apparatuses and image forming methods capable of forming color images at lower costs while achieving the reproducibility to such a level as requested by the user.

In an effort to achieve the above aims, an image forming apparatus in accordance with one aspect of the present invention is provided, including: a magenta developing unit operable to develop, using a toner of a magenta-type color, an electrostatic latent image corresponding to the toner of the magenta-type color; a cyan developing unit operable to develop, using a toner of a cyan-type color, an electrostatic latent image corresponding to the toner of the cyan-type color; a black developing unit operable to develop, using a toner of a black-type color, an electrostatic latent image corresponding to the toner of the black-type color; and an image processing unit operable to execute a pseudo full-color image forming process through which only three toner images of the magenta-type, cyan-type, and black-type colors developed by respective developing units are layered so as to form a color image. In this case, the toner of the magenta-type color is for use in the pseudo full-color image forming and has a chromaticity point shifted in a direction closer to a yellow hue when plotted on a chromaticity diagram, in comparison with the toner of a genuine magenta color for use in full-color image forming including a case of using four colors that are the magenta-type, cyan-type, and black-type colors, and a yellow-type color.

In accordance with another aspect of the present invention, an image forming apparatus is provided, including: a magenta developing unit operable to develop, using a toner of a magenta-type color, an electrostatic latent image corresponding to the toner of the magenta-type color; a cyan developing unit operable to develop, using a toner of a cyan-type color, an electrostatic latent image corresponding to the toner of the cyan-type color; a black developing unit operable to develop, using a toner of a black-type color, an electrostatic latent image corresponding to the toner of the black-type color; and an image processing unit operable to execute a pseudo full-color image forming process through which only three toner images of the magenta-type, cyan-type, and black-type colors developed by the respective developing units are layered so as to form a color image. In this case, the toner of the cyan-type color is for use in the pseudo full-color image forming and has a chromaticity point shifted in a direction closer to a yellow hue when plotted on a chromaticity diagram, in comparison with the toner of a genuine cyan for use in full-color image forming including a case of using four colors that are the magenta-type, cyan-type, and black-type colors, and a yellow-type color.

In accordance with yet another aspect of the present invention, an image forming method is provided, including the steps of: forming respective electrostatic latent images corresponding to each of magenta-type, cyan-type, and black-type colors; developing the respective electrostatic latent images so as to form toner images of each of the magenta-type, cyan-type, and black-type colors; and layering the toner images so as to form a color image. In this case, the toner of the magenta-type color is for use in pseudo full-color image forming and has a chromaticity point shifted in a direction closer to a yellow hue when plotted on a chromaticity diagram, in comparison with a toner of a genuine magenta for use in full-color image forming including a case of using four colors that are the magenta-type, cyan-type, and black-type colors, and a yellow-type color.

In accordance with yet another aspect of the present invention, an image forming method is provided, including the steps of: forming respective electrostatic latent images corresponding to each of magenta-type, cyan-type, and black-type colors; developing the respective electrostatic latent images so as to form toner images of each of the colors; layering the toner images of each of the colors so as to form a color image. In this case, the toner of the cyan-color that is for use in pseudo full-color image forming and has a chromaticity point shifted in a direction closer to a yellow hue when plotted on a chromaticity diagram, in comparison with a toner of a genuine cyan for use in full-color image forming including a case of using four colors that are the magenta-type, cyan-type, and black-type colors, and a yellow-type color.

Thereby, it is made possible to form color images using three kinds of toners of the magenta-type color, cyan-type color, and black-type color only, and hence, printing costs are saved for a toner of the yellow-type color not consumed. Therefore, the use of the image forming apparatuses and/or image forming methods in accordance with the present invention contribute to costs-savings more than those conventional apparatuses and/or methods.

Moreover, color images are formed using toners for the magenta-type color and cyan-type color that are used in the image forming in pseudo full colors, having chromaticity points shifted in the directions closer to the yellow hue when plotted on the chromaticity diagram, in comparison with the toners for use in the image forming in full colors, and hence, the resulting color images contain a yellow component while achieving the color reproducibility to such a level as required by the users.

In accordance with yet another aspect of the present invention, an image forming apparatus is provided capable of forming a color image using a plurality of image forming units. The apparatus includes: at least four holding units, each operable to hold a different one of the image forming units that form an image on a body subjected to image transfer; and a control unit. In a case where, of the at least four holding units, a first image forming unit for magenta, a second image forming unit for cyan, and a third image forming unit for black are held in a first holding unit, a second holding unit, and a third holding unit, respectively, only the first through third image forming units are used so as to form the color image.

In accordance with one aspect of the present invention, an image forming method is provided for an image forming apparatus incorporating at least four holding units, each operable to hold an image forming unit equipped with an image carrier. The method includes the steps of: in a case where, of the at least four holding units, a first image forming unit for magenta is held in a first holding unit, a second image forming unit for cyan is held in a second holding unit, and a third image forming unit for black is held in a third holding unit, using the first through third image forming units only, each forming a toner image of a unit-specific color on the image carrier thereof; and forming a color image by transferring each of the toner image sequentially onto a body subjected to image transfer in a form of multiple layers.

If the color image forming using the three kinds of toners of the magenta, cyan, and black colors is enabled in the manner described above, cost effectiveness is attained more in comparison with the conventional apparatuses and/or methods in that the printing costs are reduced as much as for one toner not consumed. In addition, at least one holding unit is vacant for the image forming unit, and, for example, with such an arrangement that the color image forming is carried out using four kinds of color toners when the user inserts the image forming unit for the yellow color in that vacant holding unit, the user is able to select between the two alternatives: image forming with four colors, hence achieving high image quality; and image forming with three colors, hence achieving low printing costs. In that, benefits produced thereby are also selectable by the user.

BRIEF DESCRIPTION OF THE DRAWINGS

These and other objects, advantages and features of the invention will become apparent from the following description thereof taken in conjunction with the accompanying drawings which illustrate specific embodiments of the invention. In the drawings:

FIG. 6 shows the relationship between combinations of the image forming units and image forming modes;

FIG. 17 is a flowchart depicting steps involved in a printing process subsequent from the unit determination process 1 in the one example;

FIG. 28 shows comparison between three-cycle process and four-cycle process with regard to time required for image forming and frequency of replacement of the developing units.

FIG. 35 presents exemplary screenshots of a message referring to a setting state of the image forming units;

DESCRIPTION OF THE PREFERRED EMBODIMENTS

Hereinafter, preferred embodiments of an image forming apparatus in accordance with the present invention will be described with reference to the accompanying drawings.

First Embodiment (1) Configuration of Image Forming Apparatus

Figure 1:
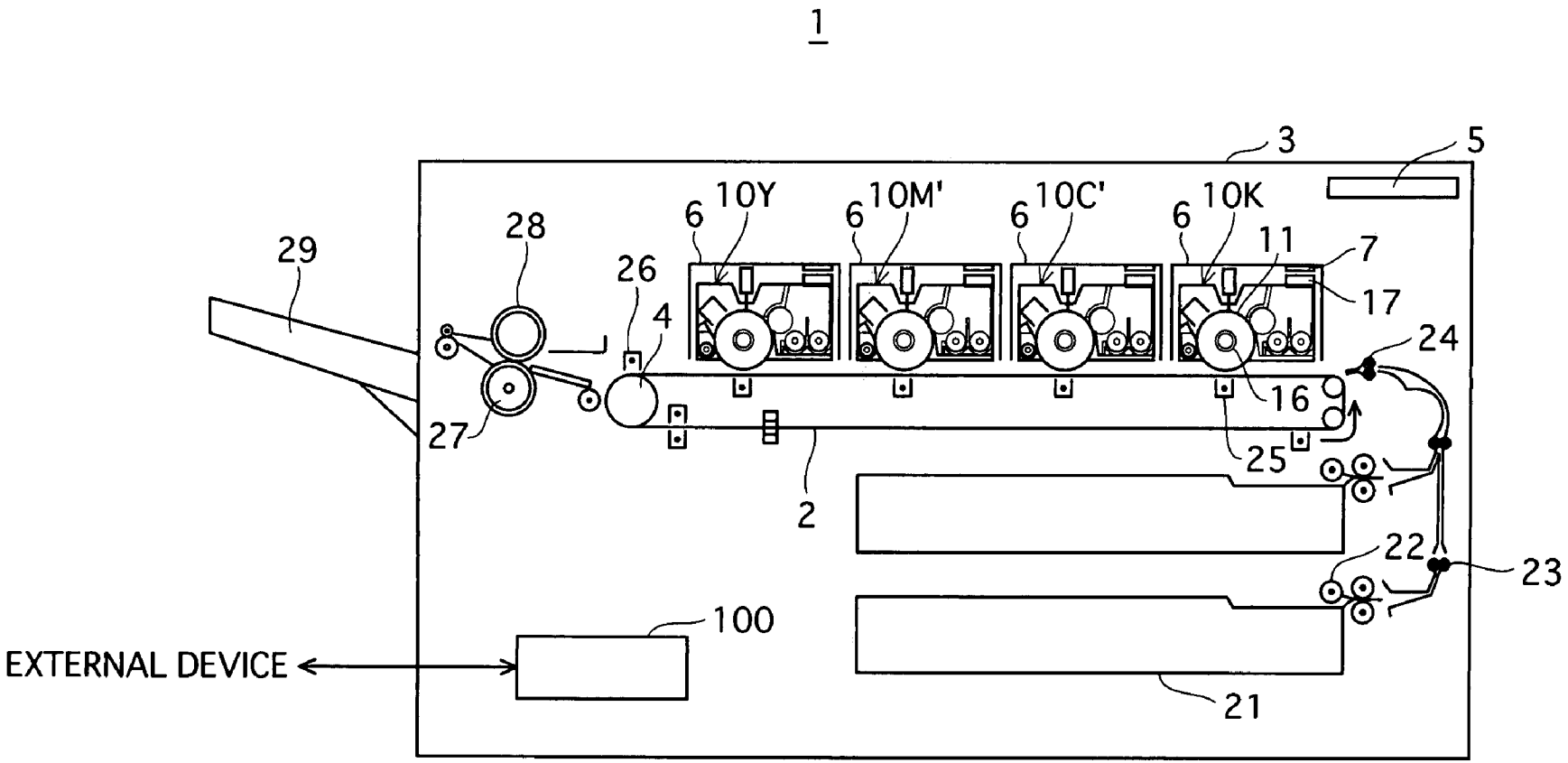
FIG. 1 shows an overall configuration of an image forming apparatus in accordance with a first embodiment of the present invention.

Now, reference is made to FIG. 1, in which an overall configuration of an image forming apparatus in accordance with a first embodiment of the present invention is shown. The figure shows the image forming apparatus of the present invention is a color digital printer 1 of a tandem type (hereinafter, simply called 'printer 1 '), and is connected to a network such as LAN. Upon reception of a command for executing a print job from an external device (not shown), the printer 1 proceeds to form a color image using toners of yellow-, magenta-, cyan-, and black-type colors. Note that yellow, magenta, cyan, and black are abbreviated Y, M, C, and K, respectively.

The printer 1 includes four image forming units 10Y, 10M', 10C', and 10K operable to form toner images of Y-, M-, C-, and K-type colors, respectively. These image forming units are disposed facing to a transfer belt 2 along that belt 2 in a rotation direction thereof from an upstream side to a downstream side serially in the order of 10K, 10C', 10M' and 10Y at certain intervals therebetween.

Letters Y, M, M', C, C', or K will be added, where needed, to constituent elements related to yellow-type, magenta-type, cyan-type, or black-type color; otherwise, those letters will be omitted. Regarding M' and C', a detailed description will be provided below.

Figure 2:
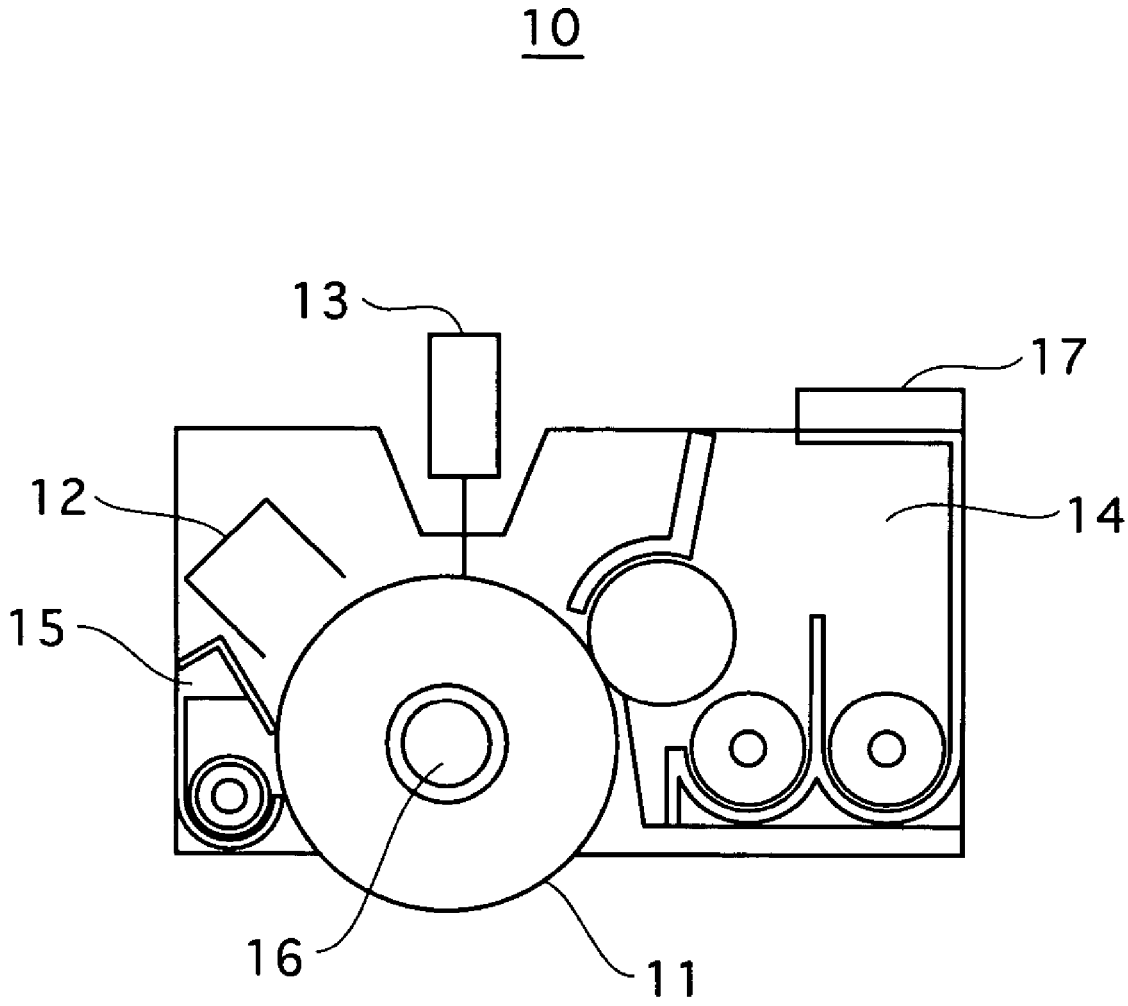
FIG. 2 is a schematic diagram of an image forming unit.

In FIG. 2, an outline of an image forming unit is shown.

As shown in the figure, an image forming unit 10 includes: a photoreceptor drum 11 serving as an image carrier; an electric charging unit 12; an image exposure device 13; a developing device 14 serving as a developing unit; and a cleaner 15. The electric charging unit 12, image exposure device 13, developing device 14 and cleaner 15 are disposed surrounding the photoreceptor drum 11. The position of the image forming unit 10 is determined using an axis 16 of the photoreceptor drum 11 with respect to a printer main body 3.

The transfer belt 2 is made of a dielectric resin sheet, and placed in such a manner as to be wrapped around multiple rollers including a drive roller 4. The belt 2 is rotatably driven in a direction indicated by the arrow in FIG. 1 by rotating the drive roller 4 using a drive unit (not shown).

The printer 1 includes a control unit 100. The control unit 100 receives, from an external device, an image signal required for completing the print job, proceeds with the processing of this signal as required to generate image data, and then converts that data to a drive signal for driving the image forming unit 10.

In the image forming unit 10, at the timing when the control unit 100 receives the drive signal from the control unit 100, the charging unit 12 charges a surface of the photoreceptor drum 11, and then the exposure device 13 forms an electrostatic latent image on that surface. After that, the developing device 14 develops the electrostatic latent image so as to form a toner image of the Y-, M-, C-, or K-type color in accordance with a toner contained therein.

Below the transfer belt 2, provided are cassettes 21 for loading recording materials used as a body subjected to transfer of the image, such as recording papers. Those papers are taken out of the cassettes by paper feeding rollers 22 so as to be transported up to a resist roller 24 using transporting rollers 23. The resist roller 24 then temporarily holds a recording paper transported, and after correcting the orientation thereof, the roller 24 feeds the paper to the transfer belt 2 at predetermined timing.

Inside the transfer belt 2, at positions facing to each of the photoreceptor drum 11, a transfer charging unit 25 is mounted. The recording papers arriving at the transfer belt 2 are electrostatically adsorbed to the transfer belt 2 by an adsorption charging unit (not shown), and then are transported onto transfer positions at which the transfer charging unit 25 comes into a face-to-face relation with the photoreceptor drum 11. At each of the transfer positions, the transfer charging unit 25 charges the transfer belt 2 from the inside thereof so that the toner images on the photoreceptor drums 11 are transferred onto the recording papers one after another.

Upon completion of multiple-transfer, the four kinds of toner images have been transferred to one recording paper. Subsequent to this, the recording paper is separated from the transfer belt 2 when electrostatic charge is removed therefrom by using a separation charging unit 26, and then is transported to paired fixing rollers 27, 28. One of the rollers 27 and 28 is heated by a heater (not shown), and thanks to the heat thereof, toners on the recording paper are fused. Thereby, the totaled four toner images are fixed onto the recording papers. The resulting papers, upon completion of full-colored image thereon, are ejected onto a paper ejection tray 29 that is provided outside of the printer main body 3.

As described above, since the image forming unit 10 is placed in the order of 10K, 10C', 10M', and 10Y along the transfer belt 2 in a rotation direction thereof from the upstream side to the downstream side, the four different-colored toner images are overlapped with the K' toner image at the bottom and the remaining images on top thereof. In this manner, with the arrangement of the K' toner image at the bottom, the fusing of the other C', M', and Y' toner images is facilitated, increasing the vividness of the colors, and hence, enhancing the reproducibility thereof.

In a case of the image forming apparatus 1 in accordance with the first embodiment of the present invention, in order to form an image, a user is prompted to select a desired mode from the operation panel 5. As an image forming mode, three modes are selectable: a full-color mode, a pseudo full-color mode, and a monochrome mode.

The full-color mode is a mode for which the color reproducibility is the focus, and image forming is carried out using four colors of Y-, M-, C- and K-types or three colors of Y-, M-, and C-types. Note that in a case of the three colors, toners of the Y-, M-, and C-type colors are mixed so as to produce the K-type color.

The pseudo full-color mode is a mode for which a matter to be considered first is costs (in a case of a tandem-type image forming apparatus, costs and speed), but not the color reproducibility, and the image forming is carried out using the three colors of M-, C-, and K-types, or the two colors of M- and C-types without relying on the Y-type color toner.

In the pseudo full-color mode, the color reproducibility is decreased due to the smaller number of colors used compared with the full-color mode. However, the amount of toners used per recording paper decreases, resulting in costs-savings.

This mode is effective in a case where it is sufficient that graphs and tables are printed colorfully, and the full-color reproduction thereof is not necessary because they are used only internally.

The reason why the Y-type toner is left unused is because the Y-type color hardly affects images to be reproduced in comparison with the M- and C-type colors, and decrease in the color reproducibility can be suppressed to the minimum. In this mode, the K-type toner is selected for use in the image forming, because using the K-type toner, it is made possible to reproduce the blackness of letters written on a business document more beautifully than the color reproduced by mixing the three of Y-, M-, and C-type colors.

When it comes to the use of the M- and C-type colors, the color reproducibility is decreased compared with the M-, C-, and K-type colors, although it is effective in terms of printing costs.

The monochrome mode refers to a mode in which only the K-type is used in the image forming.

It should be noted that although for the first embodiment of the present invention the three modes are provided including the full-color mode, pseudo full-color mode, and monochrome mode, other variations are also acceptable as an image forming mode.

(2) Detaching the Image Forming Unit

In the printer main body 3, a slot 6 is provided at four positions for use as a holding unit, and the image forming unit 10 is detachably inserted therein. Therefore, it is easy for the user to replace the image forming unit 10 when needed. For, example, when a toner of the image forming unit 10 runs out, that unit 10 is removed from the slot 6 and is replaced with a new one.

In order to detach the image forming unit 10 from the slot 6, the user is requested to open a toner access door of the printer 1 (not shown) in the first place, and to pull out the image forming unit 10 that is fitted snugly in the slot 6. Then the image forming unit 10 is pushed firmly towards the back of the main body 3 so as to be inserted. Apart from this, other variations are also feasible in order to enable the image forming unit 10 to be detachably inserted.

Each of the image forming units 10 includes an output terminal 17. From the terminal 17, an identification signal (hereinafter, simply called 'ID signal') is outputted that is used for identifying which color the relevant unit 10 is of. Provided that the ID signal is composed of three bits, for example, the image forming unit 10Y is designated as "001", 10M as "010", 10C as "011", and 10K as "100".

Each of the slots 6 has a unit connection terminal 7, building a one-to-one relationship therebetween. Once the image forming unit 10 is inserted in the slot 6, electrical connection is established between the unit connection terminal 7 and the output terminal 17 of the image forming unit 10 so as to forward the ID signal that is fed from the output terminal 17 to the control unit 100.

Subsequently, based on the three-bit information in the ID signal transported via the unit connection terminal 7, the control unit 100 (FIG. 7) makes a judgment on the image forming unit 10 in question as to which color it pertains to. Specifically, if the ID signal specific to the slot 6 in question indicates "001", it is judged that the image forming unit 10Y is fitted in that slot 6.

Moreover, in each of the image forming units 10, a toner remaining amount detection sensor 8 (FIG. 7) is provided for detecting the total amount of toner remaining in the unit 10. For this detection, a well-known liquid level sensor, photoelectric sensor or the like is employed. A detection result from the sensor 8 is notified to the control unit 100 in the form of a detection signal. Then the control unit 100 checks, based on the detection signal, whether the toner particles are left unused in the image forming unit 10.

When the toner runs out in any of the image forming units 10, the control unit 100 proceeds to display the relevant image forming unit 10 on the operation panel 5, so as to notify the user of the timing for the replacement.

Generally, every image forming unit 10 is formed in the same shape. The user is, therefore, allowed to insert the image forming unit 10 for any color into any of the slots 6.

Figure 3:
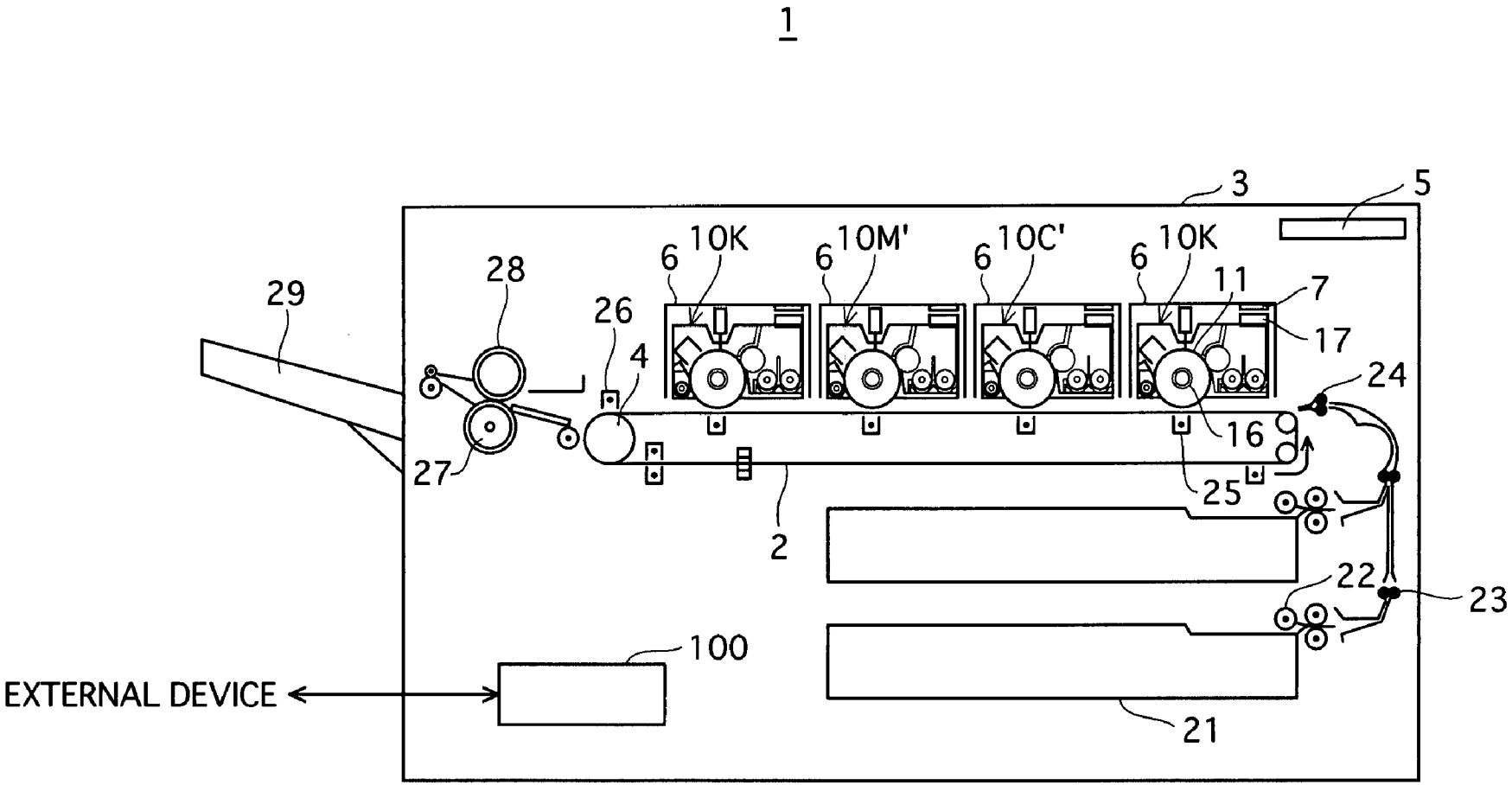
FIG. 3 shows an image forming unit for a black-type color is inserted instead of that for a yellow-type color.

Now, reference is made to FIG. 3, in which a case where the image forming unit for the K-type color is attached instead of the one for the Y-type color is presented.

In the example of FIG. 3, where the image forming units 10M', 10C', and 10K are inserted, the image forming is performed in either the pseudo full-color mode or monochrome mode. In a case where two of the image forming units 10K are inserted, the image forming using only one unit or two units together is selectively controlled. A detailed description on this will be provided below.

Note that also in the case of the pseudo full-color mode using the image forming units 10M', 10C', and 10K, the image forming operations, paper feeding, toner image transfer, toner fixation, and completed paper ejection are sequentially executed at the same timing as for the image forming using the four colors.

Figure 4:
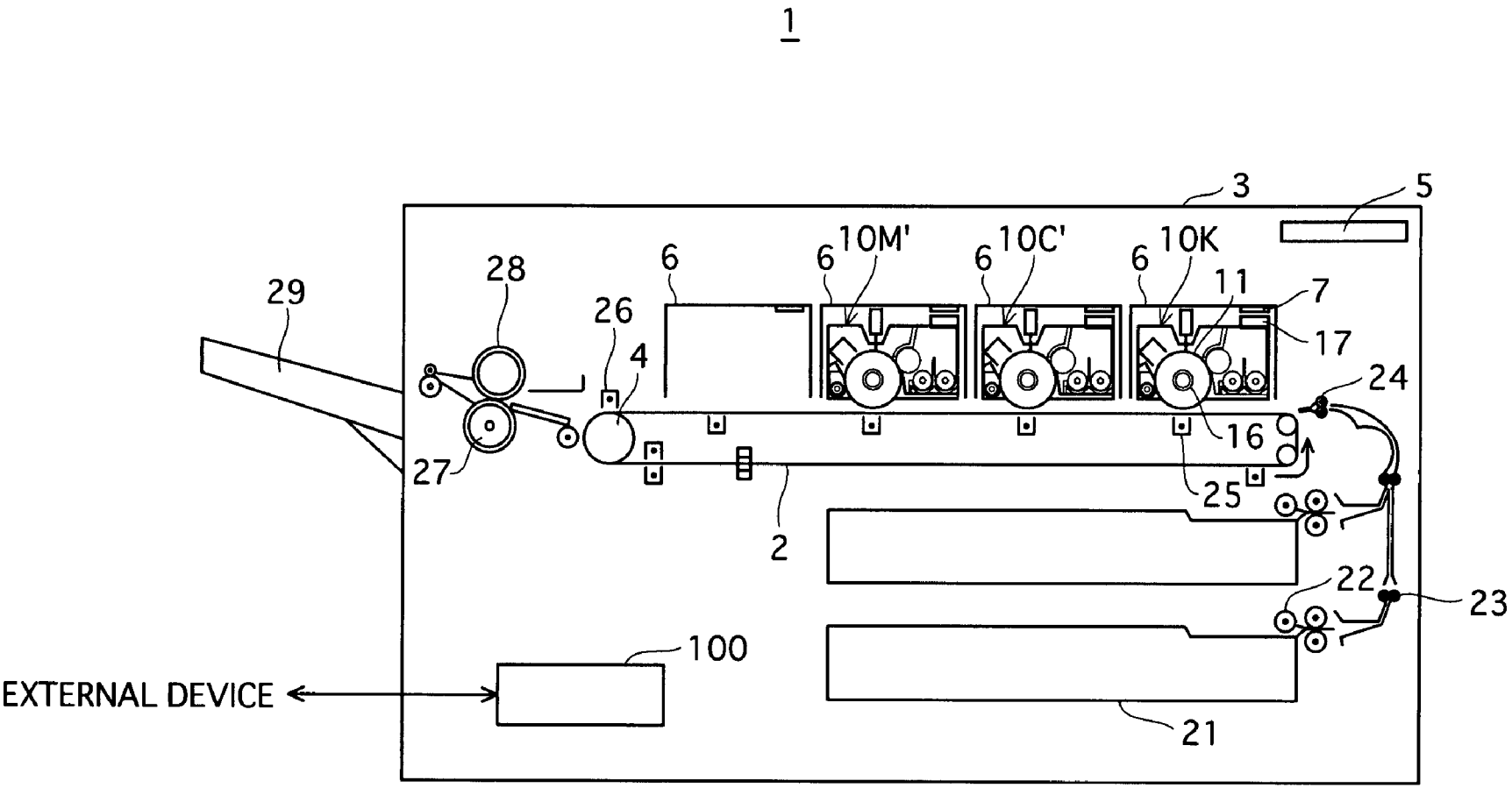
FIG. 4 shows there is a slot without the image forming unit inserted therein.

FIG. 4 shows the presence of the slot 6 in which the image forming unit 10 is not inserted. In the case as shown in the figure, since the image forming units 10M', 10C', and 10K are attached, the pseudo full-color mode and monochrome mode are selectable for the image forming operation as shown in FIG. 3.

(3) Chromaticity Points of Toners

As described above, in the first embodiment of the present invention, it is made possible to perform the image forming in the pseudo full-color mode, using the toners of the M-, C-, and K-type colors.

In the conventional techniques, color adjustment has been carried out on condition that the M and C toners for the full-color mode should be used in combination with the Y toner. Therefore, without the Y toner, it is difficult to form color images including the Y color component with high reproducibility.

Contrary to this, in the first embodiment of the present invention, so that the color images including the Y color component can be formed with relatively high reproducibility even when the Y-type color toner is not used, the image forming unit 10M' containing the toner of the M' for the pseudo full-color mode that is different in chromaticity point from that for the full-color mode, and the image forming unit 10C', likewise, containing the toner of the C' for the pseudo full-color mode that is different in chromaticity point from the toner of the C for the full-color mode are inserted.

Note that the image forming units 10M and 10C can be inserted in the slots 6 instead of the units 10M' and 10C'.

Figure 5:
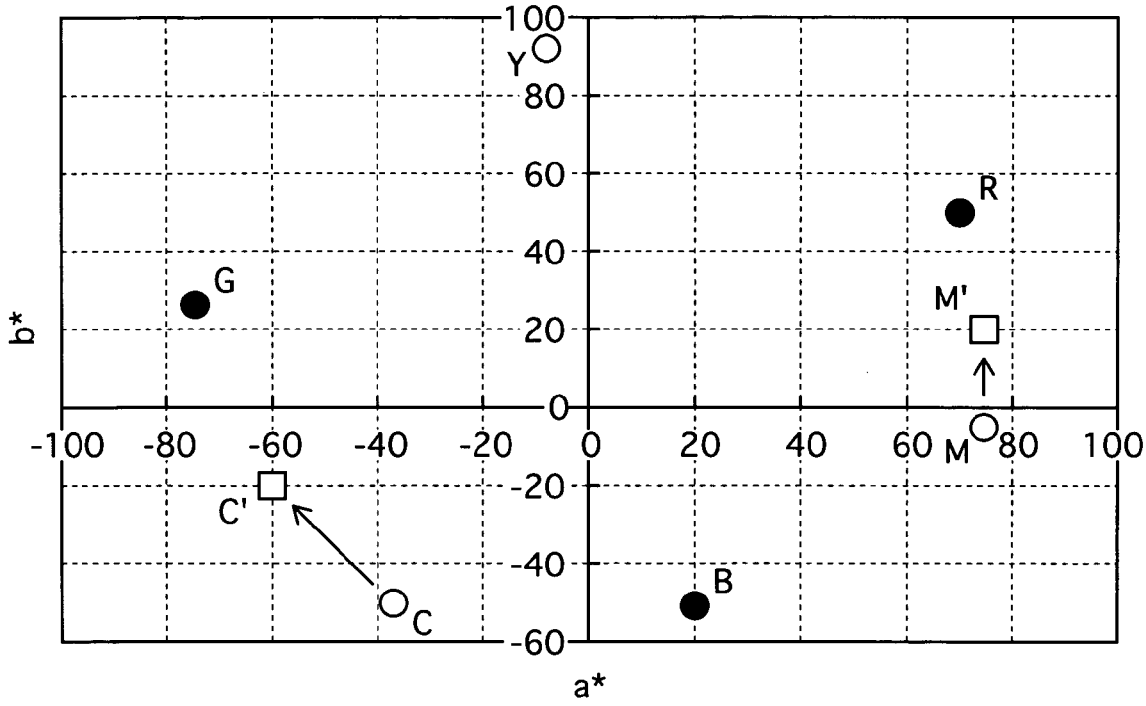
FIG. 5 is a chromaticity diagram of the L* a* b* color specification system showing chromaticity points for each color toner.

Now, reference is made to FIG. 5, presenting a chromaticity diagram of the L* a* b* color specification system showing chromaticity points of toners.

In this figure, white circles and white squares are plotted on the diagram indicating chromaticity points of the M, C, and Y toners for the full-color mode that are suitable for the full-color image forming, and the chromaticity points of the M' and C' toners for the pseudo full-color mode that are suitable for pseudo full-color image forming, respectively.

As shown in FIG. 5, the chromaticity point of the M' toner for the pseudo full-color image forming is shifted in the direction closer to the yellow hue on the diagram in comparison with that of the M toner.

Likewise, the chromaticity point of the C' for the pseudo full-color image forming is shifted in the direction closer to the yellow hue in comparison with that of the toner C.

In the M' and C' toners for the pseudo full-color image forming, the larger amount of the yellow color component is included compared with the M and C toners for the full-color image forming. Therefore, color images including the yellow color component can be formed with relatively high reproducibility without using the Y toner.

Moreover, the chromaticity point of the M' toner is shifted in the direction closer to red (R) hue on the diagram in comparison with the M toner, and the chromaticity point of the C' toner for the pseudo full-color image forming is shifted in the direction closer to green (G) hue in comparison with the C toner for the full-color image forming. Thanks to these features of the M', C' and K, the color image forming with higher reproducibility is achieved.

In the present invention, the above R is a red color produced by the subtractive color mixing of the C and Y, whereas the above G is a green color produced by the subtractive color mixing of the M and Y. As clarified above, because the toners whose chromaticity points are shifted closer to the R and G hue are used as those for the pseudo full-color image forming, the reproducibility of R and G that are produced by the Y subtractive color mixing (R=M+Y, G=C+Y) is high without relying on the Y toner. Note that it is effective to enhance the reproducibility of those R and G in that those colors are most commonly used.

How far and in which direction the chromaticity points of the M' and C' toners are shifted can be obtained in advance by conducting experiments and other, and it can be fully understood that they are not limited to the above when considering the fact that the color reproducibility is enhanced by using the M' and C' toners whose chromaticity points are shifted in directions closer to the Y hue on the chromaticity diagram. For example, it is preferable that the chromaticity point of the M' toner be positioned in a vicinity of or extremely close to the R hue (a*:68.5, b*:48.0), when the Japan Color standard is the base and viewed with the 2-degree view field, D50. Likewise, it is preferable that the chromaticity point of the C' toner be positioned in a vicinity of or extremely close to the G hue (a*:−73.5, b*:25.0).

Moreover, even when any standard other than the Japan Color is adopted, such as SWOP (Specification for Web Offset Publications) or Euro Color, the same or similar effects can be achieved as mentioned above, if such an arrangement is made that the chromaticity points of the M' and C' toners are plotted on the diagram closer to the Y hue, more preferably closer to the Y hue and also to the R and G hue.

In the first embodiment of the present invention, when the pseudo full-color mode is entered, the M' toner is used in combination with the C' toner. However, it is also feasible that color images can be formed with high reproducibility while in the pseudo full-color mode, using either the M' or C' toner, depending on the adjustment of the chromaticity points of those toners. One example for this is that the color images are formed in the pseudo full-color mode using the M' and C toners, or using the M and C' toners.

In order to manufacture toners for the pseudo full-color image forming, it is suggested, as an example, color materials whose chromaticity points are shifted are included in a binder resin and other ingredients following a conventional technique for manufacturing the toners for the full-color image forming.

(4) Combining the Image Forming Units

As described above, the user can select any one of the image forming unit 10 from those designated as 10Y, 10M, 10M', 10C, 10C' and 10K so as to be inserted in the slot 6. However, it should be noted that depending on a combination of the units 10, the image forming may be performed in the full-color mode, the pseudo full-color mode and the monochrome mode, and none of the modes may be implemented.

In order to address this matter, in the first embodiment of the present invention, certain combinations are determined in advance according to which when the kind of the image forming unit 10 is identified, the kind of the image forming mode executable is determined. Actually, when the image forming unit 10 is inserted, the kinds of the image forming modes executable are notified to the user, and in return, a selection input is sent back in accordance with the selection by the user. Then the mode selected therewith is entered.

Now, reference is made to FIG. 6, showing the correspondence between combinations of the image forming units to the modes executable.

When looking at the column 1001 in FIG. 6, it is found that the image forming units 10Y, 10M, 10C, and 10K are inserted, and under that condition, all the modes can be executed. Then, from the column 1002, it is found that the image forming units 10M, 10C, and 10K are inserted. Under that condition, the pseudo full-color mode and monochrome mode are executable. Moreover, from the column 1003, it is found that when the image forming units 10M', 10C', and 10K are inserted, the pseudo full-color mode and monochrome mode are executable.

Note that a label (not shown) indicating unit-specific information such as a name is put on the surface of each unit 10 so that from that information the user is able to know the color and chromaticity point of a toner filled in that unit. With the use of that label, it is made possible to tell one unit from another without confusing. A description will be made later on the information provided under the heading 'WASTE TONER COLLECTION UNIT' in FIG. 6.

(5) Configuration of the Control Unit

Figure 7:
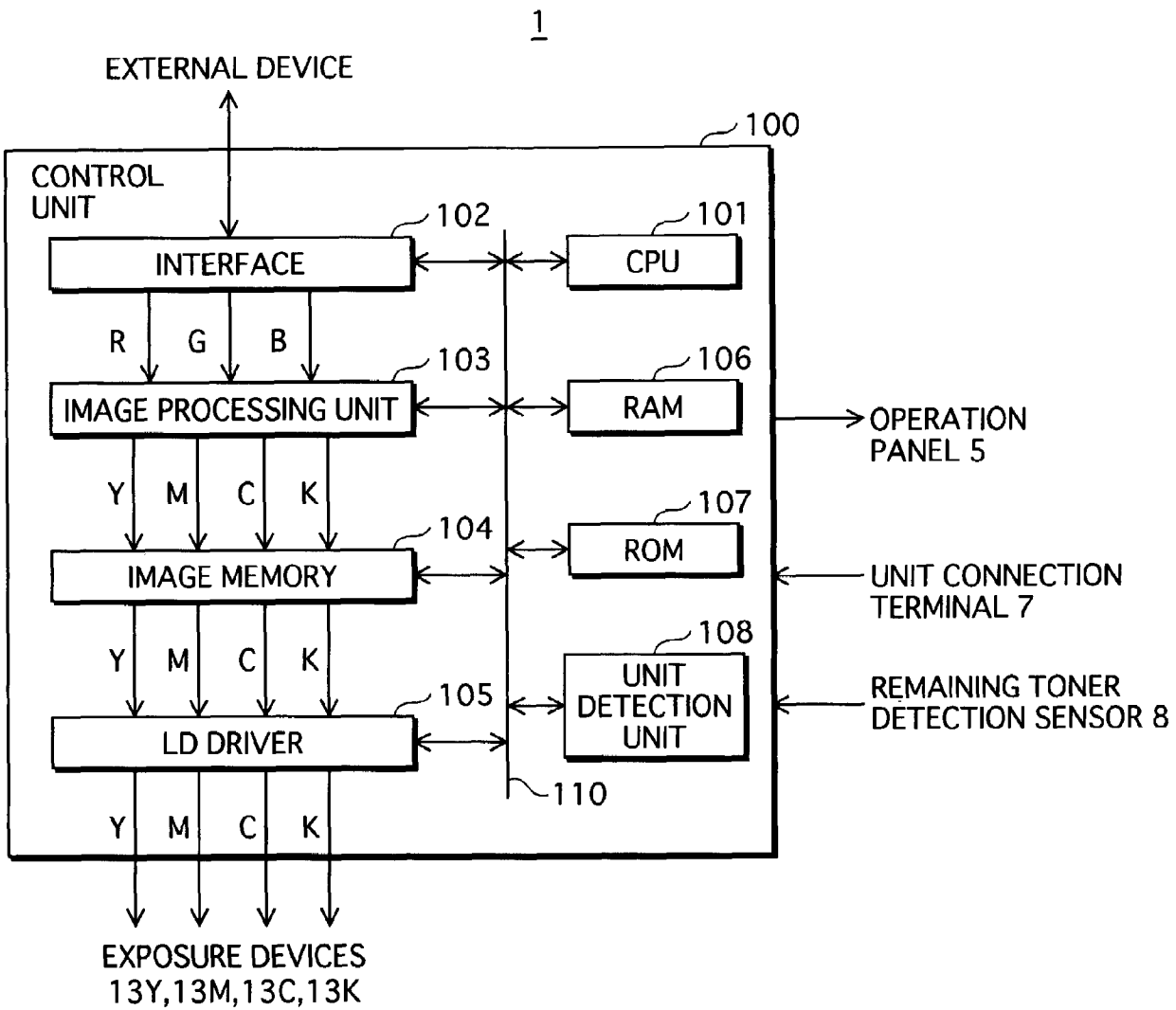
FIG. 7 is a block diagram showing a configuration of a control unit in accordance with a first embodiment of the present invention.

Now, reference is made to FIG. 7, in which a block diagram of a control unit in accordance with the first embodiment of the present invention is shown.

As shown in the figure, the control unit 100 includes: a CPU 101; a communication interface 102; an image processing unit 103; an image memory 104; an LD driver 105; a RAM 106; a ROM 107; and an unit detection unit 108 as main components. In the control unit 100, data is transported using a bus 110.

The communication interface 102 is provided for communication with a network such as a LAN card or LAN board.

The unit detection unit 108 receives an identification signal (hereinafter, simply called 'ID signal') for identifying each image forming unit 10 inserted through the unit connection terminal 7 so as to determine which of the units 10 is inserted in which of the slots 6.

The image processing unit 103 receives an image signal including data pertinent to the colors red (R), green (G), and blue (B) through the communication interface 102, performs a well-known correction process such as shading, and converts, on a per-pixel basis, data that has undergone the correction process into a digital image signal (image data) that is used for reproducing the Y-, M-, C-, and K-type colors. This digital image signal is outputted to the image memory 104.

Figure 8:
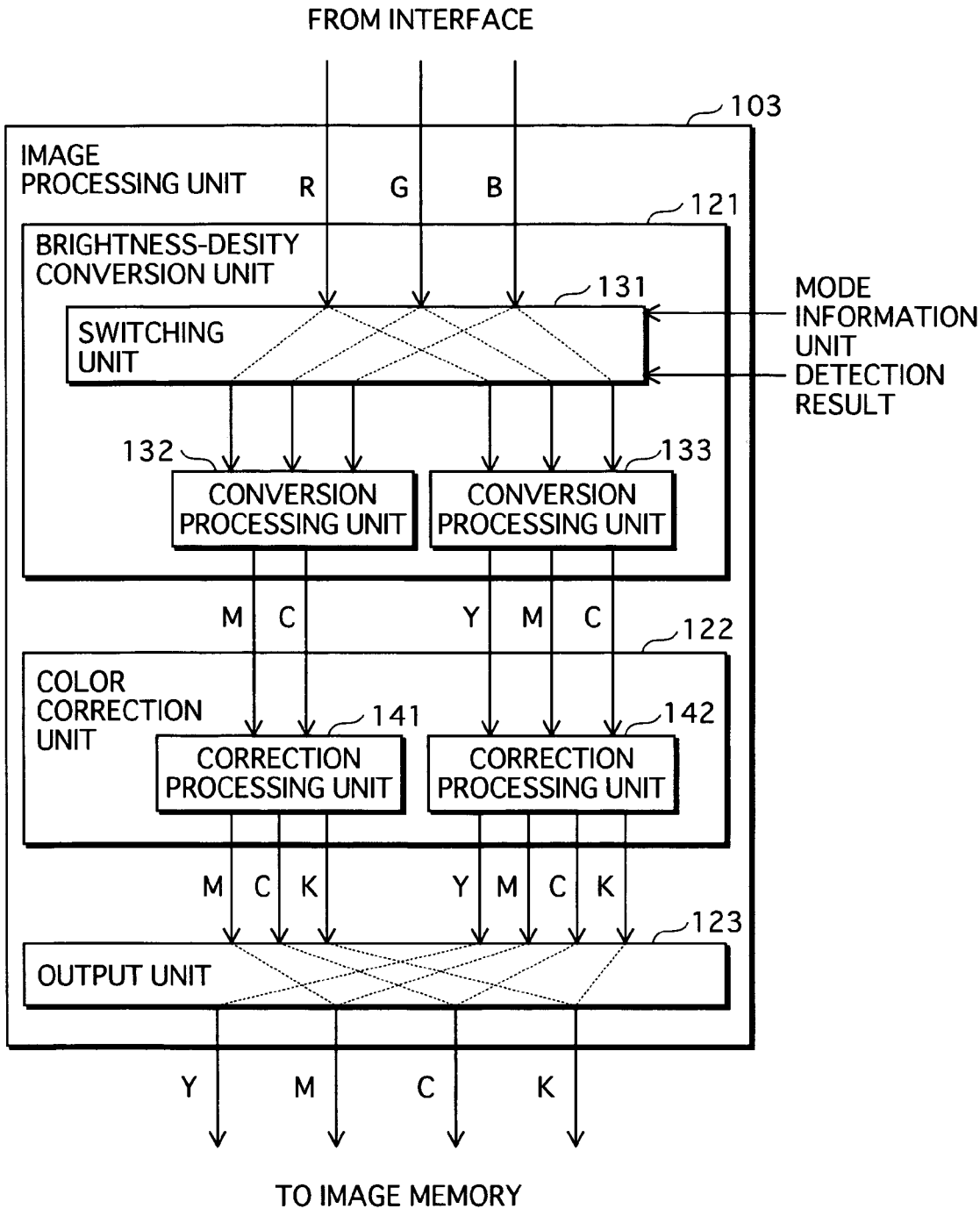
FIG. 8 is a block diagram showing a configuration of an image processing unit in accordance with the first embodiment of the present invention.

FIG. 8 is a block diagram showing a configuration of an image processing unit in accordance with the first embodiment of the present invention.

As shown in the figure, the image processing unit 103 includes: a brightness-density conversion unit 121; color correction unit 122; and an output unit 123.

The brightness-density converter 121, including a switching unit 131 and conversion units 132, 133, converts brightness data into density data.

In order to accomplish the brightness-density conversion, the switching unit 131 switches between the conversion units 132 and 133 in accordance with mode information indicating which of the image forming modes has been selected by the user and a result from the unit detection unit 108.

Specifically, if the full-color mode or monochrome mode is selected, the conversion unit 133 is selected.

The conversion processing unit 133 converts R, G, and B indicating brightness of each color into Y, M, and C indicating density of each color, by applying a predetermined conversion formula. Coefficient of this formula is obtained from experiments and other, based on the well-known formula used in the brightness-density conversion, with chromaticity points of toners used taken into account, so that preferable color reproducibility can be achieved in the full-color mode.

In the first embodiment, two formulas are prepared for the four colors of Y-, M-, C- and K-types, and for the three colors of Y-, M-, and C-types. This is because the combinations of the toners used to reproduce colors differ in accordance with the combination of the image forming units 10. Which of the two formulas is to be applied is determined based on the result of the unit detection. For example, if the image forming units 10Y, 10M, 10C, and 10K are inserted, the formula for the four colors of Y-, M-, C-, and K-types is selected.

On the other hand, if the pseudo full-color mode is selected, the conversion processing unit 132 is selected.

The conversion processing unit 132 then proceeds to convert R, G, and B into M and C using a predetermined conversion formula that is different from the one used by the conversion processing unit 133. Coefficient of a formula different from the one used by the conversion unit 133 is obtained from experiments and other so that the color reproducibility becomes optimum in the pseudo full-color mode.

In the conversion processing unit 132, totaled four formulas are prepared so as to cope with the pseudo full-color mode: one for the combination of the M, C, and K; one for the M and C; one for the combination of the M', C', and K; and one for the M' and C'. Which of the four formulas should be selected is determined in the same manner as for the conversion processing unit 133.

The switching unit 131 transports RGB color data to the selected conversion processing unit 132 or 133. Upon reception of that color data, the relevant conversion processing unit 132 or 133 converts the color data into density data using a conversion formula specific to the processing unit. Then the resulting data is outputted to the color correction unit 122.

The color correction unit 122 includes the color correction processing units 141, 142, and executes processing such as UCR (Under Color Removal), BP (Black Replacement), and γ correction so that the density data from the brightness-density conversion unit 121 can be converted into image data including the K color, and is transported to the output unit 123.

The correction unit 142 executes the UCR and other processing using various kinds of conversion formulas predetermined therefor. In order to use these formulas, their coefficients are obtained based on the well-known formula, from experiments and other, with chromaticity points of toners used taken into account, so that the color reproducibility becomes optimum in the full-color mode.

As conversion formulas, those corresponding to the combinations of colors used, that is, formulas that correspond to the two formulas for the conversion processing unit 133 are prepared in advance, and the one that corresponds to the formula used by the conversion processing unit 133 is selected.

On the other hand, the correction processing unit 141 uses the different formula from the one used by the correction unit 142 so as to execute the processing such as the UCR. Coefficients of this formula are obtained from experiments and other so that the color reproducibility becomes optimum in the pseudo full-color mode.

As the different formula, a formula that corresponds to a combination of colors used, that is, those corresponding to each of the four formulas used by the conversion processing unit 132 are prepared in advance, and the one corresponding to the formula used by the conversion unit 132 is selected.

In this respect, the conversion processing unit 132 and the correction processing unit 141 have capability as an unit operable to generate data for any colors to be reproduced other than the Y color, even if the data including the Y color component is inputted so as to specify the colors to be reproduced.

The output unit 123 supplies the image data from the correction units 141, 142 to the image memory 104 for each color.

Note that although the four formulas are prepared for the conversion processing unit 132, another method is also feasible in which one or two conversion formulas are used depending on an effect given to the color reproducibility. By doing so, it is made possible to simplify the processing such as conversion. This is true of the conversion processing unit 133, and correction units 141, 142.

As described above, a method in which, on the basis of a conventional conversion formula, a different coefficient is used in accordance with an image forming mode selected and other factor. However, the method is not limited to this, and it is also feasible that conversion, correction processing and other processing are executed basically using the conventional methods when the full-color mode and monochrome mode are entered, and on the other hand, when the pseudo full-color mode is entered, anew conversion formula is obtained from experiments and other that copes with the arrangement for forming color images using only three colors of M-, C-, and K-types in accordance with the present invention. Moreover, it is also feasible that if data conversion is performed based on predetermined conditions, any methods other than the use of formulas can be used, such as the use of a conversion table.

It is shown in FIG. 7 that the LD driver 105 reads image data for each color from the image memory 104 under the control of the CPU 101, and drives each of the exposure devices 13Y, 13M, 13C, and 13K.

The ROM 107 stores therein computer programs pertinent to image forming operation, sheet feeding operation and other operations, computer programs pertinent to notifying a user of an image forming mode selectable, if any, and a mode display processing (described later) through which an entry regarding a mode selected by the user is received.

The RAM 106 becomes a work area when the execution of a program is in progress in the CPU 101.

The CPU 101 reads a computer program required from the ROM 107, controls the image forming operation, sheet feeding operation and other operations in parallel, while at the same time considering all the timing, so as to carry out a smooth printing operation.

Moreover, the CPU 101 adjusts the timing for the operations from exposure to transfer for each color in accordance with a combination of the image forming units 10 inserted. Specifically, if the image forming unit 10 is inserted in the order of the K, C', M', and Y from the upstream side of the transfer belt 2, for example, the unit 10C' is located at the downstream side with respect to the unit 10K. However, if the unit location order is Y, M', C', and K, the unit 10C' is located at the upstream side with respect to the unit 10K. This means that it is necessary to adjust the timing for exposure depending on which of the units 10 is inserted in which of the slots 6.

In accordance with the first embodiment of the present invention, optimum conditions for executing the exposure and other operations are obtained in advance from experiments and other for each combination of the image forming units 10 in FIG. 6, that is, timing information for determining based on which of the image forming units 10 is inserted in which of the slots 6, and at which timing, the exposure and other operations can be executed in the most preferable manner. Such timing information is stored in the ROM 107. When determining the kinds of the image forming unit 10 and the slot 6, the CPU 101 reads the exposure timing in accordance with the combination of the units 10 from the timing information stored in the ROM 107, and proceeds with the exposure operation based on the timing information. Furthermore, the CPU 101 executes the mode display process.

(6) Processing by the Control Unit

Figure 9:
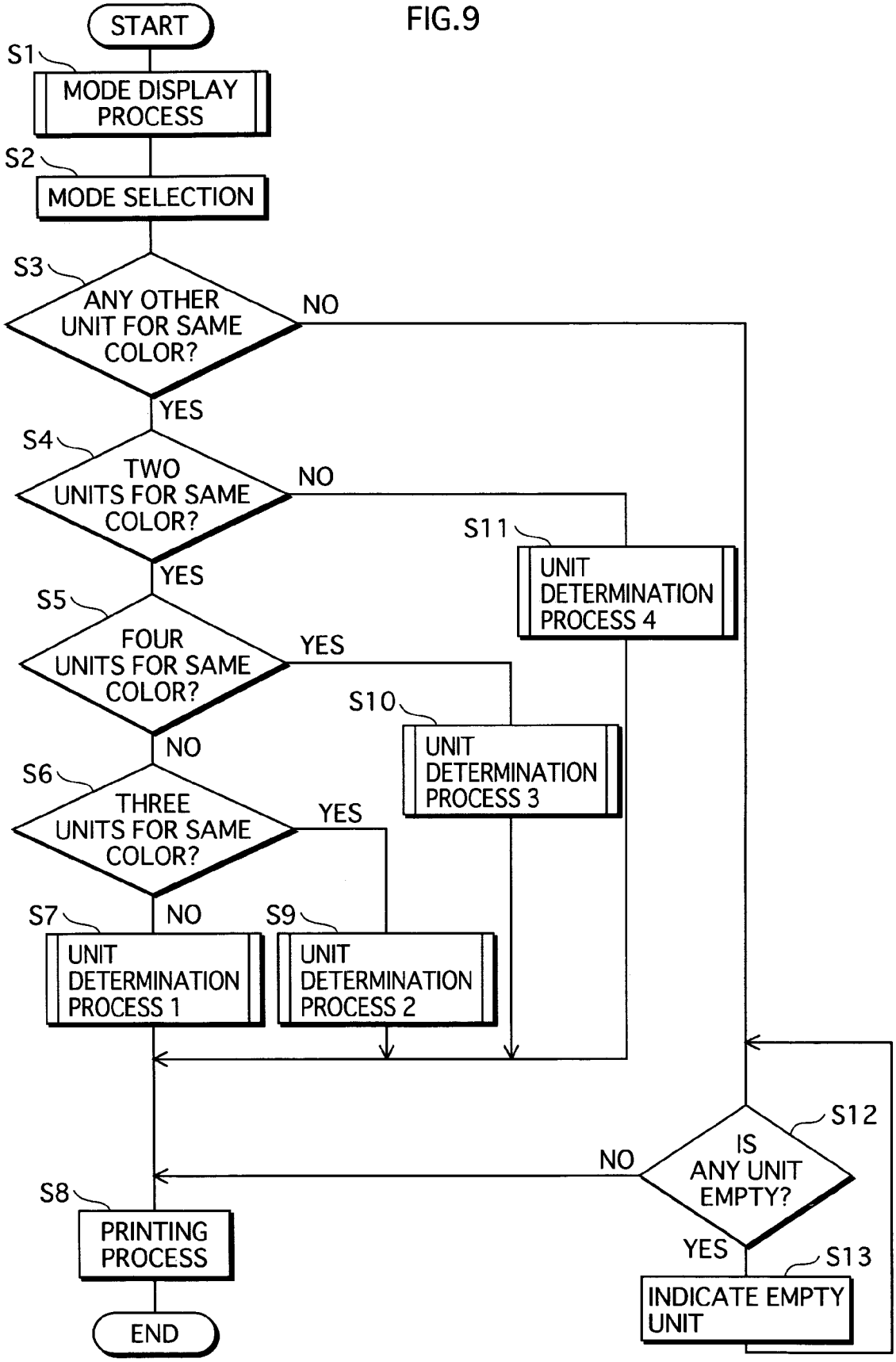
FIG. 9 is a flowchart depicting steps pertinent to a print job executed by the control unit.

Now, reference is made to FIG. 9, in which a flowchart depicting steps involved in a print job executed by a control unit is presented.

As shown in the figure, the control unit 100, upon reception of a print job, executes mode display process (S1).

Figure 10:
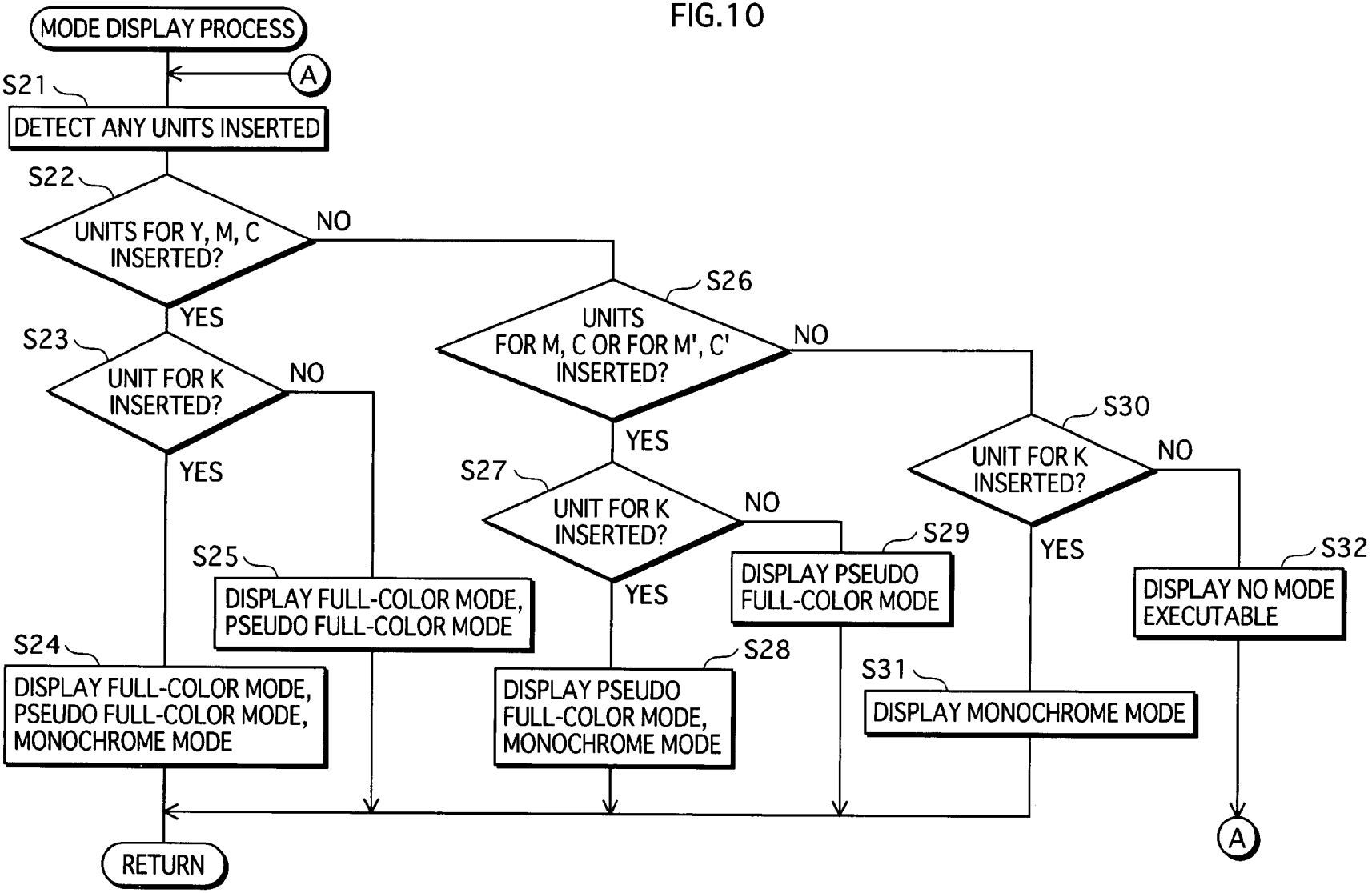
FIG. 10 is a flowchart depicting steps involved in a mode display process.

In FIG. 10, the progress of the mode display process is explained step by step.

As shown in the chart, in the mode display process, the setting state of the image forming units 10 is detected (S21). This state detection is carried out by the unit detection unit 108.

After that, it is determined whether or not the image forming units 10 for the Y, M, and C are inserted into the slots 6 (S22). Then, if the insertion of all these units is confirmed (YES in S22), the determination is further made on whether or not the image forming unit for the K is inserted in the slot 6 (S23). Then, if the insertion of the unit 10 for the K inserted is confirmed (YES in S23), a message indicating that the image forming mode is selectable from the full-color mode, pseudo full-color mode, and monochrome mode is displayed on the operation panel 5 (S24) so as to prompt the user to select one.

Figure 11:
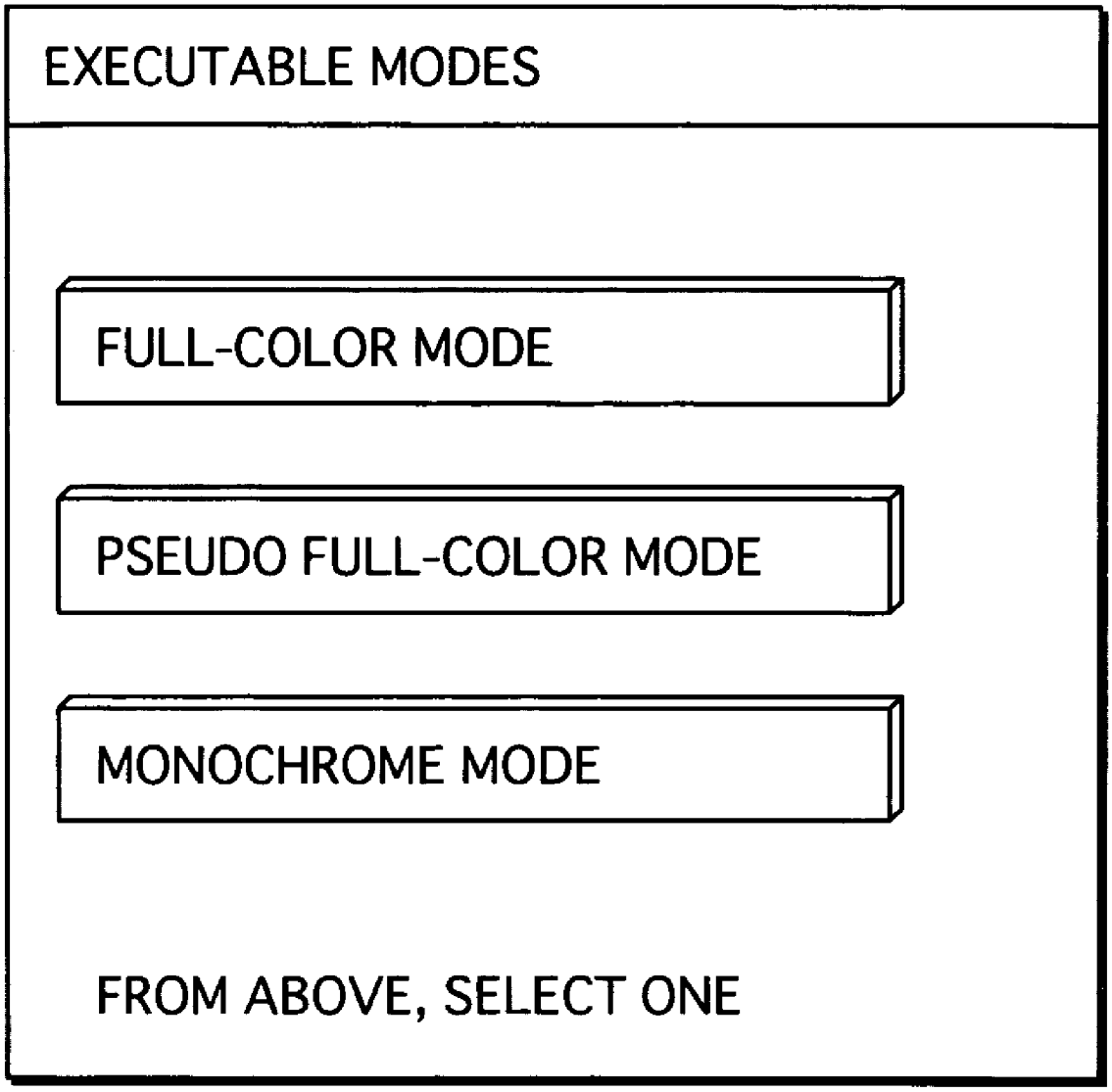
FIG. 11 presents a screenshot showing a message on an operation panel on which image forming modes selectable are shown.

FIG. 11 is a message display appearing on the operation panel indicating image forming modes selectable.

As shown in the figure, a message display 111 on the operation panel 5 presents three buttons for selecting one from the full-color mode, pseudo full-color mode, and monochrome mode. The user can select one appropriate mode by pressing its corresponding button on the panel.

In a case where an arrangement is adopted that before a color image is formed in accordance with the combinations of the image forming units each capable of forming a color image, image forming modes corresponding to those combinations are obtained, and information indicating the modes obtained is outputted, a user is able to know which image forming modes are executable ahead of the execution of the image forming. Thereby, it is made possible to form an image using a method suitable for a use of the completed image, while the image quality and printing costs are taken into account. Moreover, in a case where such an arrangement is adopted that once an entry is received from the user so as to specify a mode from those displayed on the panel, the mode specified therewith is executed, the user is able to form an image in the image forming mode of his or her choice.

Note that prompting a user to select an optimum image forming mode is the focus here. Therefore, an outputting method is not limited to the message as described above, and in order to prompt the user to select an optimum mode, other variations such as audio outputting and sending a command to an external device that has originally sent a request for executing a print job are also feasible. Note that regarding all those steps involved in the message display process that will be described, hereinafter, in detail, other variations are also feasible.

Returning to S23, if it is confirmed that the image forming unit 10 for the K is not inserted in any of the slots 6 (NO in S23), a message indicating that the image forming mode is selectable between the full-color mode and pseudo full-color mode is displayed on the operation panel 5 (S25).

Returning to S22, if it is confirmed that at least one of the three image forming units for the Y, M, and C is not inserted (NO in S22), it is then determined whether or not the image forming unit 10 is inserted in the combination of the M and C, or the combination of the M' and C' (S26).

Then, if either of the above combinations is confirmed (YES in S27), the determination is made on whether or not the image forming unit 10 for the K is inserted (S27). Then, if the insertion of the unit 10 for the K is confirmed (YES in S27), a message indicating that the mode is selectable between the pseudo full-color mode and monochrome mode is displayed on the operation panel 5 (S28).

In S27, it is confirmed that the image forming unit 10 for the K is not inserted (NO in S27), a message indicating that the pseudo full-color mode is selectable is displayed on the operation panel 5 (S29).

Returning to S26, it is determined whether or not the image forming unit 10 for the K is inserted (S30). Then, if the insertion of that unit 10 is confirmed (YES in S30), a message indicating that the monochrome mode is selectable is displayed on the operation panel 5 (S31).

If the absence of the image forming unit 10 for the K is confirmed, i.e., 'NO' is returned in S30, a message on the panel 5 indicates that no mode is selectable (S32), and after that, the process returns to S21. As soon as the unit 10 is inserted by the user, and accordingly, any of the modes becomes executable, the process is to return to a main routine after executing any of the steps S24, S25, S28, S29, and S31. In this respect, the control unit 100 is capable, as an outputting unit, of outputting the image forming modes in accordance with the combinations of the units 10, when executing the process such as S24, S25, S28, S29, and S31.

Note that in a case where a state in which none of the modes is executable continues for a certain period of time, such an arrangement is feasible that a message indicating that it is impossible to complete the print job is displayed on the operation panel 5, and thereby, the relevant job is reserved or cancelled.

In the above example, the user is able to select an optimum image forming mode from the modes displayed on the message display 111. When none of the modes appearing on the display 111 matches the user's intention, the user is able to change the image forming unit 10.

For example, if the message display 111 shows only the monochrome mode is executable, regardless of the user's wish to select the full-color mode, some or all of the image forming units 10 are changed so as to have the units 10 for the Y, M, and C inserted in the slots 6, thereby enabling the operation in the full-color mode.

Apart from the above, such an arrangement is also adoptable that when some or all of the units 10 are changed by the user, while the message display 111 is being shown, the process returns to S21, and execute again all processes after S22. This is effective in a particular case where the message display 111 indicates only the monochrome mode is executable, regardless of the user's wish to select the full-color mode.

In the above example, the user is to select an optimum image forming mode. However, such an arrangement that the printer 1 automatically executes the mode selection is also feasible. Specifically, a method for determining a mode in which compared with any other modes, more image forming units 10 are used so as to give the top priority to the image quality to be the image forming mode is adoptable in a case where multiple modes are executable.

Moreover, it is also feasible that in a case where the user has misplaced the image forming units 10, another message that is different from the message display 111 is shown on the operation panel 5 so as to notify the user of the misplacement and to prompt the user to change the units 10 in question, and after that, the processing after S22 is executed. Examples of this misplacement include a combination of the image forming units 10M' and 10C, and a combination of the units 10M and 10C' as for the units for the M- and C-type colors, that is, cases where a toner for the full-color mode is used in combination with a toner for the pseudo full-color mode.

As shown in FIG. 9, in S2, when the user enters an input through the message display 111 that is shown in response to the mode display process in S1, the reception of the entry for selecting an optimum image forming mode is confirmed, and the process moves onto S3 so as to turn off the message display 111. In this respect, the control unit 100 is capable, as a receiving unit, of receiving an entry for specifying an image forming mode of the user's choice, when S2 is executed.

In S3, it is determined whether or not two or more of the image forming units 10 for one color are inserted that are to be used when the image forming mode selected is executed. This is because which of the units 10 is to be used for image forming is determined before the printing operation is actually carried out, in a case of the presence of multiple units 10 for one color.

Examples of such a case are: (a) all the four units 10 are of the same color; (b) three units 10 are of the same color while one is of a different color; (c) two units 10 are of the same color while the remaining two are of the different colors from each other; and (d) two units 10 are of the same color while the remaining two are of a different color.

In the present embodiment, in a case of two or more image forming units 10 are present for one color, a toner of the unit 10 is used in the rotation order of one located at the upstream side of the transfer belt 2 to one located at the downstream side thereof.

Specifically, if the presence of multiple image forming units 10 for one color is detected (YES in S3), the determination is further made on the number of such colors (S4). If only one such a color is confirmed (YES in S4), then determination is made on the number of the image forming units 10 for that color in question (S5). If it is confirmed that the number is not four (YES in S5), the further determination is made on whether or not that number is three (S6). If it is confirmed that the number is not three but two (NO in S6), a unit determination process 1 is executed (S7).

Figure 12:
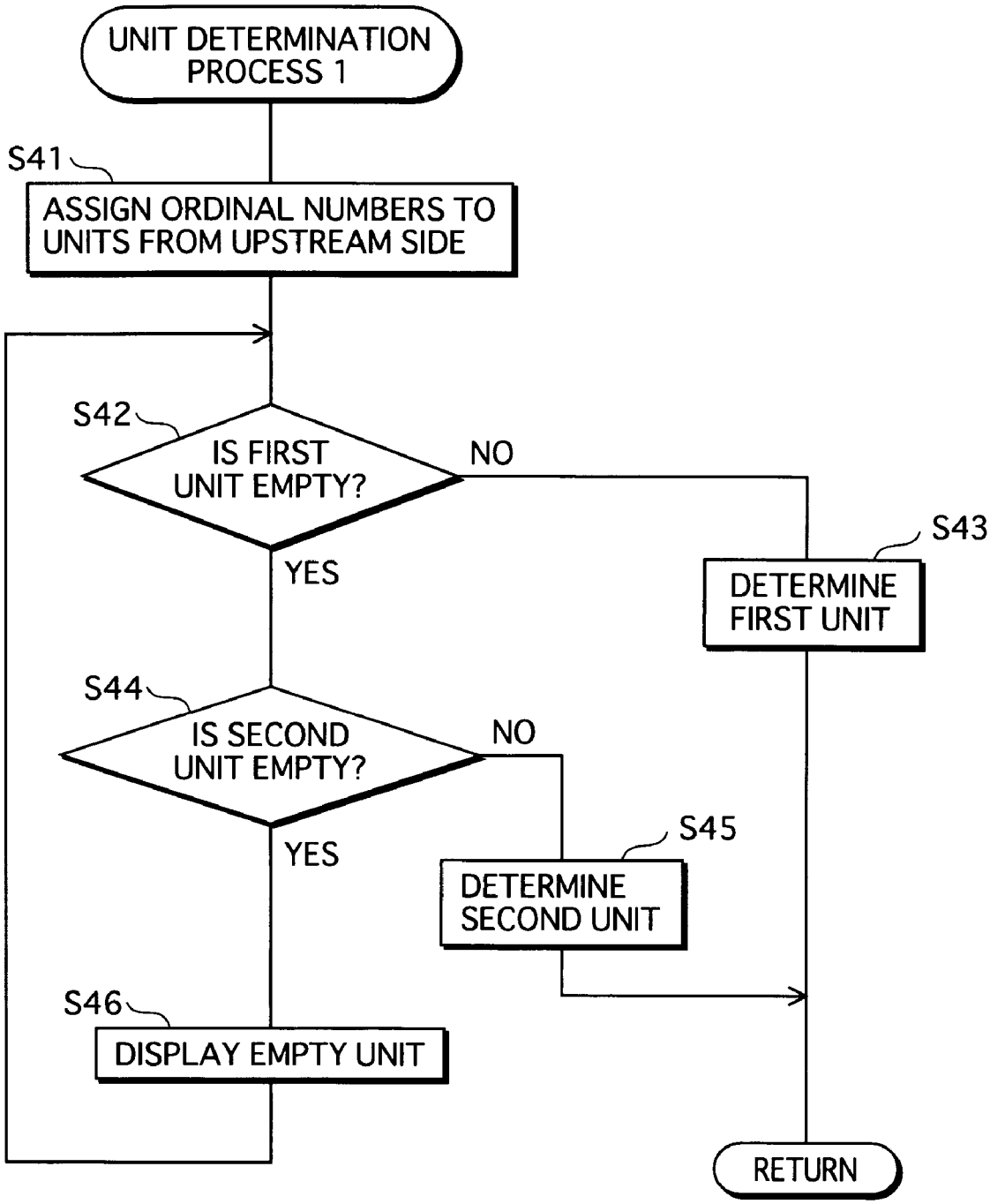
FIG. 12 is a flowchart depicting steps involved in a unit determination process 1.

FIG. 12 is a flowchart depicting steps involved in the unit determination process 1.

As shown in the chart, in the unit determination process 1, the image forming unit 10 is, in the first place, assigned an ordinal number in the order from one located at the upstream side of the transfer belt 2 to one located at the downstream side thereof (S41). Subsequently, it is determined whether or not the first image forming unit 10 is empty (S42). If not empty, that is, certain toner particles are left unused (NO in S42), the first image forming unit 10 is selected to be used in the printing operation (S43).

Otherwise, if the first image forming unit 10 is empty (YES in S42), it is then determined whether or not the second image forming unit 10 is empty (S44). Then, if the second unit 10 is not empty (NO in S44), the second unit 10 is selected to be used in the printing operation (S45). Note that if the second unit 10 is also empty (YES in S44), the fact that the toner of that color has run out is indicated on the panel 5 (S46) so as to prompt the user to replace the relevant empty unit 10 with a new one.

As shown in FIG. 9, in the course of S8, the printing operation is carried out in the image forming mode selected in S2 so as to complete the print job. In a case where the pseudo full-color mode is selected, the image forming units 10M', 10C', 10K (first), and 10K (second) are inserted, and the image forming unit 10K (second) is determined to be used, the units 10M', 10C', and 10K (second) are used for the pseudo full-color image forming.

Every time any other jobs later than the print job are executed, the above-described process is performed. Therefore, if two or more of the units 10 are identified to contain the toners of the same color, the order of the image forming units 10 to be used is from the upstream side of the transfer belt 2 to the downstream side thereof. This is also true of unit determination processes 2 through 4, which will be described later.

Note that which of the units 10 to be used is determined, as described above, depending on whether or not the toner contained therein is empty. However, the determining condition is not limited to this, and the unit 10 to be used is determined depending on whether or not the unit 10 is capable of forming an image based on the presence or absence of a mechanical or electrical error.

Returning to S6, if three of the units 10 are identified to contain the toners of the same color (YES in S6), the unit determination process 2 is executed (S9).

Figure 13:
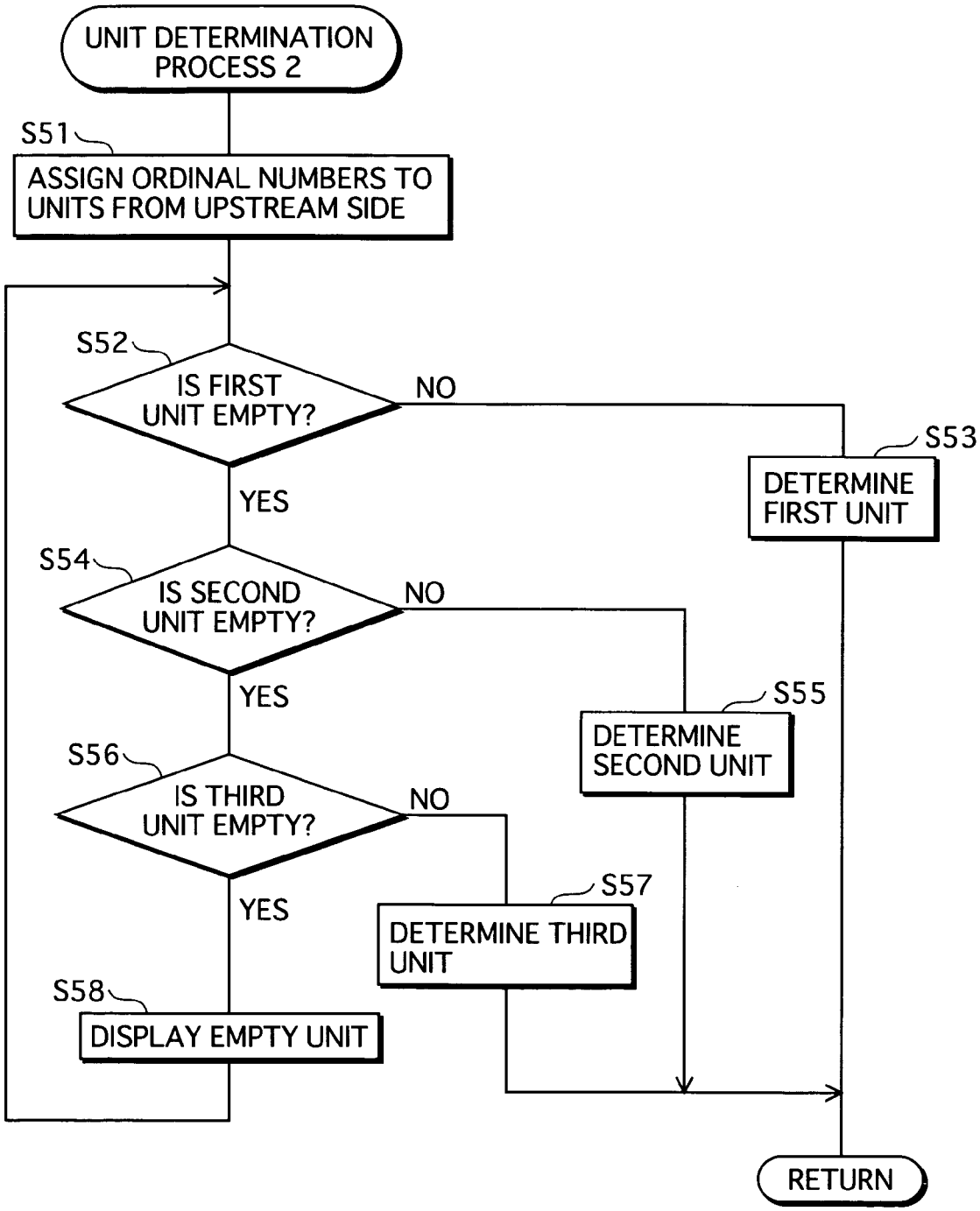
FIG. 13 is a flowchart depicting steps involved in a unit determination process 2.

FIG. 13 is a flowchart depicting steps involved in the unit determination process 2.

As shown in the chart, in the course of the unit determination process 2, the image forming units 10 for the same color are, in the first place, assigned ordinal numbers first, second, and third in the order of the unit 10 at the upstream side of the transfer belt 2 to the downstream side thereof (S51). Subsequently, it is determined whether or not the first unit 10 is empty (S52), and then, if it is confirmed that certain toner particles are left unused in the unit 10 (NO in S52), the first unit 10 is determined to be used in the printing operation (S53).

In S52, if the first unit 10 is empty (YES in S52), it is determined whether or not the second unit 10 is empty (S54), and if the second unit 10 is not empty (NO in S54), that unit is determined to be used in the printing operation (S55).

If the second unit 10 is also empty (YES in S54), it is determined whether or not the third unit 10 is empty (S56). If the third unit 10 is not empty (NO in S56), the third unit 10 is determined to be used (S57). Note that if the third unit 10 is also empty (YES in S56), the fact that the toner of that color has run out is displayed on the operation panel 5 (S58) so as to prompt the user to replace the empty unit 10 with a new one.

As clarified above, even in a case where three of the units 10 are of the same color, the number of the units 10 to be used is narrowed down into one as shown in FIG. 9. When the units 10 to be used in the printing operation are determined (S9) in order to reproduce a color for which three of the units 10 have been identified, the unit 10 determined in the unit determination process 2 (S9) is used, whereas, as for the remaining colors, each corresponding unit 10 is used, thereby completing the printing operation (S8).

In S5, if four units 10 are present for the same color (YES in S5), the unit determination process 3 is executed (S11).

Figure 14:
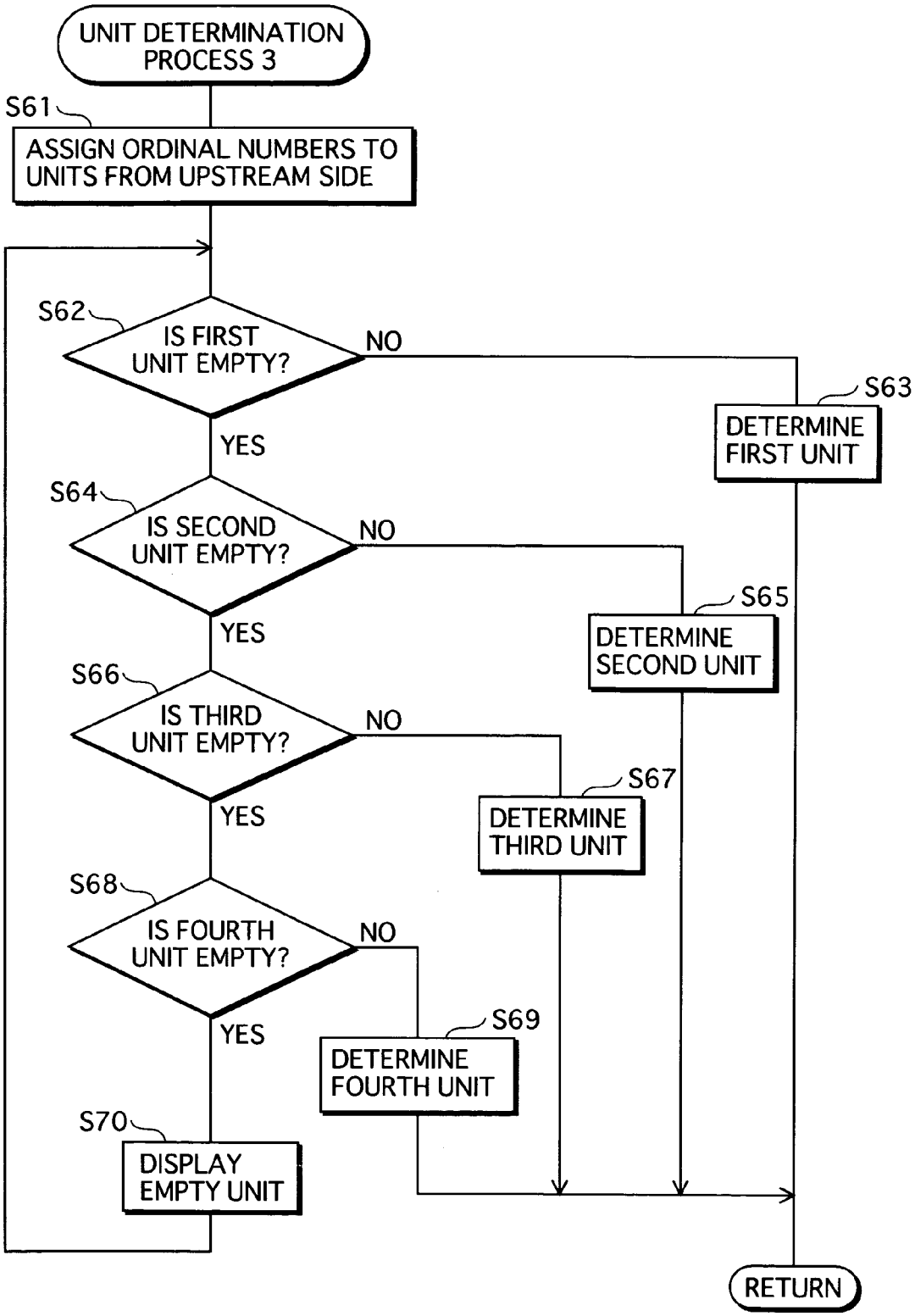
FIG. 14 is a flowchart depicting steps involved in a unit determination process 3.

FIG. 14 is a flowchart depicting steps involved in the unit determination process 3.

As shown in the chart, in the course of the unit determination process 3, the units 10 are assigned, in the first place, ordinal numbers first, second, third and fourth in the order of the unit 10 at the upstream side of the transfer belt 2 to the one the downstream side thereof (S61). Subsequently, it is determined whether or not the first unit 10 is empty (S62), and then, if certain toner particles are left in the first unit 10 (NO in S62), the first unit 10 is determined to be used in the printing operation (S63).

If the first unit 10 is empty (YES in S62), it is determined whether or not the second unit 10 is empty (S64), and if the second unit 10 is not empty (NO in S64), the second unit 10 is determined to be used in the printing operation (S65).

If the second unit 10 is also empty (YES in S64), the determination is made on the third unit 10 whether empty or not (S66), and if certain toner particles are left unused in the third unit 10 (NO in S66), then the third unit 10 is determined to be used in the printing operation (S67).

If the third unit 10 is also empty (YES in S66), then it is determined whether or not the fourth unit 10 is empty (S68). If the fourth unit 10 is not empty (NO in S68), the fourth unit 10 is determined to be used in the printing operation (S69). Note that if the fourth unit 10 is also empty (YES in S68), the fact that the toner of that color has run out is displayed (S70) so as to prompt the use to replace the empty unit 10 with a new one.

As clarified above, in the case where four units 10 are for the same color, the number of the units 10 to be used is narrowed down into one as shown in FIG. 9 in the following manner.

When the units 10 to be used in the printing operation are determined (S10) in order to reproduce a color for which four of the units 10 have been identified, the unit 10 determined in the unit determination process 3 (S10) is used, whereas as for the remaining colors, each corresponding unit 10 is used, thereby completing the printing operation (S8).

Returning to S4, if two of the units 10 are for one color (first color) and different two of the units 10 are for a different color (second color) (NO in S4), the unit determination process 4 is executed.

Figure 15:
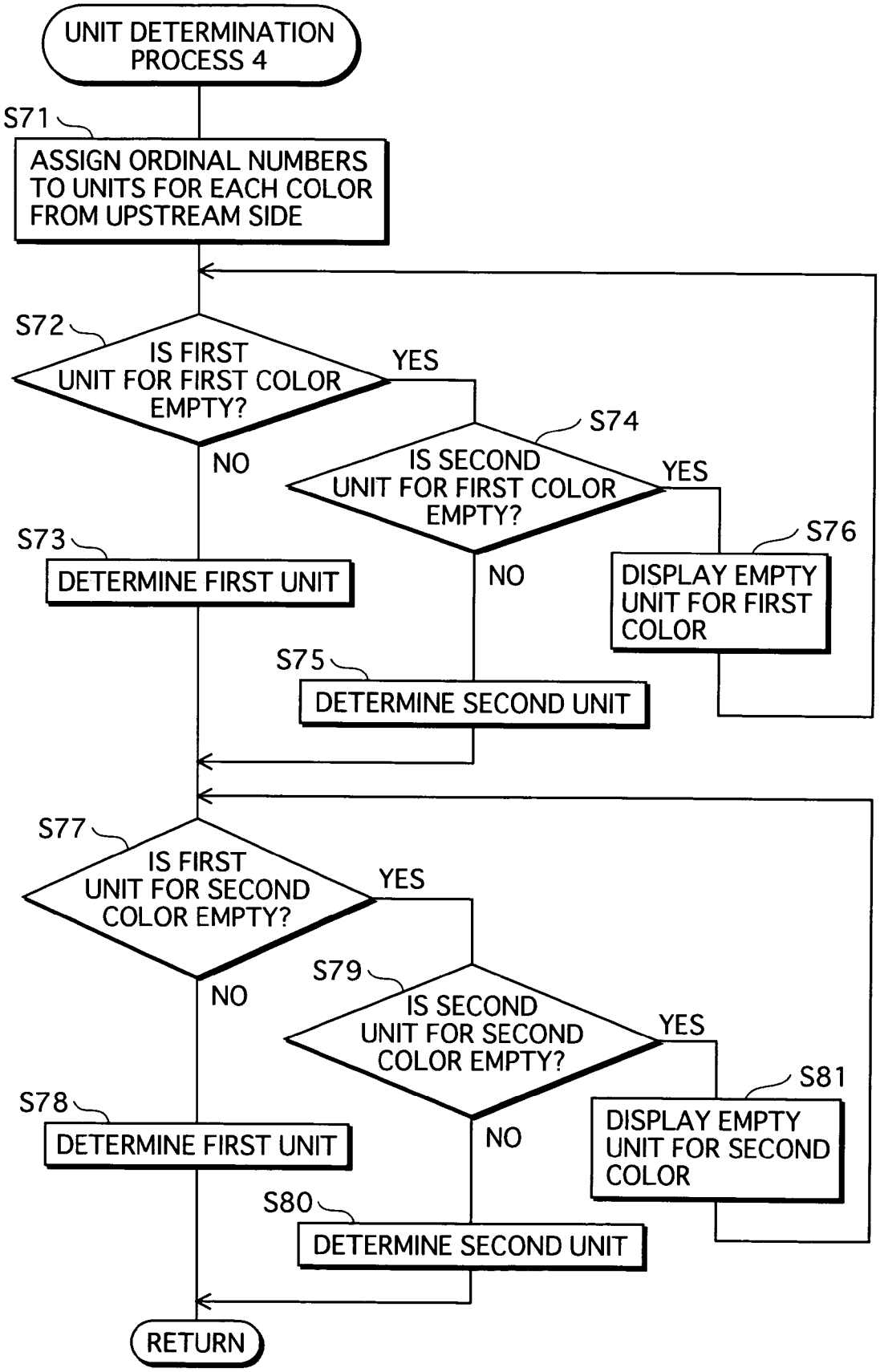
FIG. 15 is a flowchart depicting steps involved in a unit determination process 4.

FIG. 15 is a flowchart depicting steps involved in the unit determination process 4. As shown in the chart, in the course of the process 4, the image forming units 10 for the first color and the second color are assigned ordinal numbers first and second, respectively, in the order of the unit 10 at the upstream side of the transfer belt 2 to the one at the downstream side thereof (S71).

After that, the determination is made on the first unit 10 for the first color whether empty or not (S72). Then, if the relevant unit 10 is not empty, that is, certain toner particles are left (NO in S72), the first unit 10 is determined to be used in the printing operation (S73).

In S72, if the first unit 10 is empty (YES in S72), it is then determined whether or not the second unit 10 is empty (S74). If the second unit 10 is not empty (NO in S74), the second unit 10 is determined to be used in the printing operation (S75). Note that if the second unit 10 is also empty (YES in S74), the fact that the toner of that color has run out is displayed on the operation panel 5 (S76) so as to prompt the user to replace the empty unit 10 with a new one.

Subsequently, the determination is made on the first unit 10 for the second color whether empty or not (S77). If the first unit 10 is not empty (NO in S77), then the first unit 10 is determined to be used in the printing operation (S78).

In S77, if the first unit 10 is empty (YES in S77), then the determination is made on the second unit 10 (S79). Then, if the second unit 10 is not empty (NO in S79), the second unit 10 is determined to be used (S80). Note that if the second unit 10 is also empty (YES in S79), the fact that the second unit 10 is empty is notified to the user (S81) so as to prompt the user to replace the relevant empty unit 10.

As clarified above, in the case where two pairs of the units 10, each pair of which has the toner of the same color, one of the units 10 is determined so as to reproduce each color.

As shown in FIG. 9, when the image forming units 10 that will be used in the printing operation are determined (S11), the one determined in the unit determination process 4 is used so as to reproduce colors, for which two of the units 10 are present, whereas, as for the remaining colors, each corresponding unit 10 is used so as to complete the printing operation (S8).

Returning to S3, if the one-to-one relationship is established between the colors and the units 10 (NO in S3), it is then determined whether or not the units 10 for the colors required for the image forming are empty (S12). If the presence of the empty unit 10 is confirmed (YES in S12), it is displayed on the operation panel 5 (S13). When the relevant empty unit 10 is replaced with a new one, and as soon as it is confirmed that none of the units 10 is empty (NO in S12), the printing operation is executed (S8).

Note that in the above example, the user is to select an optimum image forming mode. However, such an arrangement is also feasible that S3 is executed prior to S1 and S2, or that S3 is executed subsequent to S1 (skipping S2).

In the cases where the mode display step and/or the mode selection step are skipped, such an arrangement is feasible, for example, that the printer 1 automatically selects an image forming mode to be executed. Specifically, a method for determining a mode in which compared with any other modes, more image forming units 10 are used so as to give the top priority to the image quality to be the image forming mode is adoptable in a case where multiple modes are executable. Moreover, it is also feasible that an image forming mode is arranged in such a manner that the user is able to specify a mode of his or her choice in advance, and the specified mode is executed as an image forming mode.

Furthermore, in a case where only one image forming mode is executable, and no options are given to the user so as to select one therefrom, it is also feasible that a visual display or other is outputted only for confirmation purpose, and without receiving an entry that specifies a mode from the user, the only one executable mode is executed. In addition, such an arrangement that the outputting per se is not carried out is feasible. By doing so, the total number of processes executed by the CPU 101 is decreased as many processes as skipped such as the mode selection, and hence, the overall processing is simplified and the load imposed to the CPU 101 is decreased.

In a case where multiple modes are displayed as selectable by information outputted, an entry for specifying a mode may be received from the user, whereas in a case of only one mode selectable, the entry may not be received from the user, and the image forming mode may be automatically switched over to the only one selectable mode. In the latter case, no time is required for waiting for the user's selection of the mode, and hence, the image forming can be performed more smoothly without forcing a redundant step to be executed. Moreover, in a case where the number of modes executable is only one in accordance with a combination of the image forming units 10 capable of forming the color images, the only one mode executable may be executed without outputting. With this arrangement, the control pertinent to the outputting can be omitted, resulting in the more simplified control.

In the above example, in the case where two or more of the units 10 are for the same color, a toner is consumed in the order of the unit 10 at the upstream side of the transfer belt 2 to the unit 10 at the downstream side thereof. The order is not limited to this, and a preferable order, obtained from experiments and other, may be determined in advance. For example, the order of the unit 10 to be used is determined in such a manner that a toner of the unit 10 located at the downstream side is consumed first.

Moreover, another arrangement is also adoptable that the processing of using the multiple units 10 for the same color one after another and the processing of consuming toners therein equally for the same amount are selectively executed.

Figure 16:
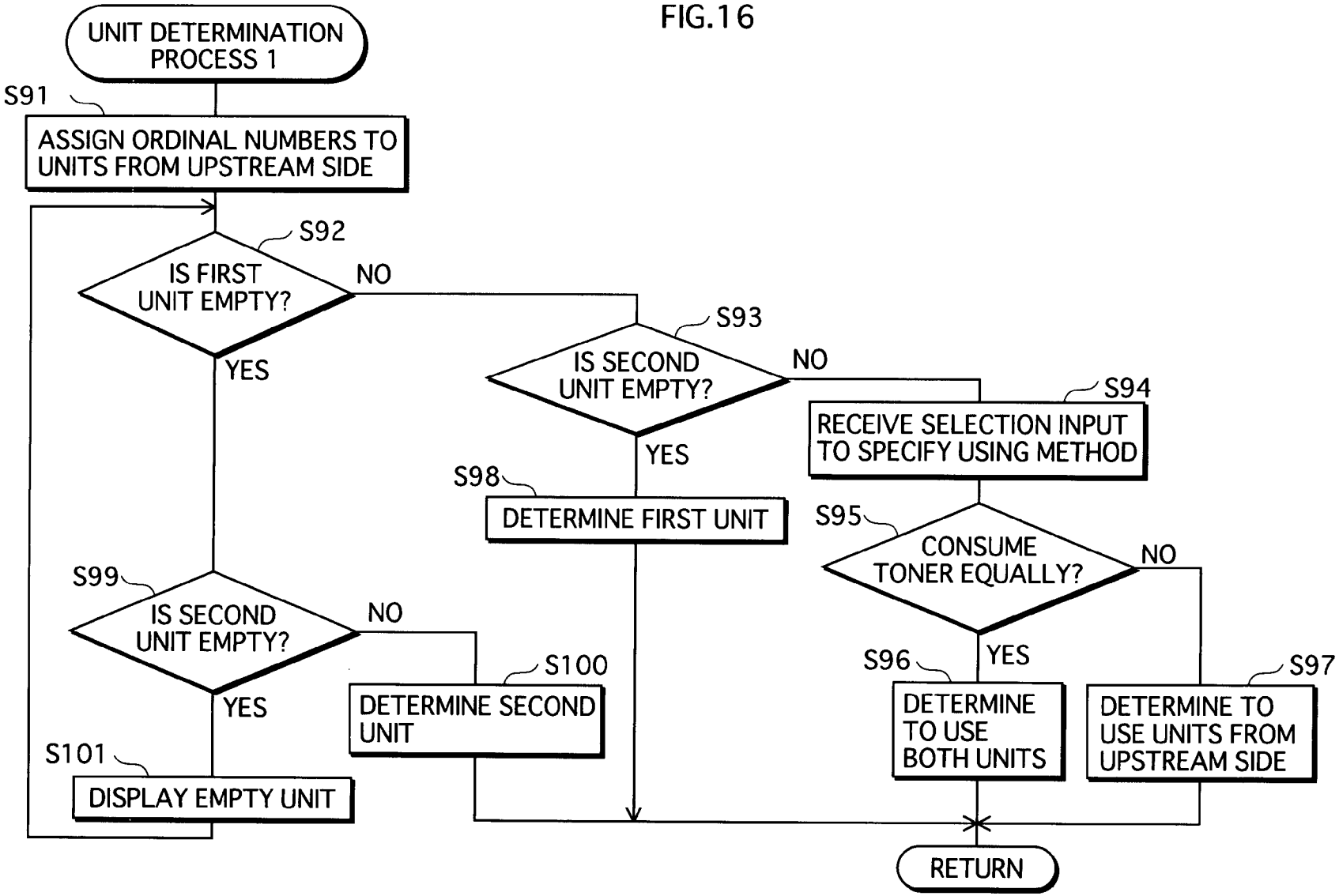
FIG. 16 is a flowchart depicting steps involved in another example of the unit determination process 1.

FIG. 16 is a flowchart depicting steps involved in one example of modification for the unit determination process 1.

As shown in the chart, two of the image forming units 10 for the same color are assigned ordinal numbers first and second (S91). After that, it is determined whether or not the first unit 10 is empty (S92), then if the relevant unit 10 is not empty, that is, certain toner particles are left unused (NO in S92), the determination is made on the second unit 10 (S93). If the second unit 10 is not also empty (NO in S93), then an entry for specifying how to consume the toners is received from the user (S94).

The reception of the entry would mean that with respect to the image forming units 10 for one color, for example, an entry for specifying a method for consuming toners of the units 10 equally for the same amount, or for consuming those toners one after another. In this example, selectable methods are displayed on the operation panel 5, and the entry made by the user touching the panel is received as a selection input. In this respect, the control unit 100 is capable, as a receiving unit, of receiving an entry for specifying how to consume the toners.

If the user selects the consuming of the toners equally for the same amount (YES in S95), the first and second units 10 are determined to be used (S96). On the other hand, if the user selects the consuming of the toners one after another (NO in S95), the order of the image forming units 10 to be used in the printing operation is determined to be from the one at the upstream side of the transfer belt 2 (S97).

Returning to S92, if the first unit 10 is not empty (NO in S92), but the second unit 10 is empty (YES in S93), the first unit 10 is determined to be used (S98).

In S92, if the first unit 10 is empty (YES in S92), it is determined whether or not the second unit 10 is empty (S99). Then, if the second unit 10 is not empty (NO in S99), the second unit 10 is determined to be used (S100). Otherwise, that is, if the second unit 10 is empty (YES in S99), the fact that the second unit 10 is empty is displayed on the operation panel 5 (S101) so as to prompt the user to replace the empty second unit 10 with a new one.

In this manner, where two of the image forming units 10 are for the same color, and neither of them is empty, if the method for consuming the toners equally for the same amount is selected, those two of the units 10 are determined to be used in the printing operation. With this selection, as will be described in a section pertinent to a printing process in the case of the one example of the unit determination process 1, those two of the units 10 are alternatively changed so that the toners in the both units 10 are equally consumed for the same amount. In FIG. 16, the case where two of the units 10 are for the same color is the focus. However, in a case where three or four of the units 10 are present for one color, all the units 10 containing a certain amount of toner particles are determined to be used as in the case where two of the units 10 are present.

FIG. 17 is a flowchart depicting steps involved in a printing process in the case of one example of the unit determination process 1.

As shown in the chart, it is determined in the unit determination process 1 whether or not both the units 10 are determined to be used (S111). If either of the first or second unit 10 only is to be used in the process 1 (NO in S111), the unit 10 determined therein is used in the printing operation (S112).

In S111, if both the units 10 are determined to be used in the process 1 (YES in S111), the variable n representing a page number is set to 1 (S113), and at the same time, the remaining amount of the toner in the first unit 10 is assigned to Z1 (S114), and the remaining amount of the toner in the second unit 10 is assigned to Z2 (S115).

Note that how much relevant toner particles are left in the unit 10 is determined based on a detection signal from the toner remaining amount detection sensor 8. However, this determination is not limited to this, and other variations are feasible. For example, a method is also adoptable in which the amount of toner to be consumed in forming an image is estimated based on a color gradation value for each pixel within a paper, and a value obtained by subtracting that estimated value from a given value is determined to be the remaining amount of that toner.

After that, the equation $X=Z1-Z2$ is calculated (S116) Then, it is determined whether the relationship $X>A$ is true (S117), and if the result is false (NO in S117), further determination is made on the relationship $X<A$ whether or not it is true (S118), and then, if the relationship is false (NO inn S118), it is determined to use both the first and second units 10 (S119), and so that the toners in the two units 10 are equally consumed, an area assignment process is enabled (S120).

The area assignment process is a process for consuming toners from two of the units 10 equally for the same amount. More specifically, it is a process for using two of the units 10 by alternatively changing based on a given condition.

When the area assignment process is enabled (S120), an image forming area is assigned to each of the units 10 by a dot counter, and by consuming the toners contained in two of the units 10 equally for the same amount, the printing of the nth page (first page in this case) is carried out (S121).

Figure 18:
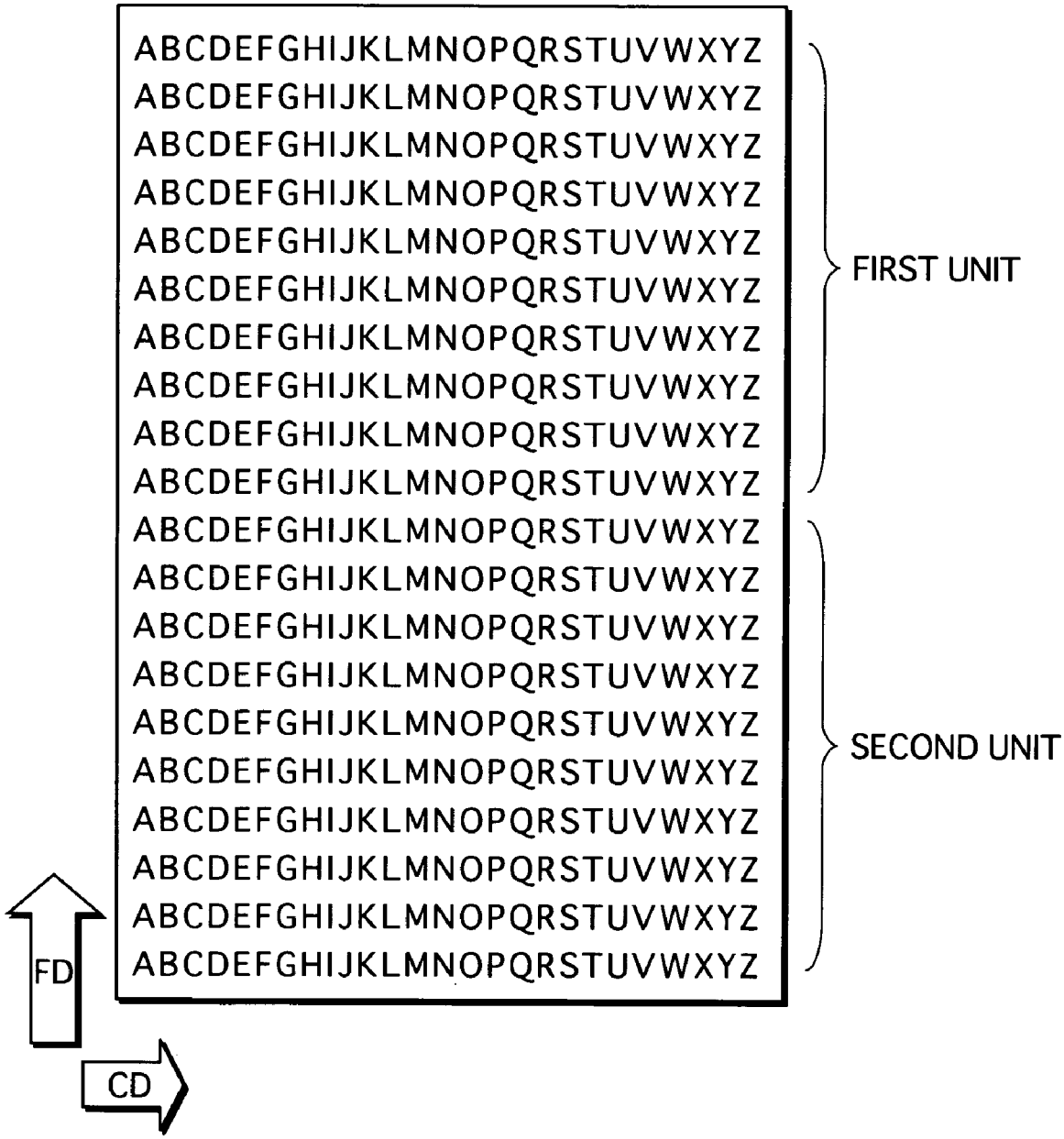
FIG. 18 shows one recording paper is divided into parts that are assigned to each of the image forming units.

FIG. 18 is provided in order to facilitate the understanding how one recording paper is divided into parts that are assigned to each of the multiple image forming units.

In this figure, the arrow CD indicates a main scanning direction, while the arrow FD indicates a sub-scanning direction as well as a direction in which a recording paper is transported.

In the example of FIG. 18, the image forming areas assigned to the first and second units 10 are substantially halves of one recording paper. In other words, the area from the top to the middle of the recording paper in the sub-scanning direction is assigned to the first unit 10, and the area from the middle of the recording paper to the end thereof in the sub-scanning direction is assigned to the second unit 10.

With the arrangement that an image on a recording paper is divided into multiple areas, and depending on an area the units 10 are changed to be used in a case where multiple units 10 are inserted for one color, toners are equally consumed from the multiple units 10 for that color. Hence, such a state hardly occurs that the multiple units 10 become unable at one time to develop an image.

As another area assignment method, such a method is adoptable that the number of pixels forming an image as a toner image of a relevant color is counted up per main scanning line in the ascending order from the first line, second line . . . and the last line, and the main scanning line in which the count is halved is obtained. An area starting from the main scanning line obtained to the top of a recording paper (first area) is formed using the first unit 10, and when the printing process reaches the main scanning line obtained, the unit 10 to be used is switched over to the second unit 10, and the second unit 10 proceeds with forming of an area starting from the main line obtained to the end of the recording paper (second area). In order to change the multiple units 10, a method is suggested that in accordance with the timing when the first and second areas pass through a developing point, voltage supply for the image forming is switched on and off.

As a method for counting up the number of pixels forming an image, such a method is adoptable that color gradation values are read for all the pixels from data pertinent to the relevant color within the image data stored in the image memory 104, and the number of pixels except for the pixels forming a background of the image is counted up. Also another method is feasible that the number of pixels except for the pixels forming a background of the image is counted up by referring to the brightness of all the pixels based on a signal specific to a relevant color within a drive signal outputted from the LD driver 105.

Returning to S117, if the relationship X>A is true (YES in S117), it is determined that an image on the nth page is formed using the first unit 10 (S124), and the area assignment process is disabled (S126). If the relationship X<A is true (YES in S118), it is determined that an image on the nth page is formed using the second unit 10 (S125), and the area assignment process is disabled (S126).

When the area assignment process is disabled (S126), the printing of the nth page (first page in this case) is commenced by using the second unit 10 (S121).

When the image forming is completed, it is determined whether or not the nth page is the last page (S122), and then, if it is the last page (YES in S122), the printing process terminates. Otherwise (NO in S122), the formula n=n+1 is applied (S123), and then, the process returns to S114. In this respect, the control unit 100 is capable, as a switching unit, of switching the image forming units in order to complete the process of S113 through S126.

As clarified above, with the arrangement that multiple units 10 for the same color are switched over when used, it is made possible that the multiple units 10 for a color that is most frequently used are inserted. Hence, the frequency of replacement of the image forming units 10 is reduced, decreasing the trouble for the maintenance operations.

In particular, with the arrangement that the multiple units 10 for the same color are alternatively switched, such a state often occurs that the multiple units 10 for the same color become unable to develop an image at the substantially same timing, and hence, it is made possible to replace the units 10 at one time, decreasing the trouble for the maintenance operations.

Where two or more of the units 10 are inserted for the same color, the remaining amounts of the toners therein are not necessarily the same. Accordingly, one of those units 10 having the largest amount of the toner is prioritized for use in the printing operation so that the toners of all those units are equally consumed.

Note that the method for consuming the toners equally is not limited to this. It is also feasible to perform the alternate switching of the units 10 for the same color each time the image forming is performed for one page or multiple pages, or each time multiple jobs are completed.

Also, it is feasible that regardless of the remaining amount of toner in each of the image forming units 10, the units 10 are switched over for use in the printing operation each time the image forming for one page or multiple pages is completed. For example, the first unit 10 is used for a first recording paper, and the second unit 10 is used for a second recording paper. The repetition of this switching enables the equal consumption of the toners to a certain extent. With the arrangement that the units 10 are switched over for each recording paper, one unit 10 is used for one paper, Hence, image distortion arising from discrepancy caused by the switching of the units 10 is not caused.

Moreover, it is feasible that the alternate switching of the units 10 is performed each time one job or multiple jobs are completed. With the arrangement that the color image forming is carried out on a job basis, and the units 10 are switched over for each job, it is made possible to control the switching of the units 10 in a smoother manner.

Furthermore, it is also feasible that the multiple units 10 for the same color are switched over by using a method specified with a selection input from the user, an entry made by the user. Thereby, for example, the user is able to specify how to switch the multiple units 10 in accordance with his or her needs.

In addition, such an arrangement is also adoptable that among the multiple units 10 for the same color, one of the units 10 is used so as to develop a relevant color image, and if the unit 10 becomes unable to develop, the unit 10 is switched over to another unit 10 so as to complete the development of that color image. With this arrangement, at the timing when the unit 10(*a*) becomes unable to develop a color, the fact that the necessity arises for preparing the unit 10(*b*) to be replaced with the one currently in use is notified to the user, and while the development of the relevant color image is in progress using the unit 10(*a*), it is possible to prepare the unit 10(*b*), or to replace the unit 10(*a*) currently in use with the unit 10(*b*). Therefore, such an event that the image forming is carried out intermittently can be prevented.

Example of Modification for the First Embodiment

The image forming apparatus in accordance with the first embodiment is arranged in such a manner that images of each color are transferred in multiple layers onto a recording paper as a body subjected to the image transfer that is transported on the transfer belt 2. An image forming apparatus in accordance with one example of modification for the first embodiment is arranged in such a manner that toner images of each color are transferred in multiple layers onto an intermediate transfer belt, and those images are transferred in a bunch onto a recording material such as a recording paper. This is called an intermediate transfer method.

Moreover, the image forming apparatus in accordance with the example of modification for the first embodiment is arranged in such a manner that a waste toner collection unit is attachable to a slot instead of the image forming unit. This waste toner collection unit is provided for collecting the toner particles remaining on the intermediate transfer belt.

Regarding the other arrangements, the image forming apparatus in accordance with the example of modification for the first embodiment, basically, has the same arrangements as in the first embodiment of the present invention.

Descriptions will be provided, hereinafter, so as to discuss in detail an image forming apparatus in accordance with the example of modification for the first embodiment. For convenience of explanation, descriptions on the same arrangements as for those described in the first embodiment are omitted or provided in short.

(1) Configuration of a Printer

Figure 19:
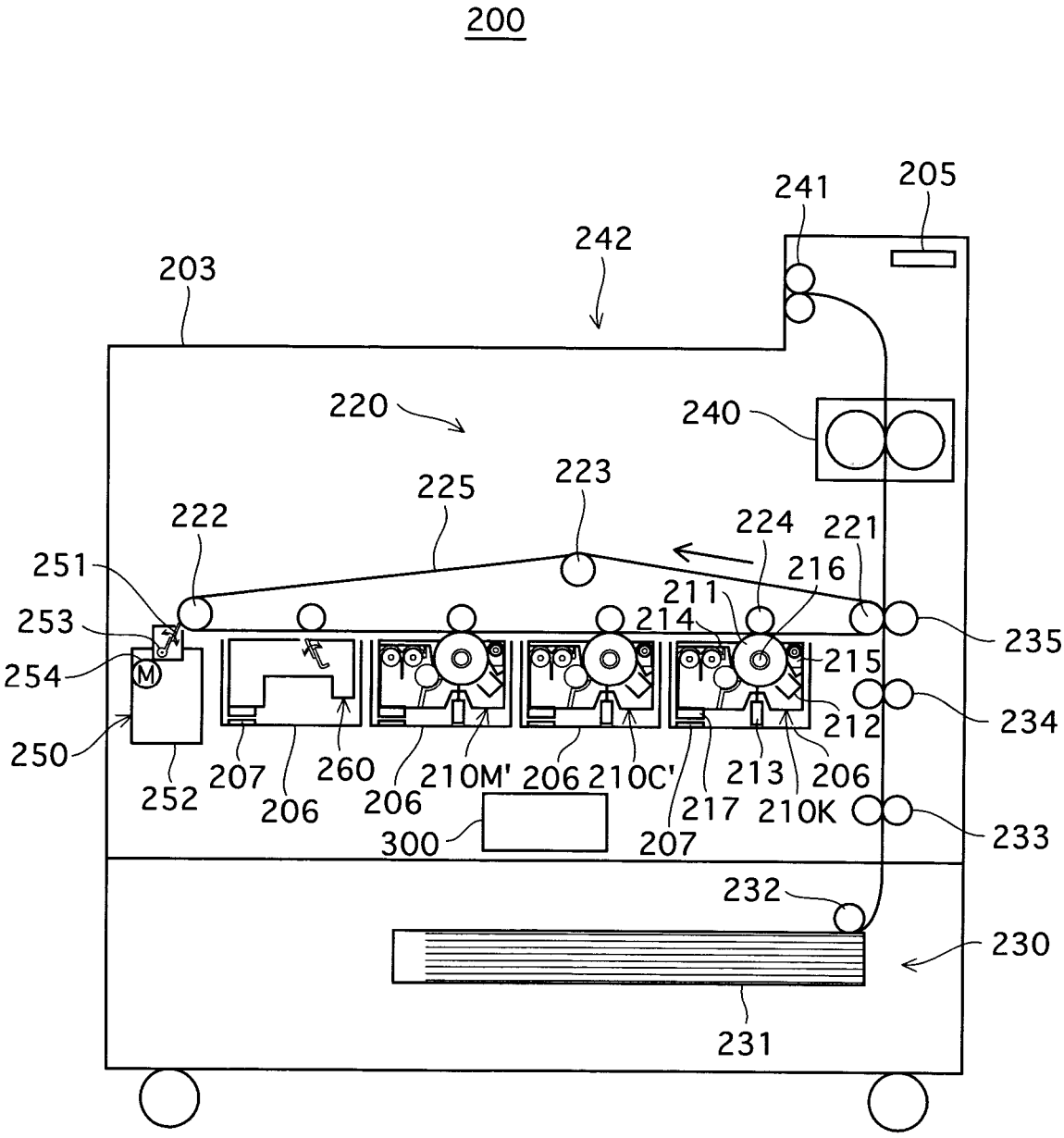
FIG. 19 shows an overall configuration of an image forming apparatus in accordance with the first embodiment of the present invention.

FIG. 19 shows an overall configuration of an image forming apparatus in accordance with the example of modification for the first embodiment.

As shown in the figure, as the image forming apparatus in accordance with the modification of the first embodiment, a printer 200 includes: image forming units 210M', 210C', and 210K corresponding to the M-, C-, and K-type colors, respectively; an intermediate transfer unit 220 having an intermediate transfer belt 225 that rotates in a direction indicated by the arrow in the figure; a paper feeding unit 230; a fixing unit 240; and a control unit 300. The printer 200 is connected to a network such as LAN, and when receiving a command for executing a print job from an external device, proceeds with image forming based on the command.

The image forming units 210M', 210C', and 210K are disposed facing to the intermediate transfer belt 225 and in a rotation direction thereof from an upstream side to a downstream side serially in the order of 210M', 210C', and 210K at certain intervals therebetween.

Each of the image forming units 210 includes: a photoreceptor drum 211 serving as an image carrier; around the photoreceptor drum 211, an electric charging unit 212, a light exposure unit 213, and a developing device 214 serving as a developing unit; and a cleaner 215. The electric charging unit 212, light exposure unit 213, developing device 214 and cleaner 215 are disposed surrounding the photoreceptor drum 211. The position of the image forming unit 210 is determined with respect to a printer main body 203, using an axis 216 of the photoreceptor drum 211.

The intermediate transfer unit 220 includes: a drive roller 221; a driven roller 222; a tension roller 223; a primary transfer roller 224 having a face-to-face relation with the photoreceptor drum 211; and an intermediate transfer belt 225 serving as an intermediate transfer body that is suspended over the rollers 221, 222, 223.

The paper feeding unit 230 includes: a paper cassette 231 for loading recording papers; a paper feeding roller 232 for feeding recording papers one by one from the paper cassette 231; a pair of transporting rollers 233 for transporting the recording papers fed from the cassette 231; a pair of timing rollers 234 for adjusting timing for forwarding the recording papers to a secondary transfer position; and a secondary transfer roller 235.

A control unit 300, upon reception of the printing command from the external device, receives an image signal, converts that signal into a digital image signal for colors reproduced as M-, C-, and K-types, and generates a drive signal for driving the exposure unit 213. In response to the drive signal, the exposure unit 213 emits a laser light for forming an image, and performs exposure-scanning on the photoreceptor drum 211 in a main scanning direction.

Prior to the exposure-scanning, toner particles remaining on the surface of the photoreceptor drum 211 are removed by the cleaner 215. After that, the photoreceptor drum 215 is discharged with irradiation of an eraser lamp (not shown), and is uniformly charged by the charging unit 212. When the laser light is irradiated to the photoreceptor drum 215 while in a state of uniformly charged, an electrostatic latent image is formed on the surface of the drum 211.

Each electrostatic latent image is developed by the developing device 214 for each color, and thereby, a toner image is formed as a developer image on the surface of the drum 211 for each color of M-type, C-type, and K-type, and is transported, for primary transfer, onto the intermediate transfer belt 225 being rotated, with an electrostatic force that is produced by a voltage applied to the primary transfer roller 224 provided on a back surface of the intermediate transfer belt 225.

The image forming is carried out with timing shifted in the order from the one at the upstream side of the belt 225 to the one at the downstream side thereof, so that toner images are transferred in multiple layers at the same positions of the intermediate transfer belt 225. Thereby, the toner images are overlapped in the order of M', C', and K with the color M' at the bottom. The toner images overlapped on the transfer belt 225 are moved onto the secondary transfer position by rotation of the transfer belt 225. In this respect, the image forming unit 210 and intermediate transfer unit 220 function as an image forming unit.

In synchronization with the rotation timing of the intermediate transfer belt 225, a recording paper is fed from the paper feeding unit 230 through the timing roller 234. The recording paper is forwarded while being interposed between the rotating intermediate transfer belt 225 and secondary transfer roller 235. When it reaches the secondary transfer position, the toner images on the belt 225 are transferred onto the recording paper for secondary transfer by using the electrostatic force generated by the voltage applied to the secondary transfer roller 235.

As described above, since the toner images are overlapped on the belt 225 in the order of the M', C', and K with the M' at the bottom, all the toner images are overlapped on the recording paper in the order of K, C', and M' with the K at the bottom. Thereby, the resulting color reproducibility is improved.

The recording paper passing through the secondary transfer position is transported to the fixing unit 240. Then heat and pressure are applied to the recording paper so that toner images are fixed, and the completed paper is ejected through a pair of ejection rollers 241 onto a paper ejection tray 242.

The printer 1 is equipped with a cleaner 250. The cleaner 250 includes a blade 251 for sweeping off toner particles remaining on the intermediate transfer belt 225 when the transfer is completed, and a storage unit 252 for storing waste toner particles collected.

The blade 225 has a shaft coupled with a rotational shaft of a switching motor 254 through a motive power transmission mechanism including a gear or the like (not shown). The switching motor 254 is connected to the control unit 300. The control unit 300 moves the blade 251 in directions indicated by the arrows in the figure by driving the rotation of the switching motor 254 so that the blade 251 is shifted between a position in contact with the transfer belt 225 and a position independent of the transfer belt 225.

In the cleaner 250, a collected toner detection sensor 255 (FIG. 21) is provided operable to detect the amount of toner particles collected. From the detection sensor 255, a signal is outputted in accordance with the amount of toner stored in the storage unit 252.

For this detection, a well-known liquid level sensor, photoelectric sensor, volume sensor or the like is adopted. Alternatively, an optical sensor is used so as to detect a fact that a coil spring (not shown) provided at the bottom of the storage unit 252 is shrinking downward as the amount of toner stored in the storage unit 252 increases.

In one of the slots 206, a waste toner collection unit 260 is inserted. The waste toner collection unit 260 is generally similar to the image forming unit 210 in terms of shape and size, and is attachable to any of the slots 6. With the arrangement that the waste toner collection unit 260 is detachably inserted in the slot 206, it is made possible that the toner particles remaining on the photoreceptor drum 211 are collected by the collection unit 260, and thereby, the image quality is improved.

Figure 20:
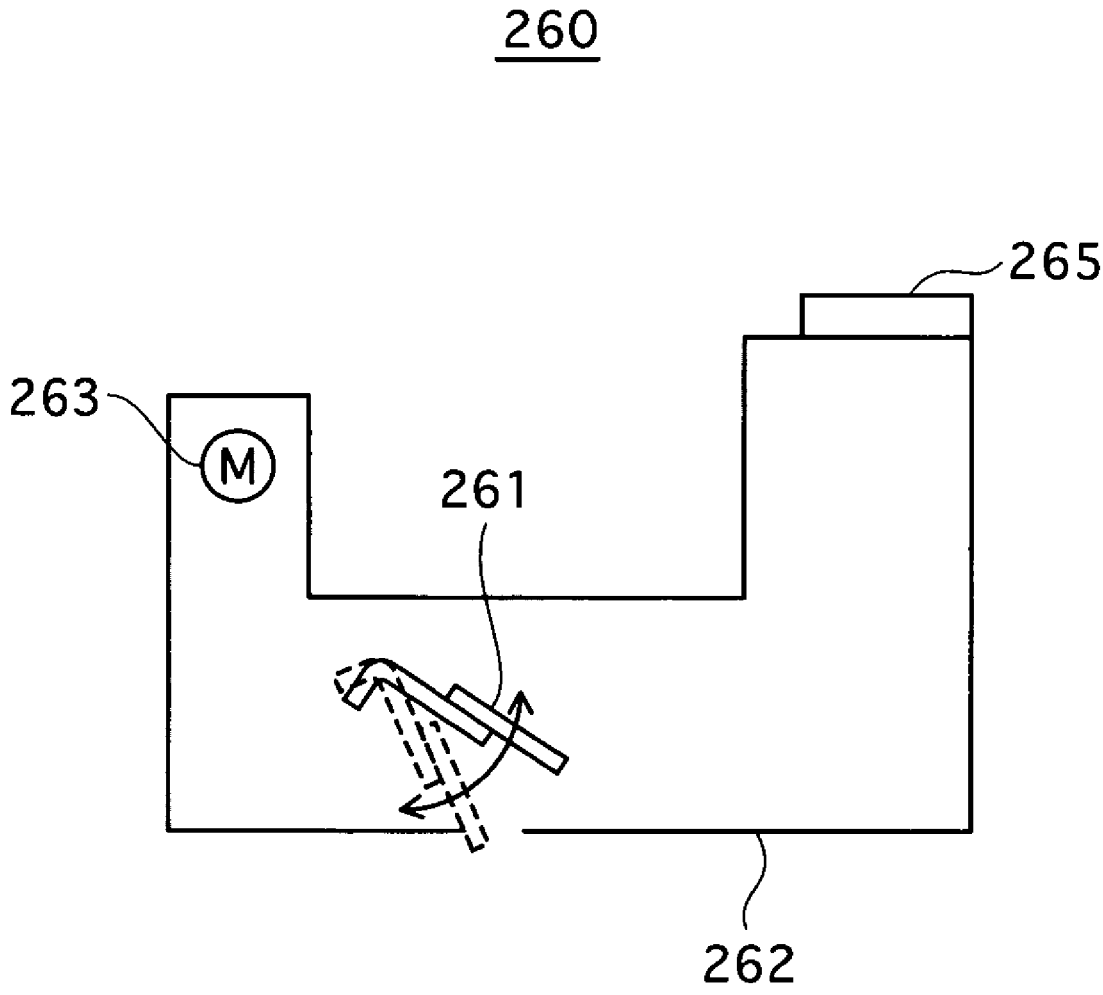
FIG. 20 is a schematic diagram of a waste toner collection unit.

FIG. 20 shows an outline of a waste toner collection unit.

As shown in the figure, the waste toner collection unit 260 includes a blade 261 for sweeping off waste toner particles on the intermediate transfer belt 225, and a storage unit 262 for storing the waste toner particles collected by the blade 261. Note that it is possible to replace the storage unit 262 by a user.

A shaft of the blade 261 (not shown) is coupled with a rotational shaft of the switching motor 263 through a motive power transmission mechanism including a gear or the like (not shown). The switching motor 263 is connected to the control unit 300. The control unit 300 moves the blade 251 in directions indicated by the arrows in the figure by driving the rotation of the switching motor 254 so that the blade 251 is shifted between a position indicated by the solid line and a position indicated by the dotted line in FIG. 20. In this case, the dotted line is a position where a tip of the blade 261 is in contact with the intermediate transfer belt 225, whereas the solid line is a position where the tip of the blade 261 is not in contact therewith.

The toner particles remaining on the belt 225 are collected by the blade 261 when located at the position of the dotted line, and the toner particles collected are stored inside the storage unit 262.

In the waste toner collection unit 260, a collected toner detection sensor 264 (FIG. 21) is provided. The detection sensor 264 generally has the same functionality as for the collected toner detection sensor 255 in the cleaner 250, and is to output a signal in accordance with the amount of toner collected.

The detection signal from the collected toner detection sensor 264 is transported onto the control unit 300. Based on that signal, the control unit 300 determines how much toner is collected in the waste toner collection unit 260, and also determines whether or not more toner particles can be collected.

Note that it is feasible that a 'full' level is detected using a well-known liquid level sensor, photoelectric sensor, volume sensor or the like.

The waste toner collection unit 260 includes an output terminal for outputting an identification signal (hereinafter, simply called 'ID signal') such as a signal containing three bits of '111' that indicates the unit 260 per se is a unit operable to collect waste toner particles. This output terminal is electrically connected to a unit connection terminal 207 of the slot 206 to which the waste toner collection unit 260 is attached. By doing so, the ID signal from the output terminal 265 is sent to the control unit in the same manner as in the case where the image forming unit 210 is inserted.

Figure 21:
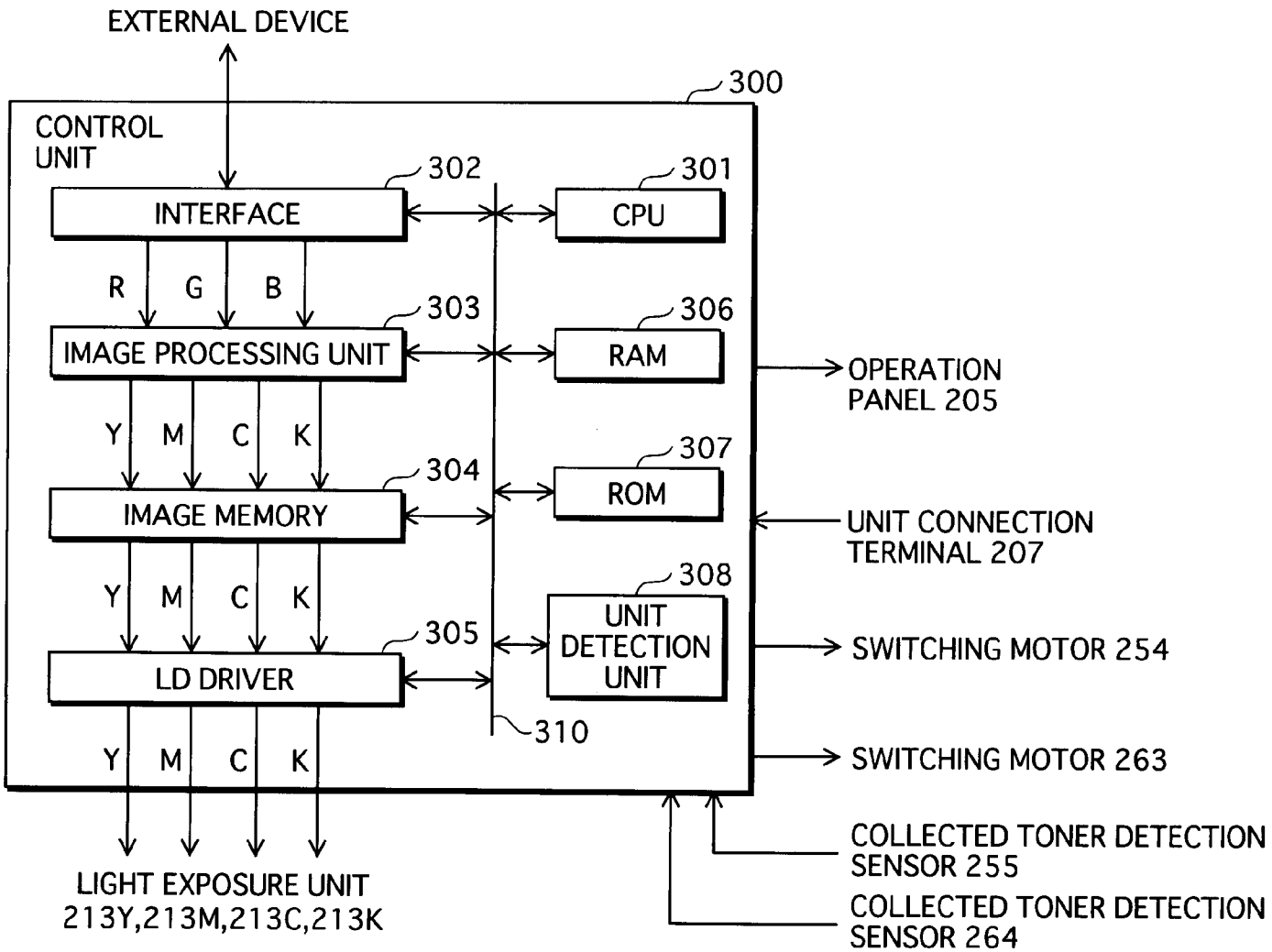
FIG. 21 is a block diagram of a control unit in accordance with one example of modification for the first embodiment of the present invention.

FIG. 21 is a block diagram showing a configuration of a control unit as one example of a modification for the first embodiment of the present invention.

As shown in the figure, the control unit 300 includes: a CPU 301; a communication interface 302; an image processing unit 303; image memory 304; an LD driver 305; a RAM 306; a ROM 307; and a unit detection unit 308 as main constituent elements, and data communication there within is carried out using a bus 310.

Each of the elements in the control unit 300 generally has the same functionality as for each of the elements in the control unit 100 and is assigned the same name in accordance with the first embodiment of the present invention. Moreover, the unit detection unit 308 (FIG. 21) in the control unit 300 receives the ID signal from the image forming unit 210 as well as the waste toner collection unit 260. Based on the three-bit information indicated by the signal, the control unit 300 is able to detect in which of the slots 6 the waste toner collection unit 260 is inserted.

Which of the image forming units 210 can be used in combination with the waste toner collection unit 260, if attached, is determined in advance. Combinations thereof are indicated with circles, indexed with the title "WASTE TONER COLLECTION UNIT" in the table shown in FIG. 6. For example, when the column 1004 is referenced, it is found that the units 210M', 210C', and 210K can be used in combination with the waste toner collection unit 260 (in the example of FIG. 19).

(2) Clearing Process by the Control Unit

Figure 22:
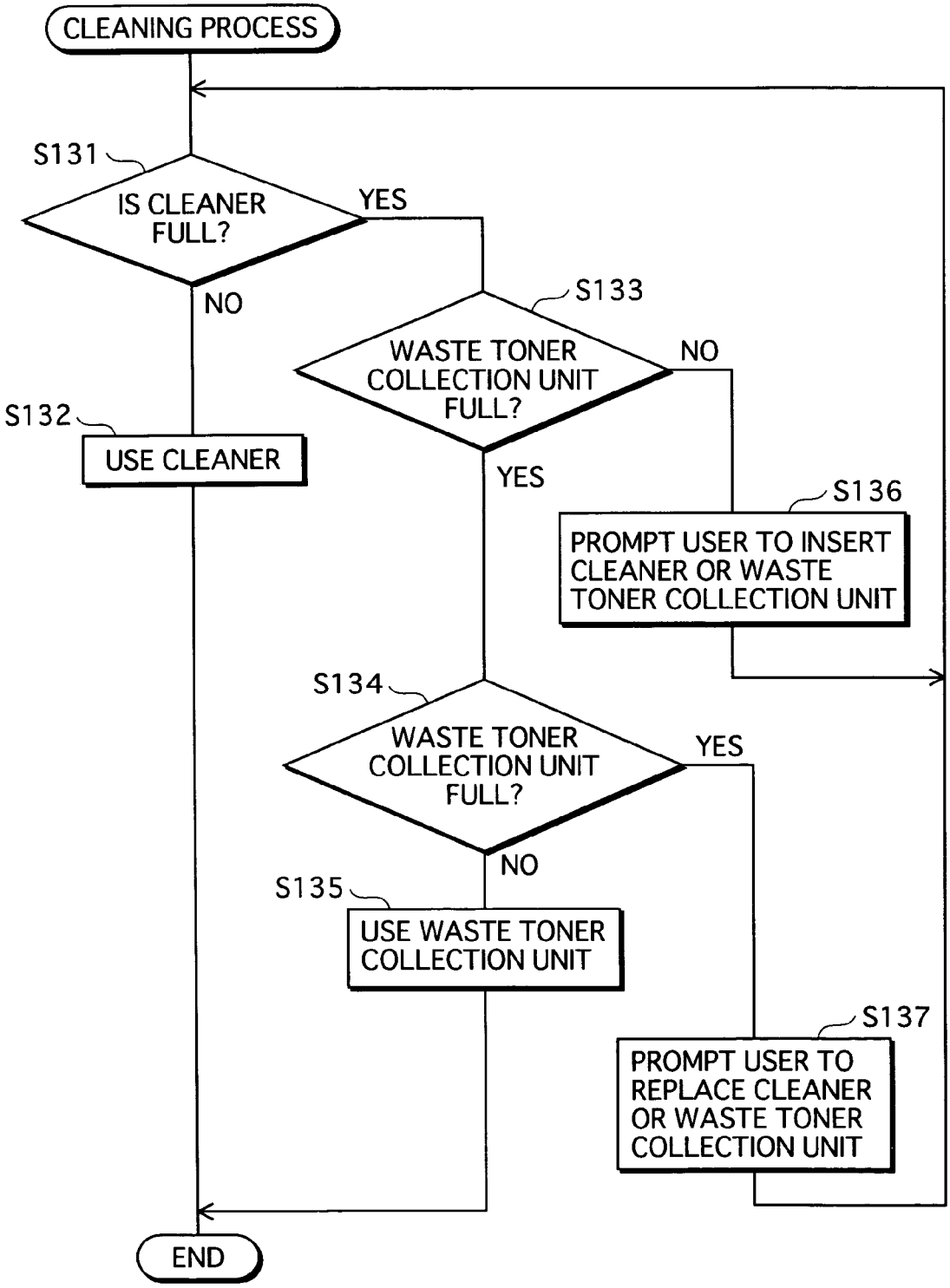
FIG. 22 is a flowchart depicting steps involved in a cleaning process.

FIG. 22 is a flowchart depicting steps involved in a cleaning process.

This process is executed each time the printing of one recording paper is performed. As shown in the chart, it is determined whether the cleaner 250 is in a state of being unable to collect remaining toner particles (hereinafter, called 'full state') (S131). This determination is based on a detection signal from the collected toner detection sensor 255.

Unless in the full state (NO in S131), the cleaning operation is carried out by using the cleaner 250 (S132).

If the cleaner 250 is in the full state (YES in S131), it is then determined whether or not the waste toner collection unit 260 is inserted (S133), and if the insertion is confirmed (YES in S133), the determination is made on the waste toner collection unit 260 (S134). Then, if the full state is confirmed (NO in S134), the cleaning operation is carried out by using the waste toner collection unit 260 (S135).

Returning to S133, if the waste toner collection unit 260 is not inserted (NO in S133), a message prompting the user to replace the cleaner 250 or insert the waste toner collection unit 260 is displayed on the operation panel 205 (S136), and the process returns to S131.

In S134, if the waste toner collection unit 260 is in the full state (YES in S134), the message prompting the user to replace the cleaner 250 or waste toner collection unit 260 is displayed on the operation panel 205 (S137), and then the process returns to S131. In this respect, the control unit 300 functions as a switching unit operable to switch the cleaner 250 with the waste toner collection unit 260. With the arrangement that the cleaner 250 and waste toner collection unit 260 are switched over when used, both the units are capable of collecting the remaining toner particles, resulting in the increased capability of collecting waste toner particles.

With the above arrangement, the cleaning of the remaining toner particles is assigned to the cleaner 250 in principle, and when the cleaner 250 is in the full state, the waste toner collection unit 260 serving as a backup of the cleaner 250 is used. While the cleaner 250 is engaged in the remaining toner cleaning operation, the toner collecting operation assigned to the unit 260 is halted. As soon as the cleaning by the cleaner 250 is disabled, the remaining toner collecting operation is commenced at the unit 260. In this manner, the cleaner 250 plays the main part in collecting the remaining toner, and hence, the replacement of the unit 260 with the image forming unit 10 is unlikely to cause a problem. Note that it is also feasible that the waste toner collection unit 260 is used in principle for the cleaning operation, while the cleaner 250 is reserved as a backup.

(3) Another Cleaning Process by the Control Unit

In the above-described cleaning process, when the cleaner 250 is full of waste toner particles, the waste toner collection unit 260 is used. However, the order of use is not limited to this. It is feasible that the cleaner 250 and waste toner collection unit 260 are alternatively used so that the amounts of toner particles collected thereby are the same. With the arrangement of alternative use of those two units, it is most likely to happen that the cleaner 250 and waste toner collection unit 260 become full substantially at the same timing, i.e., unable to collect any more toner particles. In a case where the user is to discard the toner particles that have been collected by the cleaner 250 and waste toner collection unit 260, that operation can be carried out for the cleaner and the waste toner collection unit 260 at one time, which means that any trouble for the maintenance operations can be reduced.

Figure 23:
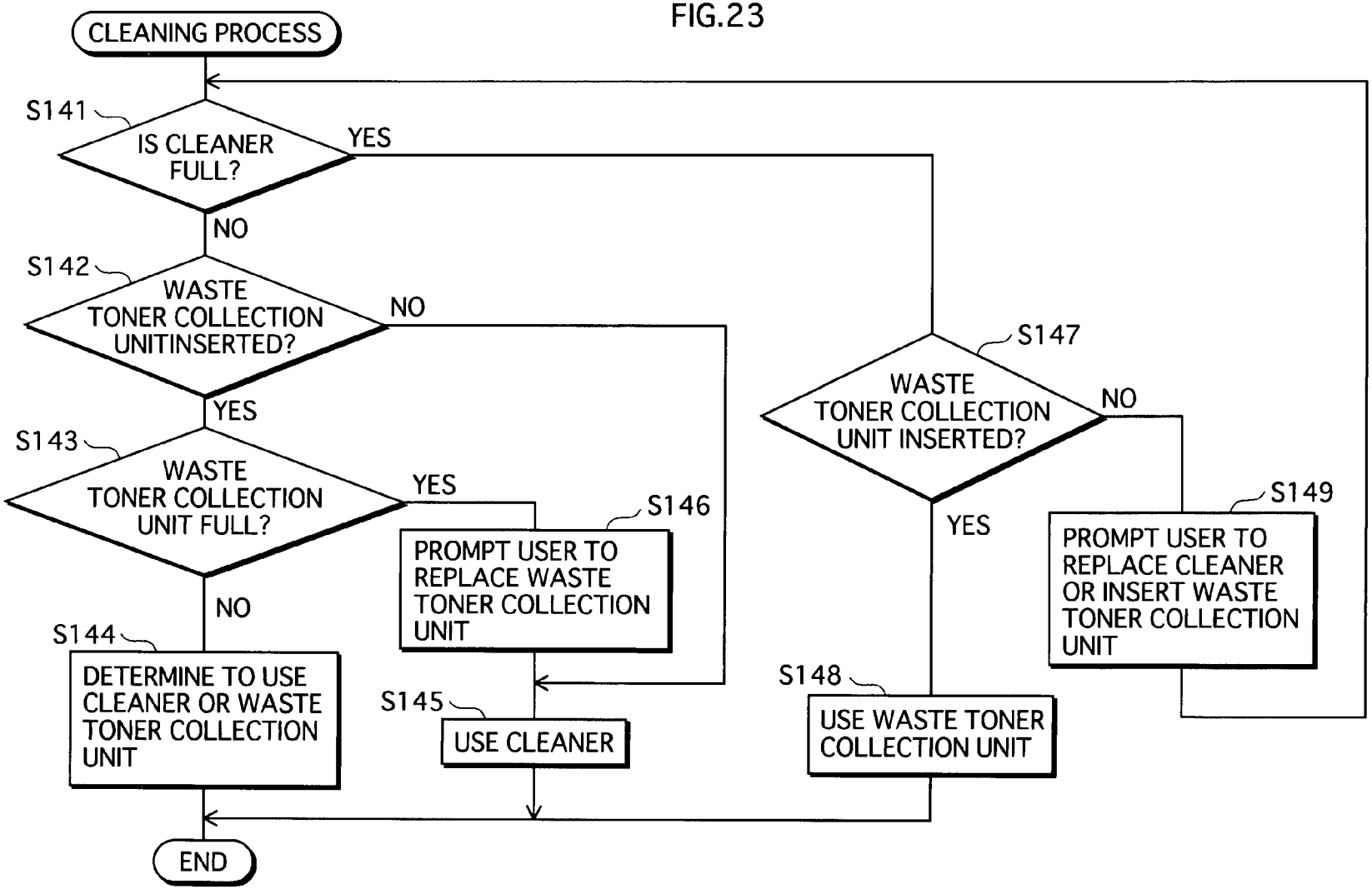
FIG. 23 is a flowchart depicting steps involved in another cleaning process.

FIG. 23 is a flowchart depicting steps involved in another cleaning process. This process is executed every time the printing operation is carried out for one recording paper.

As shown in the chart, it is determined whether or not the cleaner 250 is in the full state (S141), then if 'NO' is returned, and the cleaner is not in the full state (NO in S141), it is determined whether or not the waste toner collection unit 260 is inserted (S142). If the insertion thereof is confirmed (YES in S142), the determination is then made on the waste toner collection unit 260 whether or not in the full state (S143). Then, if 'NO' is returned, and the unit 260 is not in the full state (NO in S143), it is determined which of the cleaner 250 and the waste toner collection unit 260 is to be used, and the determined unit is used so as to carry out the cleaning of the remaining toner particles (S144).

In a case where the cleaner 250 and waste toner collection unit 260 are used in the cleaning operation (S144), it is assumed that a maximum level of the storage unit 252 for storing waste toner particles collected by the cleaner 250 is denoted as level A ranging from 0 to 100 while the maximum level of the storage unit 262 for storing waste toner particles collected by the waste toner collection unit 260 is denoted as level B ranging from 0 to 100. For each level, '0' indicates an empty state, and '100' the full state. In order to detect the level B, a coil spring (not shown) is used mounted at the bottom of the storage unit 262 so as to detect, using an optical sensor, the falling of the top end of the spring in accordance with the total amount of toner particles stored in the storage unit 262, Another example for the level detection is a liquid level sensor.

If the relationship between A and B is $A \leqq B$, the blade 251 of the cleaner 250 is brought into contact with the intermediate transfer belt 252 so that the cleaner 250 carries out the cleaning operation. On the other hand, if $A>B$, the blade 251 is separated from the transfer belt 225, and the waste toner collection unit 260 is used so as to carry out the cleaning operation.

Then, when the level A for the storage unit 252 in the cleaner 250 reaches the full level, the fact that the cleaner 250 is full of waste toner particles is displayed on the operation panel 205 so as to prompt the user to change the storage unit 252. Likewise, when the level B for the storage unit 262 in the waste toner collection unit 260 reaches the 'full' level, the user is notified of the fact that the storage unit 262 is full of waste toner particles through the operation panel 205 so as to prompt the user to change the unit 262.

In S142, if the insertion of the waste toner collection unit 260 is not confirmed (NO in S142), the cleaner 250 is used for the cleaning operation (S145).

In S143, it is determined whether or not the waste toner collection unit 260 is in the full state (YES in S143), a message prompting the user to change the unit 260 is displayed on the operation panel 205 (S146), and in parallel to this, the cleaner 250 commences the cleaning operation (S145).

In S141, if the full state of the cleaner 250 is confirmed (YES in S141), whether or not the waste toner collection unit 260 is inserted is determined (S147). If the insertion of the unit 260 is confirmed (YES in S147), the waste toner collection unit 260 is used for the cleaning operation (S148).

Otherwise, i.e., if the insertion of the unit 260 is not confirmed (NO in S147), the message prompting the user to change the cleaner 250 or to insert the waste toner collection unit 260 is displayed on the operation panel 205 (Sl49).

In this manner, the waste toner collection unit 260 is attachable instead of the image forming unit 210. With this arrangement, it is not necessary for the user to change the storage unit 252 at the same timing as when the unit 252 of the cleaner 250 enters in the full state, resulting in the decreased frequency of the replacement operation of the storage unit 252 and increased ease of maintenance in comparison with the arrangement where only the cleaner 250 is used.

Note that in the above example, the control unit 300 determines which of the two units, the cleaner 250 or waste toner collection unit 260, is to be used. Also it is feasible that the user can specify how to use the two units through the operation panel 205, by making an entry on a message display (not shown) so that in accordance with the entry made, the cleaner 250 and the waste toner collection unit 260 are switched over so as to collect the remaining toner particles. In this case, the control unit 300 functions as a reception unit operable to receive any entry made for specifying a method for using the cleaner 250 and/or waste toner collection unit 260, and also functions as a switching unit operable to switch over the two units 250 and 260 in accordance with the entry received. With the arrangement that the cleaner 250 and waste toner collection unit 260 are switched in response to a selection input that is an entry made for specifying a method for using the cleaner 250 and waste toner collection unit 260, it is made possible for the user to select a using method in accordance with his or her needs, hence improving the usability.

Note that in the above-described example, the cleaning operation is to be executed each time the image forming is carried out for one recording paper. However, the execution timing is not limited to this. It is also feasible that the cleaning operation is executed at the timing when the image forming is carried out for each page or multiple pages, or at the timing when one job or multiple jobs are completed.

Moreover, the cleaning process depicted in FIG. 22 and the one depicted in FIG. 23 are executed using different image forming apparatuses. However, such an arrangement is also adoptable that within one apparatus, the user can select either process through the operation panel 205 or an external device as needed.

Figure 24:
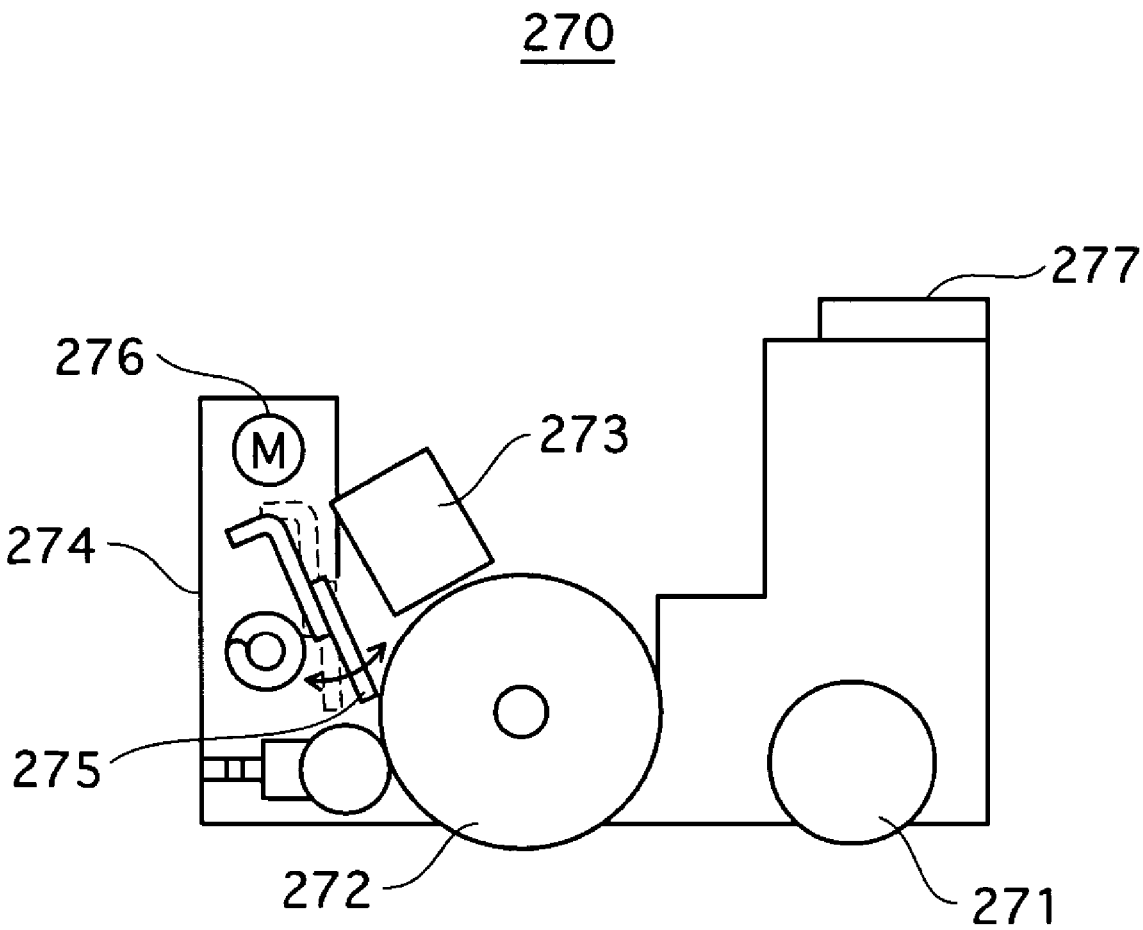
FIG. 24 is a schematic diagram of another waste toner collection unit.

FIG. 24 shows an outline of another waste toner collection unit.

As shown in the figure, a waste toner collection unit 270 includes: an charging roller 271 for charging again waste toner particles remaining on the intermediate transfer belt 225; a collection roller 272 for collecting waste toner particles on the transfer belt 225; an electrical charger 273 for charging the collection roller 272; a blade 275 for sweeping the waste toner particles transferred onto the collection roller 272 to the storage unit 274; a switching motor 276 for switching the blade 275 between a sweeping-enabled position and sweeping-disabled position; and an output terminal 277.

A description will be, hereinafter, provided on a mechanism for collecting waste toner particles by using the waste toner collection unit 270. After the secondary transfer, electrical charge carried on the waste toner particles that are left on the intermediate transfer belt 225 results in a broad distribution. So the waste toner particles are forcedly attributed to the negative polarity using the charging roller 271. Thereby, these toner particles are moved onto an area bound between the transfer roller 224 and collection roller 272.

Since the collection roller 272 is being attributed to the positive polarity due to the charger 273, the waste toner particles are moved to the collection roller 272 when the negative bias is applied to the transfer roller 224. Then, the waste toner particles collected on the collection roller 272 are swept by the blade 275 from the collection roller 272 to the waste toner storage unit 274.

Second Embodiment

(1) Configuration of an Image Forming Apparatus

The image forming apparatus in accordance with the first embodiment of the present invention is of a tandem type. In a second embodiment, an image forming apparatus of a transfer drum type will be discussed with differences to the first embodiment highlighted. For convenience of explanation, descriptions on the same or similar arrangements as those in the first embodiment are omitted or provided in short.

Figure 25:
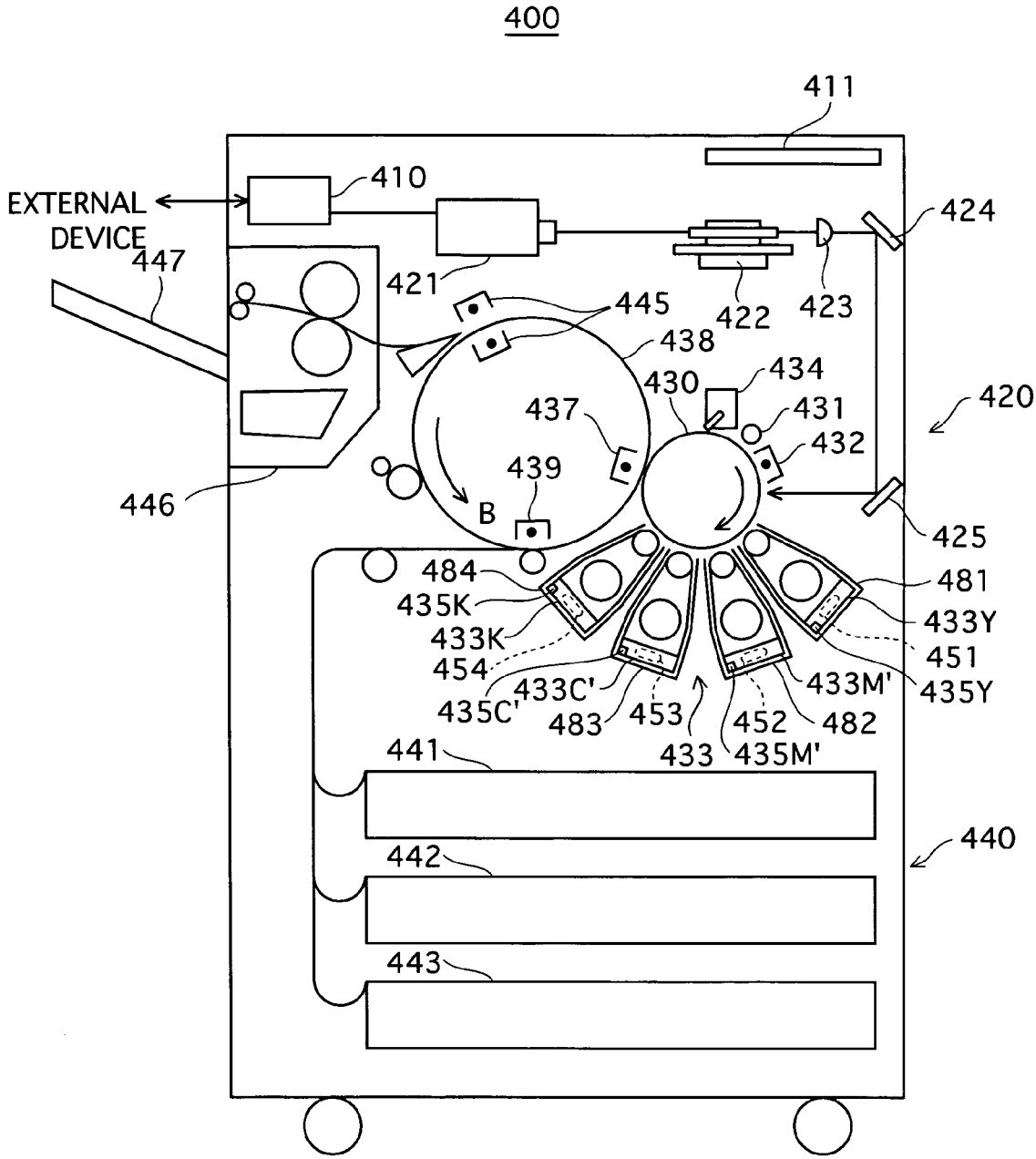
FIG. 25 shows an overall configuration of an image forming apparatus in accordance with a second embodiment of the present invention.

FIG. 25 shows an overall configuration of an image forming apparatus in accordance with the second embodiment of the present invention.

As shown in the figure, the image forming apparatus in second embodiment is a color digital printer 400 (hereinafter simply called 'printer 400 '), and includes: a processing unit 420; a paper feeding unit 440; a fixing unit 446; and a control unit 410. The printer 400 is connected to a network such as LAN. Upon reception of a command for executing a print job from an external device (not shown), the printer 400 proceeds to form a color image using the toners of the yellow-type, magenta-type, cyan-type, and the black-type colors.

The paper feeding unit 440 includes paper cassettes 441 to 443, and transports recording materials such as recording papers stored in the cassettes 441 to 443 one by one to the processing unit 420.

The processing unit 420 includes: an exposure unit 421; a photoreceptor drum 438 serving as an image carrier; and a transfer drum serving as a transfer material transporting body. Around the photoreceptor drum 430, provided are: an eraser lamp 431; an electrical charger 432; developing units 433Y, 433M', 433C', and 433K for the Y-, M-, C- and K-type colors, respectively; a cleaner 434; a transfer charger 437; and the like. In the developing units 433Y, 433M', 433C', and 433K, toners of each corresponding color is contained.

The control unit 410, upon reception of an image signal for use in executing a relevant print job from the external device, creates image data by executing processes required for this image signal, and converts the image data into a drive signal for driving a laser diode in a printer head 421 (not shown). Note that since the configuration and processes assigned to the control unit 410 are the same as those assigned to the printer in the first embodiment, detailed descriptions on them are omitted.

The printer head 421 emits a laser light for use in the image forming in response to the drive signal from the control unit 410. The laser light from the printer head 421 is deflected with a polygon mirror 422, passes through an fθ lens, and then, after its direction is changed with return mirrors 424, 425, and the laser light finally scans a surface of the photoreceptor drum 430 that is rotating in a direction indicated by the arrow in the figure.

From the surface of the photoreceptor drum 430, toner particles remaining thereon are removed by using a cleaner 434 before the drum 430 is exposed to the exposure light, and furthermore, the drum 430 is eradiated with the eraser lamp 431 so as to be discharged, and then is uniformly charged with the electrical charger 432. When a photosensitive surface uniformly charged is exposed to the exposure light, an electrostatic latent image is formed. This latent image is turned into a toner image by using any of the developing units 433.

From any of the paper cassettes 441 to 443, a recording paper of a desired size is fed as a body subjected to toner transfer. And the recording paper is subjected to an effect from an electrostatic attraction charger 439, and is forwarded to a transfer position in a face-to-face relation with a transfer charger 437 while being wrapped around a transfer drum 438 that is rotating in a direction indicated by the arrow in the figure. When reaching the transfer position, the toner image present on the photoreceptor drum 430 is transferred onto the recording paper with an electrostatic effect of the transfer charger 437

As described above, those processes from the light exposure to development, transfer and the like are repeatedly executed for each color of K-, C-, M-, and Y-types on a recording paper. Thereby, toner images are overlapped on the recording paper so as to be reproduced as a color image.

Given the order of executing the processes from light exposure to transfer is K-, C-, M- and Y-types, a toner image placed at the bottom of all the images on the recording paper is the one of the K-type color. Following this order, it is made possible to fuse the other colors better than the K-type color, increasing the vividness of the colors and hence improving the color reproducibility.

Note that the number of cycles in which the processing from light exposure to transfer is executed is not limited to four. Even in the case of three-cycle process, as long as the toner of the K-type color is used, the processing pertinent to the K-type color is executed in the first place. In the second embodiment, the processing from light exposure to transfer is executed first with respect to the K-type color. However, it is not necessarily executed first in some cases where the order of executing the processes hardly affects the color reproducibility thanks to developing characteristics and fixing characteristics. Accordingly, the process execution order is not limited to the above, and hence, it is feasible that a preferable order is determined based on experiments and other, and timing information pertinent to the light exposure and other process in accordance with the order determined is stored in the ROM in advance.

Upon completion of four toner images overlapped one after another on the recording paper, force to be attracted to the transfer drum 438 is lost therefrom with an effect of a separation static eliminator 445. Accordingly, the recording paper is separated from the transfer drum 438. Subsequently, the toner images are fixed on the recording paper by using the fixing device 446, and then the completed paper is ejected onto a tray 447.

An operation panel 411 is provided on a position of the top surface of the printer 400, which is convenient for the user to manipulate it, and using the operation panel 411, the user is able to select a desired image forming mode. There are multiple modes provided: full-color mode, pseudo full-color mode, and monochrome mode, each having the same operational behavior as in the first embodiment.

As in the first embodiment, also in the second embodiment, the image forming using the M-, C-, and K-type colors only is enabled in the pseudo full-color mode. Toners used in this mode are the same as in the first embodiment, i.e., an M' toner for the pseudo full-color image forming whose chromaticity point plotted on a chromaticity diagram is shifted closer to the yellow hue in comparison with the M toner for the full-color image forming, and a C' toner for the pseudo full-color image forming whose chromaticity point on the diagram is shifted closer to the yellow hue in comparison with C toner.

(2) Developing Unit

Inside the printer 400, slots (holding units) 481 to 484 each operable to hold the developing unit 433 are mounted to a main body thereof. All the developing units 433 are of the same shape. The user is able to attach and detach any of the developing units 433 with respect to any of the slots 481 to 484.

As the developing unit 433, those containing toners of colors Y, M, M', C, C', and K are denoted as the developing units 433Y, 433M, 433M', 433C, 433C', and 433K, respectively. As in the first embodiment, those units 433 are used in the combinations shown in FIG. 6 so as to carry out the image forming.

In order to attach the developing units 433, the user is requested to open a toner access door (not shown) attached at a front portion of the printer 400, and to push each of the units 433 firmly towards the back of the main body. And inversely, the unit 433, pulled out from the slots 481 to 484, can be detached therefrom. Any other variations are feasible as long as the units 433 are attachable and detachable.

Each of the developing units 433 has an output terminal 435 for outputting an identification signal (hereinafter, simply called 'ID signal') that is used for identifying which color a relevant unit 433 is of.

In the slots 481 to 484, unit connection terminals 451 to 454 are disposed, establishing a one-to-one relationship therebetween. When the developing units 433 are inserted in the slots 451 to 454, the output terminals 435 provided on the units 433 are electrically connected to the unit connection terminals 451 to 454 so that the ID signal is transported to the control unit 410 through the output terminals 435.

When the ID signal arrives at a unit detection unit (not shown) incorporated in the control unit 410, the detection unit proceeds to determine which of the developing units 433 is inserted in which of the slots 481 to 484 based on the ID signal. It is suggested that the ID signal is composed of three-bit information and other as in the first embodiment.

Figure 26:
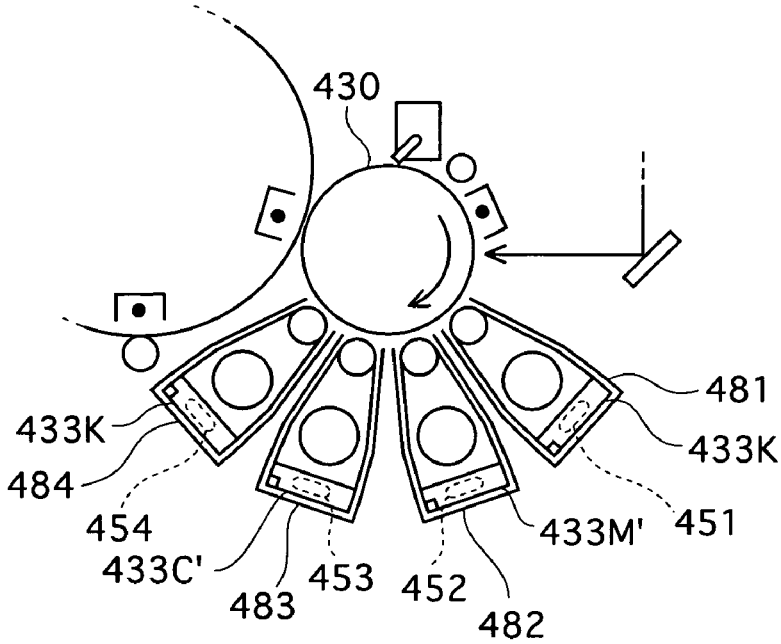
FIG. 26 shows a developing unit for a black-type color is inserted instead of that for a yellow-type color.

Now reference is made to FIG. 26, referring to a case where the developing unit 433 for the black-type color instead of the yellow-type color is inserted.

In one example shown in this figure, since the developing units 433M', 433C', and 433K are inserted, it is possible to carry out the image forming in the pseudo full-color mode and monochrome mode. Note that two units 433K are inserted in this example. Accordingly, when the image forming is actually carried out for the color K, an operational control is performed so that the number of the units 433K to be used is determined to be one or two.

Figure 27:
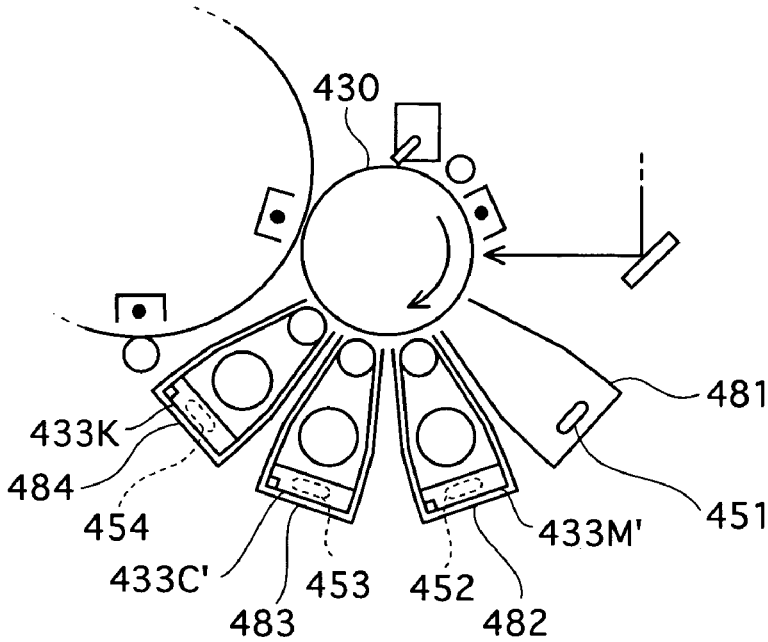
FIG. 27 shows there is a slot without the developing unit inserted therein.

A case where the developing unit 433 is not attached to any of the slots 481 to 484 is shown in FIG. 27.

In one example shown in this figure, since the developing units 433M', 433C', and 433K are inserted in the slots 482 to 484, it is possible to carry out the image forming in the pseudo full-color mode and monochrome mode, as in the example of FIG. 26.

In each of the developing units 433, a remaining toner detection sensor (not shown) is provided for detecting the amount of toner remaining therein. For this detection, it is suggested that as in the first embodiment, a well-known liquid level sensor, photoelectric sensor or the like is employed.

A detection signal produced in the remaining toner detection sensor is transported to the control unit 410. Based on that signal, the control unit 410 is able to know how much toner is left in the developing unit 433.

FIG. 28 shows comparison between the three-cycle process and four-cycle process with regard to time required for completing the image forming under the heading of SPEED, and frequency of replacement of the developing units under the heading of MAINTENANCE.

As shown in the table, in a case of the four-cycle process where the time required for the image forming is set to one and the maintenance operation is performed in a normal frequency, regardless of how many units 433 are inserted, the three-cycle process is performed at 4/3 the speed of the four-cycle process, where the processing from light exposure to development and transfer makes up one cycle. As for the maintenance, since the image forming is performed in the cycles with one color fewer than that for the four cycles, time duration from the first replacement of the unit 433 to subsequent replacement becomes longer, decreasing the frequency of the maintenance operations.

As described above, the pseudo full-color mode is provided as an option apart from the full-color mode, and hence, the user is able to select his or her preferred mode from the two. Eventually, excellent image quality in the full-color mode or high-speed processing and ease of the maintenance in the pseudo full-color mode can be accomplished for the benefit of the user in accordance with the user's choice.

Example of Modification for the Second Embodiment

For an image forming apparatus in one example of modification for the second embodiment, instead of the developing unit, a waste toner collection unit for collecting waste toner particles remaining on a photoreceptor drum is detachably inserted in the slot. Any arrangements other than the one mentioned above are, basically, the same or similar to those in accordance with the second embodiment.

For convenience of explanation, descriptions on the same or similar arrangements as for the image forming apparatus in the second embodiment are omitted or provided in short. In the following description, the above-mentioned difference will be the focus.

(1) Configuration of a Printer

Figure 29:
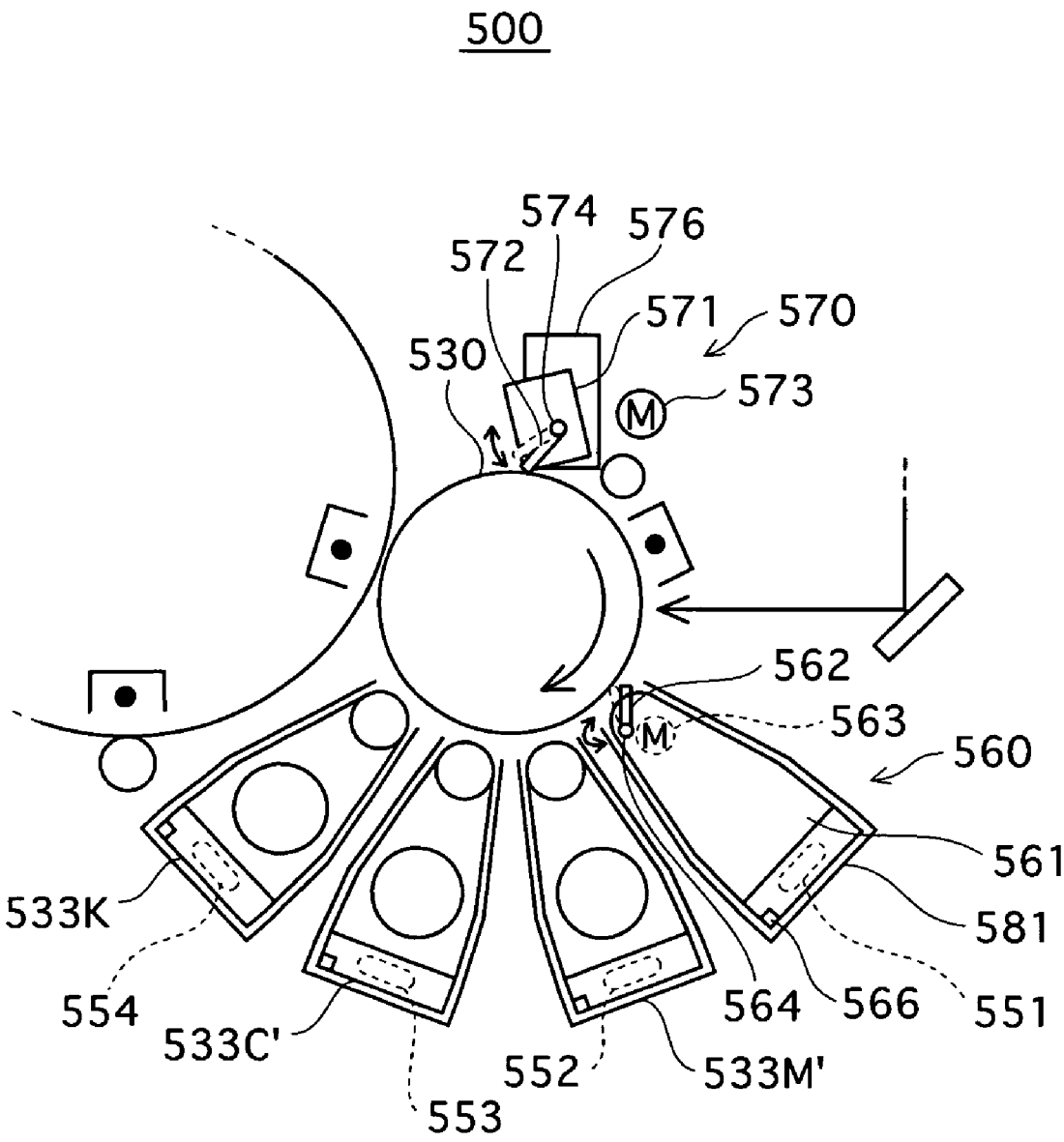
FIG. 29 shows an overall configuration of an image forming apparatus in one example of modification for the second embodiment of the present invention.

Now reference is made to FIG. 29, in which an overall configuration of an image forming apparatus in accordance with one example of modification for the second embodiment is shown.

In this figure one example is presented where the waste toner collection unit 260 is inserted in the slot 581, and the developing units 533M', 533C', and 533K are inserted in the slots 582 to 254.

The waste toner collection unit 560 is substantially of the same shape and size as those of the developing unit 533, and is attachable in any of the slots 581 to 584.

The collection unit 560 includes: a main body 561; a blade 562; a switching motor 563; and an output terminal 566, and is operable to collect toner particles remaining on the photoreceptor drum 530.

Inside of the main body 561 is hollow, and is capable of storing waste toner particles collected.

The blade 562 is held rotatable around an axis 564 thereof in directions indicated by the arrows in the figure, while at the same time being coupled with a rotational shaft of a switching motor 563 via a motive force transmission mechanism including a gear or the like (not shown).

The switching motor 563 is connected to a control unit (not shown). The control unit drives the rotation of the switching motor 563, thereby shifting the blade 562 between a position indicated by the solid line and a position indicated by the dotted line. In this case, the dotted line is a position where a tip of the blade 562 is in contact with the photoreceptor drum 530, and the solid line is a position where the tip of the blade 562 is not in contact therewith. The toner particles remaining on the photoreceptor drum 530 are swept by the blade 562 when located at the position of the dotted line, and the toner particles collected are stored inside the main body 561.

The output terminals 566 are provided so as to output an identification signal (hereinafter, simply called 'ID signal') for stating that a relevant unit is designated to store waste toner. Those output terminals 566 are electrically connected to the unit connection terminals 551 to 554 of the corresponding slots 581 to 584. Thereby, as in the case where the developing units 533 are inserted in the slots 581 to 584, the ID signal from the output terminal 566 of the waste toner collection unit 560 is transported to the control unit 520.

The control unit 520 receives the ID signal not only from the developing units 533 but also from the waste toner collection unit 560, and reads three-bit information indicated by that signal so as to identify in which of the slots 581 to 584 the waste toner collection unit 560 is inserted.

Which of the developing units 533 can be used in combination with the waste toner collection unit 560, if attached, is determined in advance. Combinations thereof are indicated with circles, indexed with the title "WASTE TONER COLLECTION UNIT" in the table shown in FIG. 6. For example, when the column 1004 is referenced, it is found that the units 533M', 533C', and 533K can be used in combination with the waste toner collection unit 560 (in the example of FIG. 29).

Moreover, in the waste toner collection unit 560, a collected toner detection sensor (not shown) is provided for detecting the amount of toner collected. For this detection, a well-known liquid level sensor, photoelectric sensor, volume sensor or the like is employed that is capable of outputting a detection signal in accordance with the amount of toner collected in the main body.

That signal from the collected toner detection sensor is transported to the control unit. Then the control unit, based on that signal, determines how much toner has been collected in the waste toner collection unit 560 and whether the unit 560 is still able to collect toner particles.

In the example of modification for the second embodiment, the cleaner 570 is disposed instead of the cleaner 434 discussed in the second embodiment.

The cleaner 570 includes: a main body 571; a blade 572; a switching motor 573; and a collection tank 576.

Inside of the main body 571 is hollow and is equipped with a rotational shaft having a screw-like shape (not shown), and with rotation of the shaft, the waste toner particles swept by the blade 572 are moved towards the collection tank 576 so as to be stored inside the tank 576.

The collection tank 576 is located on an innermost side of the apparatus, and collects waste toner particles moved with an action of the cleaner main body 571. Replacement of this tank 571 is possible by the user.

The blade 572 is held rotatable around an axis 574 thereof in directions indicated by the arrows in the figure, while at the same time being coupled with a rotational shaft of a switching motor 573 through a motive force transmission mechanism including a gear or the like (not shown).

The switching motor 573 is connected to the control unit (now shown). The control unit drives the rotation of the switching motor 573, thereby shifting the blade 572 between a position indicated by the solid line and a position indicated by the dotted line. In this case, the dotted line is a position where a tip of the blade 572 is in contact with the photoreceptor drum 530, and the solid line is a position where the tip of the blade 572 is not in contact with the photoreceptor drum 530. Toner particles remaining on the photoreceptor drum 530 are swept therefrom by the blade 572 when located at the position of the solid line, and are moved onto the collected tank 576 through the main body 571 so as to eventually be collected inside the tank 576.

In the cleaner 570, a collected toner detection sensor (not shown) is provided for detecting the amount of toner collected. For this detection, a well-known liquid level sensor or the like is employed, which is capable of outputting a detection signal in accordance with the amount of toner collected.

The control unit then, based on that detection signal, determines how much toner particles have been collected in the collection tank 576 and whether the tank 576 is still capable of collecting particles.

In the example of modification for the second embodiment, if the waste toner collection unit 560 is inserted, the number of slots available for the developing units is three, and hence, it is made possible to carry out the image forming in the three cycles only. However, the image forming per se is executed, in principle, under the same control as in the second embodiment. Note that while in the full-color mode, only the combination of Y, M, and C is allowed.

Third Embodiment

An image forming apparatus in accordance with a third embodiment of the present invention is the same as the one of a tandem type in the example of modification for the first embodiment in that the apparatus includes an intermediate transfer belt serving as a body subjected to toner transfer, whereas a difference is present between the two in that the number of holding units each operable to hold the image forming unit is only three in the case of the apparatus in the third embodiment. For convenience of explanation, descriptions on the same or similar arrangements as those in the example of modification for the first embodiment are omitted or provided in short. In the following description, the above-mentioned difference will be the focus.

(1) Configuration of the Image Forming Apparatus

Figure 30:
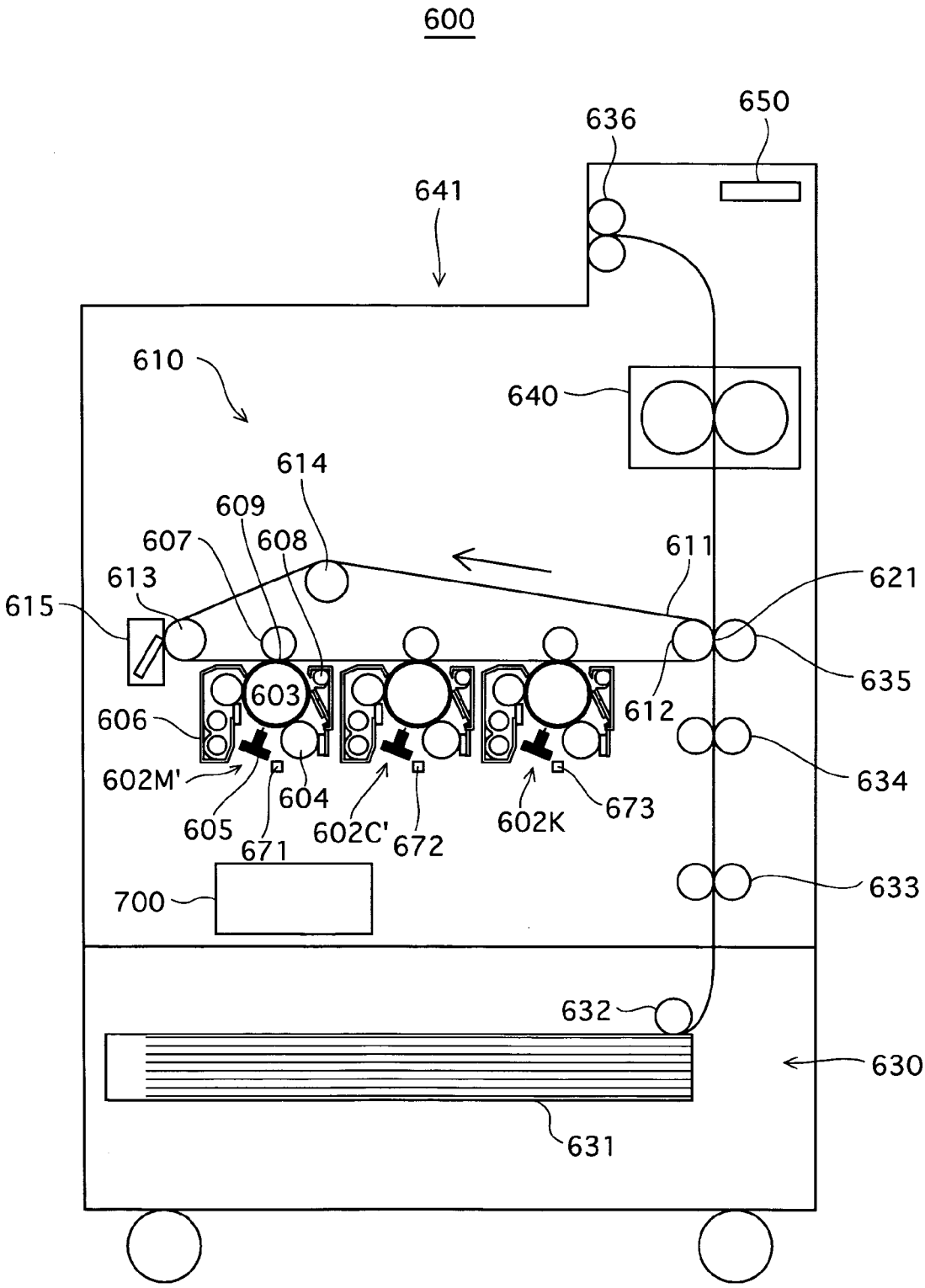
FIG. 30 shows an overall configuration of an image forming apparatus in accordance with a third embodiment of the present invention.

Now reference is made to FIG. 30, in which an overall configuration of an image forming apparatus in accordance with the third embodiment of the present invention is shown.

As shown in the figure, the image forming apparatus in the third embodiment is a color digital printer 600 (hereinafter, simply called 'printer 600 '), and is connected to a network such as LAN. Upon reception of a command for executing a print job from an external device (not shown), the apparatus proceeds to form a color image using the toners of the M-, C-, and K-type colors.

The printer 600 includes: three image forming units 602M', 602C', and 602K each operable to form toner images of the M', C', and K colors, respectively; an intermediate transfer unit 610 having an intermediate transfer belt that rotates in a direction indicated by the arrow in the figure; a paper feeding unit 630; a fixing unit 640; and a control unit 700.

The image forming units 602 are placed serially at predetermined intervals along the intermediate transfer belt 611 facing thereto, starting from an upstream side thereof to a downstream side. Each of the units 602 includes: a photoreceptor drum 603 serving as an image carrier; an electrical charger 604 disposed around the drum 603; a light exposure unit 605; a developing unit 606 in which a toner is contained; and a cleaner 608.

The intermediate transfer unit 610 includes: a drive roller 612; a driven roller 613; a tension roller 614; primary transfer rollers 607 disposed facing to each of the photoreceptor drums 603; an intermediate transfer belt 611 suspended over the rollers 607, 612, 613, and 614; a drive motor for driving the rotation of the drive roller 612; and a cleaner 615 for cleaning toner particles remaining on the transfer belt 611.

The paper feeding unit 630 includes: a paper cassette 631 for loading recording materials such as recording papers; a feeding roller 632 for feeding the recording papers inside the cassette 631 one by one; a pair of transporting rollers 633 for transporting the recording papers fed from the cassette 631; a timing roller 634 for adjusting timing for transporting the recording papers to a secondary transfer position 621; and a transfer roller 635.

The control unit 700, upon reception of a printing request command from an external device, receives an incoming image signal, converts the signal into a digital image signal for reproduction of the M-, C-, and K-type colors, and generates a drive signal for driving each of the light exposure units 605. In response to the drive signal from the control unit 700, the light exposure unit 605 emits a laser light for forming images of each color so as to perform exposure-scanning on the photoreceptor drum 603 in a main scanning direction.

Prior to the exposure-scanning, toner particles remaining on the surface of the photoreceptor drum 603 are removed by the cleaner 608. After that, the photoreceptor drum 603 is discharged with irradiation of an eraser lamp (not shown), and is uniformly charged by the electric charger 604. When the laser light is irradiated to the photoreceptor drum 603 while in a state of uniformly charged, an electrostatic latent image is formed on the surface of the drum 603.

Each of the electrostatic latent images is developed by the developing unit 606 specific to each color, and thereby, a toner image is formed as a developer image on the surface of the drum 603 for each of the colors M', C', and K, and when arriving at each of the primary transfer positions 609, the toner image is transferred successively onto the intermediate transfer belt 611 being rotated, with an electrostatic force that is produced by a voltage applied to the primary transfer rollers 607 provided on a back surface of the intermediate transfer belt 611. This is called primary transfer.

In the primary transfer, the image forming operation is carried out with timing shifted for each color in the rotation direction from the upstream side of the transfer belt 611 to the downstream side thereof, so that toner images are transferred in multiple layers at the same positions of the intermediate transfer belt 611. Thereby, the toner images are overlapped in the order of M', C', and K from the downstream side of the belt 611. In this respect, the image forming unit 602 and intermediate transfer unit 610 function as an image forming unit.

The toner images of each color overlapped on the transfer belt 611 are moved onto the secondary transfer position 621 by the rotation of the transfer belt 611.

In synchronization with timing for the rotation of the intermediate transfer belt 611, a recording paper is fed from the paper feeding unit 630 through the timing roller 634. The recording paper is forwarded while being interposed between the intermediate transfer belt 611 and the secondary transfer roller 635. When the paper reaches the secondary transfer position, the toner images on the transfer belt 611 are transferred, as secondary transfer, onto the recording paper by the electrostatic force generated by the voltage applied to the secondary transfer roller 611.

The recording paper passing through the secondary transfer position is transported to the fixing unit 640. Then heat and pressure are applied to the recording paper so that toner images are fixed thereon, and the completed paper is ejected through a pair of ejection rollers 636 onto a paper ejection tray 641.

In this manner, a color image formed with the toner images of the three colors of M-, C-, and K-types is completed. In a case of forming a monochrome image, for example, using only the color K, the above-described process is executed by relying on the image forming unit for the K only so that an image of the color K is formed on a recording paper.

As described above, a toner of the Y-type color is not employed in the third embodiment, because the Y-type color affects a reproduced image the least, and hence, degradation of the color reproducibility is minimized. However, unless the Y-type toner is used, the reproducibility of a color image containing the Y color component is deteriorated. Therefore, in the third embodiment, instead of the M- and C-type toners, the M' and C' toners for use in the pseudo full-color image forming are adopted as described in the first embodiment.

As shown in FIG. 30, each of the image forming units 602 is provided in an attachable/detachable manner with respect to the main body of the apparatus. Thanks to this feature, the user is able to easily replace the unit 602 with a new one, when the toner of the unit 602 runs out.

As a holder of the image forming unit 602, a slot (not shown) is provided to the main body of the apparatus. In order to detach the unit 602, the user is requested to open a toner access door (not shown) attached at a front portion of the printer, and to pull out the unit 602 held in the slot, and inversely in order to attach the unit 602, the user is requested to push the unit 602 towards an innermost side of the printer. As long as the unit 602 is attachable and detachable, any other variations are feasible.

Moreover, in the third embodiment, as alternatives for the image forming units 602M' for the magenta-type color and 602C' for the cyan-type color, the image forming units 602M and 602C (not shown) are available that contain in the developing units developers including the toners of the conventional M and C colors, respectively. The insertion of these units 602M and 602C is allowed superseding the units 602M' and 602C'.

These units 602M and 602C are, basically, of the same shape and size as those of the units 602M' and 602C' while the type of toners contained therein are different.

The image forming unit 602 to be inserted in the main body of the printer is selectable between the 602M' and 602M, and those 602C' and 602C. Each of the image forming units 602 has a signal output unit (not shown) operable to output from an output terminal (not shown) an identification signal, for example, a signal composed of three-bit information that indicates which color a relevant unit is of. Specifically, the three-bit information may indicate '001' for the unit 602M, '010' for the unit 602M', '101' for the unit 602K and so on.

Inside the printer 600, at positions where the image forming units 602 are inserted, unit connection terminals 671, 672, and 673 are disposed. When the units 602 are inserted in the main body of the printer 600, the output terminals 671 to 673 are electrically connected to the output terminals provided in the units 602. The ID signal outputted from the unit 602 is sent to the control unit 700 through the unit connection terminals 671 to 673.

A setting state judgment unit 709 (FIG. 31) operable to judge the setting state of the control unit 700, upon reception of the ID signal from each of the units 602, makes a judgment on at which position the relevant units 602 are attached. Specifically, If the ID signal received through the unit connection terminal 671 contains '001', it means that the unit 602M is inserted at a position corresponding to the unit connection terminal 671 (at the leftmost position of the printer). Hereinafter, a position of the unit connection terminal 672 is called a middle position of the printer, and a position of the unit connection terminal 673 is called a rightmost position.

Note that a label (not shown) on which information such as name is written is put on the surface of each of the image forming units 602 so that from that information the user is able to know the type and a chromaticity point of a toner filled in the unit 602 in question. With the use of that label, it is made possible to tell one unit from another without confusing.

Figure 31:
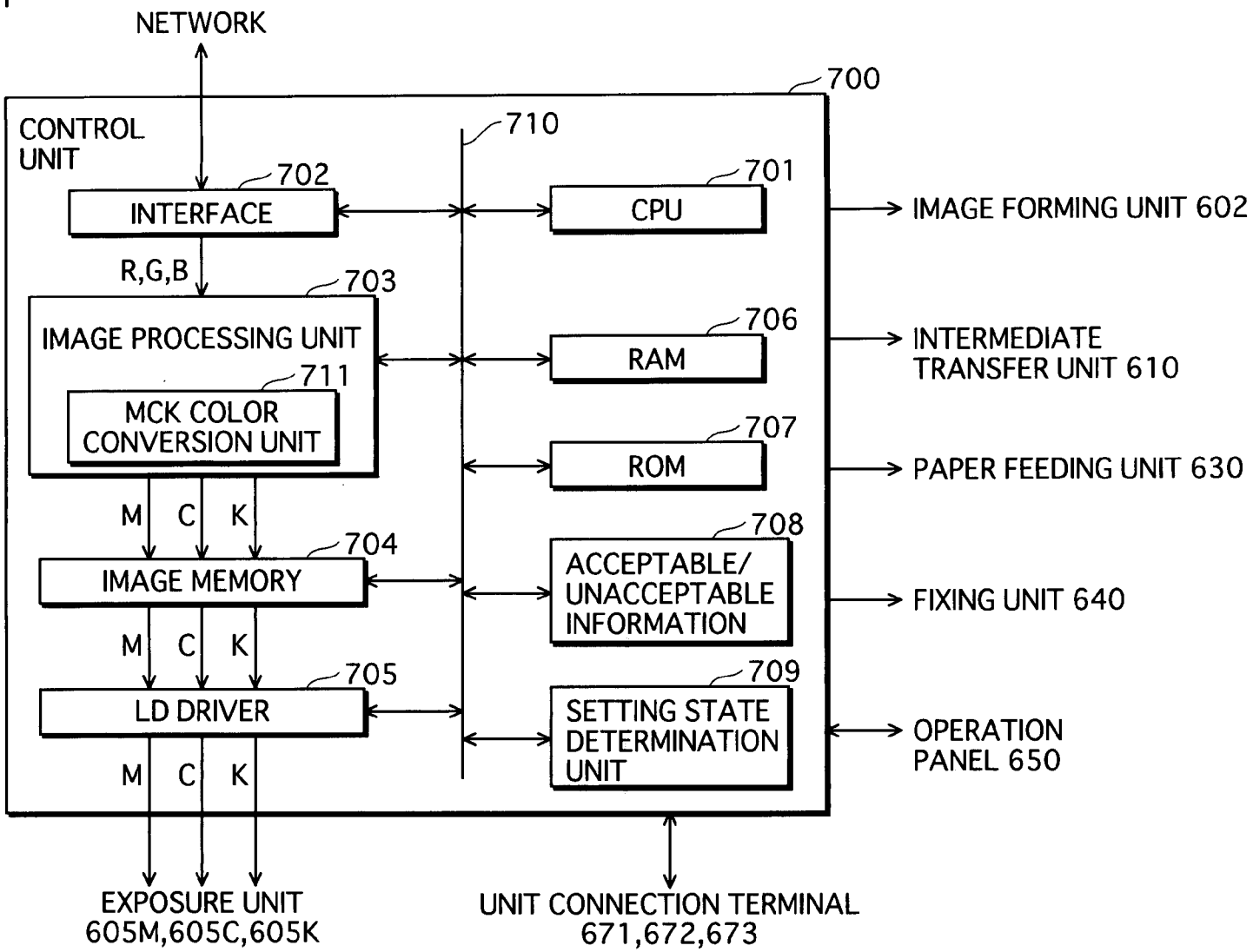
FIG. 31 is a block diagram of a control unit in accordance with the third embodiment of the present invention.

Now reference is made to FIG. 31, in which a block diagram of a control unit in the third embodiment is shown.

As shown in this figure, the control unit 700 includes: a CPU 701; a communication interface 702; an image processing unit 703; an image memory 704; an LD driver 705; a RAM 706; a ROM 707; an 'acceptable/unacceptable' information memory unit 708; and a setting state judgment unit 709 as main constituent elements, and data communication therewithin is carried out using a bus 710.

The communication interface 702 is provided for communication with a network such as a LAN card or LAN board.

The setting state judgment unit 709 makes a judgment as for which of the image forming units 602 is attached at which position, based on the ID signal received from each of the units 602 through the unit connection terminals 771 to 773.

The 'acceptable/unacceptable' information memory unit 708 is made of a nonvolatile memory, in which information indicating normal combinations of the image forming units 602 is stored.

Figures 32, 33:
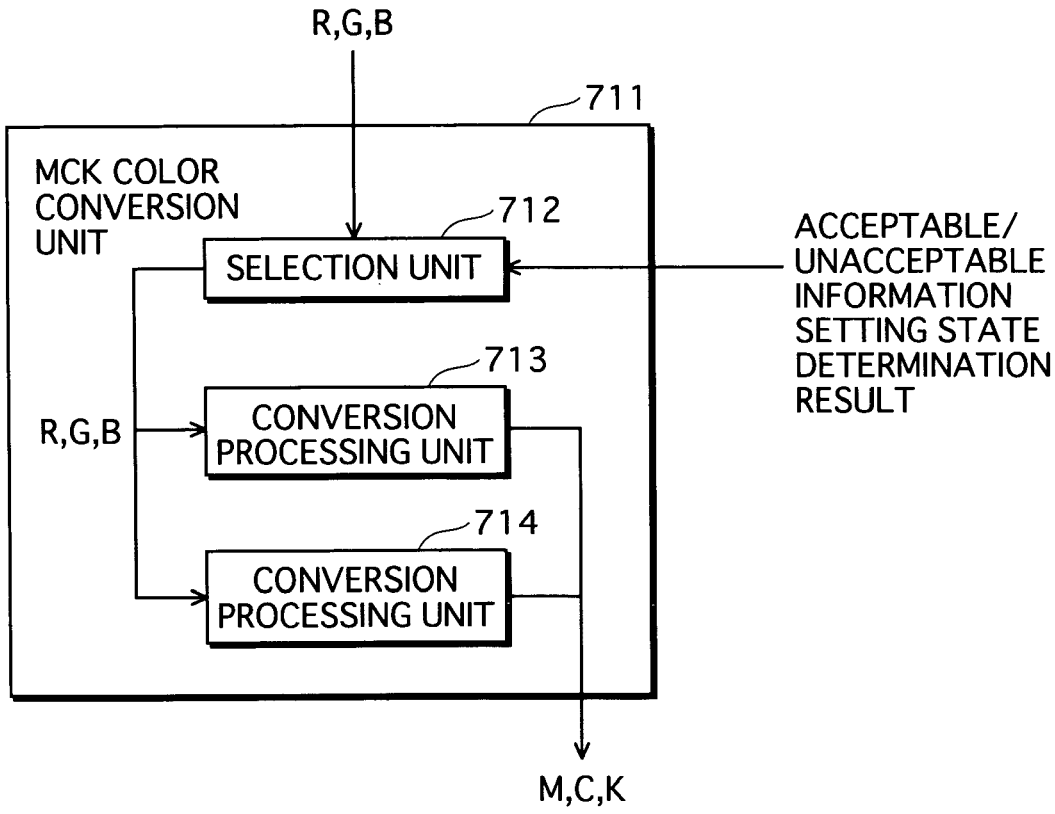
FIG. 32 presents contents of 'acceptable/unacceptable' information that is stored in an 'acceptable/unacceptable' information memory unit inside the control unit.
FIG. 33 is a block diagram of an MCK color conversion unit inside the control unit.

FIG. 32 presents one example of the information stored in the 'acceptable/unacceptable' information memory unit 708 of the control unit 700.

The 'acceptable/unacceptable' information is tabulated so as to show at a glance combinations of the image forming units 602 to be attached at the leftmost position, middle position, and rightmost position of the printer. Specifically, in one example of FIG. 32, as indexed with the name 'PATTERN 1' a combination is acceptable in which the image forming units of the M', C', and K are attached at the leftmost position, middle position, and rightmost position, respectively.

On the other hand, 'PATTERN 2' shows the combination of the M, C, and K is acceptable. In terms of excellent reproducibility of the color image containing the Y color component, it is preferable to use M- and C-type toners together. In a case where the user has no intention to have a chart or graph reproduced faithfully because a reproduced image is used internally, for example, in his or her office only, it is determined that the pattern 2, i.e., the use of the M and C toners falls within a range of acceptance because usefulness brought about therewith may be increased.

Again in FIG. 31, the image processing unit 703 performs a well-known correction process such as shading to the image signal, for example, RGB color data that is received through the communication interface 702, converts it on a 'per pixel' basis into a digital image signal (image data) for those colors reproduced as M-, C-, and K-type colors, and stores that converted image data into the image memory 704. This conversion is carried out by an MCK color conversion unit 711.

Now reference is made to FIG. 33, in which a block diagram of the MCK color conversion unit 711 inside the control unit is shown.

As shown in this figure, the MCK color conversion unit 711 includes a selection unit 712, and conversion processing units 713, 714.

For the conversion of RGB into MCK, the selection unit 712 selects either of the conversion processing unit 713 or 714 in accordance with the combination of the image forming units (pattern 1 or 2).

Then, the conversion processing unit 713 or 714 proceeds with the relevant conversion of RGB into MCK using a predetermined formula.

This conversion formula is created, while chromaticity points of the toners and combination of the image forming units are taken into account, by obtaining an appropriate value of a coefficient related to the Y, M, C, K color data from experiments and other, based on the formula used for the image processing such as the UCR (Under Color Removal), BP (Black Replacement), or γ correction, for each combination of the image forming units.

In this case, data pertinent to the conversion formula used in the case of the pattern 1 is stored in the conversion processing unit 713 in advance. When the conversion is actually carried out, this data is read from the unit 713, and is applied to the processing. Likewise, data pertinent to the conversion formula for the case of the pattern 2 is stored in the conversion processing unit 714 in advance. A detailed description will, hereinafter, be provided on the conversion processing executed by the MCK color conversion unit 711.

A method for executing this kind of conversion is not limited to the one for obtaining a coefficient value by using the conventional formulas. It is also feasible that a formula is newly created from experiments and other that falls within the scope of the present invention for forming a color image using the M' and C, toners only. Alternatively, if the relevant conversion is realized based on predetermined conditions, other variations such as a conversion table are employed.

In FIG. 31, the LD driver 705, under the control of the CPU 701, reads the M-, C-, and K-type color image data from the image memory 704 for each scanning line, and proceeds to drive the light exposure units 605M, 605C, and 605K.

The ROM 707 stores computer programs pertinent to the image forming operation assigned to the intermediate transfer unit 610 and the recording paper feeding operation assigned to the paper feeding unit 630, and a computer program pertinent to the setting state notification process with which the setting state of the image forming units 602 is notified to the user.

The RAM 706 becomes a work area when any of the computer programs is running in the CPU 701.

In order to execute the image forming, paper feeding operation or the like, the CPU 701 reads a necessary program from the ROM 707, and works on systematic control by adjusting timing of all the units involved so that the execution of a relevant printing operation is carried out smoothly. Also the CPU 701 is responsible for executing the setting state notification process.

Figure 34:
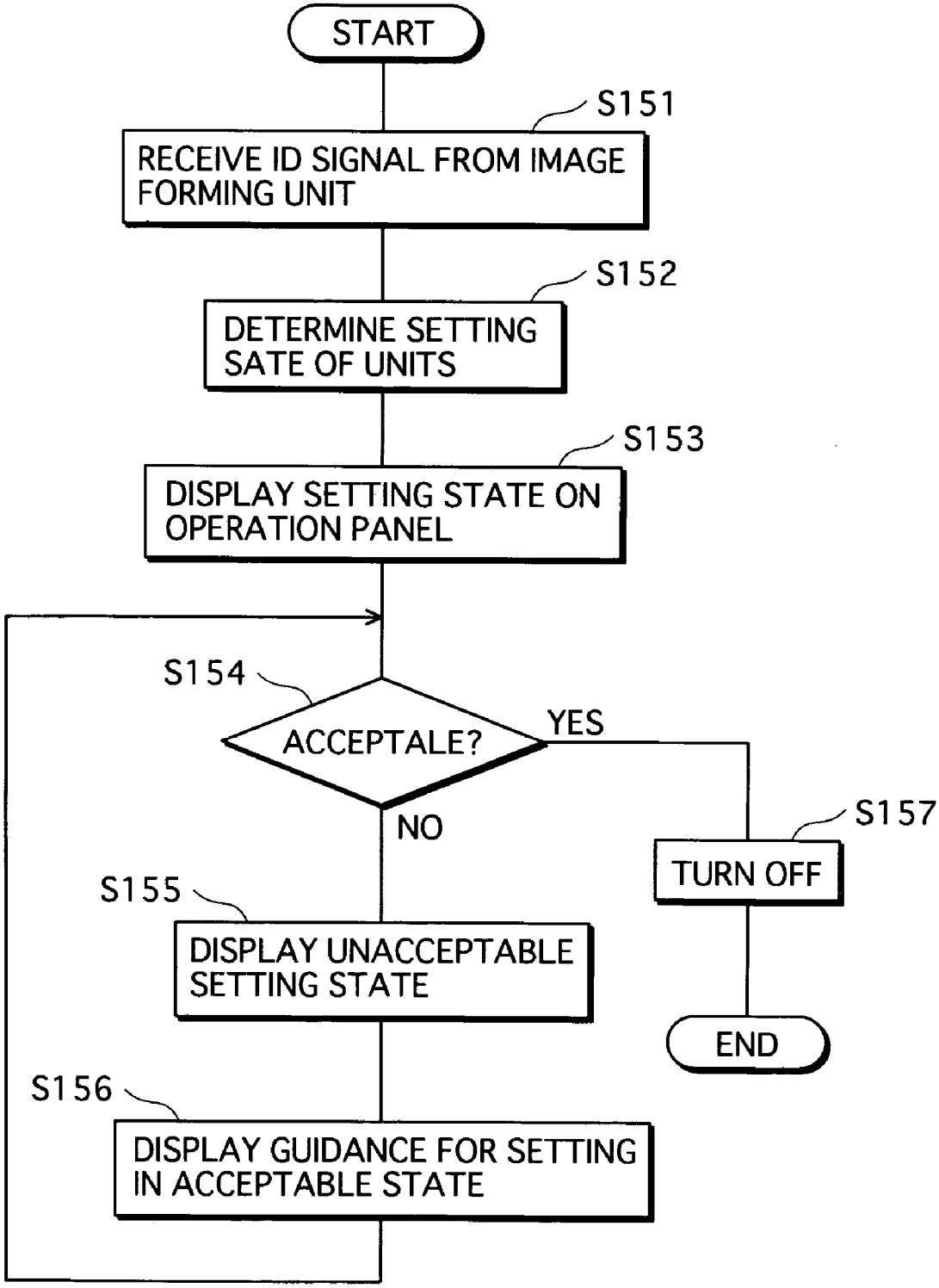
FIG. 34 is a flowchart depicting steps involved in a setting state notification process.

Now reference is made to FIG. 34, in which a flowchart depicting steps involved in the setting state notification process is shown.

This notification process is executed when at least one of the image forming units is replaced. So that the confirmation is made on the fact that at least one of the image forming units has been replaced, a method using a switch for detecting the image forming units 602 (not shown) is suggested. Specifically, this switch is mounted on the main body of the printer, and if the switch is turned on, it means that the relevant unit 602 is inserted, and if turned off, the relevant unit 602 is removed. In short, when a signal from the switch shifts from off to on, it means that the unit 602 has been replaced with another. Any other variations are feasible as long as capable of detecting the attached/detached state of the image forming units 602.

As shown in the chart, the control unit 700 receives the ID signal from each of the image forming units 602 inserted (S151), and based on the ID signal, makes a judgment on the setting state of the image forming units 602, i.e., which color the source unit 602 is of and at which position that unit 602 is inserted (S152). This judgment is performed by the setting state judgment unit.

After that, the setting state of the image forming units 602 is displayed on the operation panel 650 (S153).

FIG. 35 presents examples of messages indicating the setting state of the image forming units 602.

Specifically, in FIG. 35A, one example of a display 801 is shown in which a message indicating that the image forming units 602 are inserted from the left in the order of M', K, and C'. FIG. 35B presents one example of a display 802 is shown in which a message indicating that the units 605 are inserted from the left in the order of M and C.

In FIG. 34, the control unit 700 determines whether or not the setting state is acceptable (S154). This determination is carried out by comparing a setting state of the units 602 to the 'acceptable/unacceptable' information. As the result of the comparison, if a relevant setting state of the image forming units 602 matches either of the pattern 1 or 2, the relevant setting state is determined to be acceptable. Specifically, if the image forming units 602 are inserted from the left in the order of M', C', and K, this state is the same as the pattern 1, and hence, determined to be acceptable. If the units 602 are inserted from the left in the order of M', K, and C' as shown in the example of FIG. 35A, this setting state matches neither of the pattern 1 nor 2, and hence, determined to be unacceptable. On the other hand, the one shown in the example of FIG. 35B is equivalent to the pattern 2, and hence, determined to be acceptable.

As a comparison result, if unacceptability of a setting state is confirmed (NO in S154), so that the image forming units 602 are reset in an acceptable order, a guidance message is displayed on the operation panel 650 so as to prompt the user to follow the message (S155, S156).

FIG. 35C shows one example of a display 803 that is to appear when the relevant state is found to be unacceptable. Corresponding to the display shown in FIG. 35A, the display 803 shows a message indicating that the setting state is unacceptable and therefore, prompting the user to change the unit K with the unit C'. In the case of FIG. 35C, the message indicating that the setting state is unacceptable is shown in parallel with the message prompting the user to change the units 602 within a display. Alternatively, it is also feasible that two messages are displayed on different displays by switching between the two.

When the control unit 700 determines that the setting state has been corrected, for example, by the user resetting the units 602 in question at their appropriate positions (YES in S154), the display 801 appearing on the operation panel 650 is disappeared (S157), and the ongoing process terminates.

As described above, the determination is made on the basis of acceptable/unacceptable. Alternatively, the determination may be made on whether or not a relevant setting state is the best of all. When the determination is made based on the patterns shown in FIG. 32, in S154, only if a relevant setting state is the same as the pattern 1, that state is determined to be the best, and as for any other setting states that are not determined to be the best, i.e., as for those matching the pattern 2, a display 804 as shown in FIG. 35D may appear on the operation panel 650. The display 804 shows a message indicating that the image forming units 602M and 602C should be changed with the units 602M' and 602C' so that the units 602 are used in the best setting.

Apart from the above message indication, for example, any other variations are feasible so as to notify the user of it, such as audio indication or turning on a lamp specific to that indication. Also, it is feasible that a notification process is executed with respect to an external device such as a personal computer so that a display unit such as a monitor incorporated in the device is enabled to display a message. More specifically, a message display command is sent to the personal computer, and in response to it, any guidance message is displayed on the monitor. This will apply to a fourth embodiment of the present invention.

Figure 36:
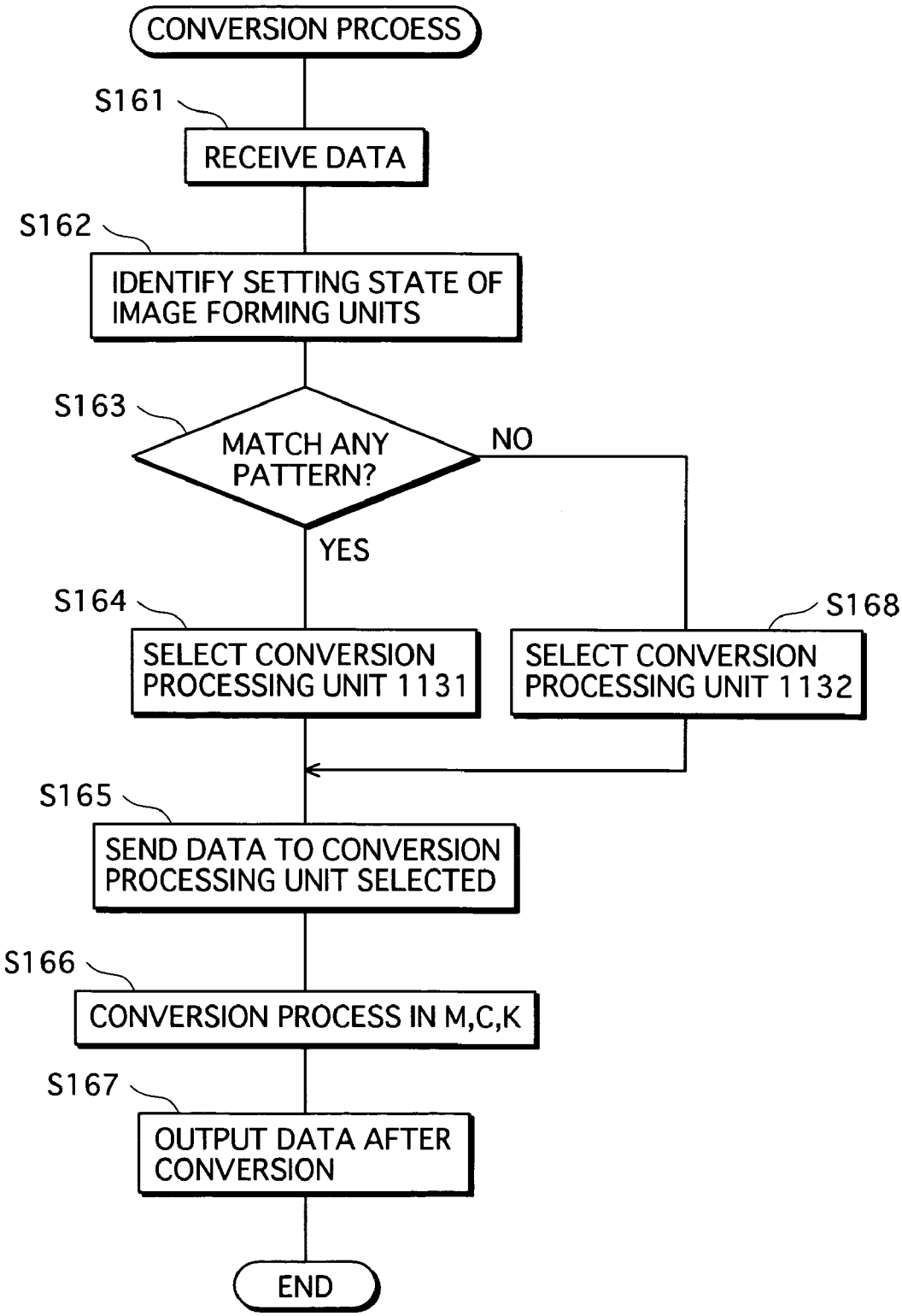
FIG. 36 is a flowchart depicting steps involved in a conversion process executed by the MCK color conversion unit.

Now reference is made to FIG. 36, in which a flowchart depicting steps involved in a conversion process executed in the MCK color conversion unit is shown.

As shown in the chart, when the RGB color data that has undergone the correction process such as the shading is received (S161), determination is made on a pattern, i.e., the setting state of the image forming units 602 (S162) This determination is carried out following the same processes as described in S151, S152, and S154. Specifically, an outcome of the determination by the setting state determination unit 709 and 'acceptable/unacceptable' information are referenced. From the outcome of the determination, it is determined that which of the image forming units 602 is attached at which position, and then, it is determined which pattern the relevant setting state of the units 602 matches.

If matching with the pattern 1 is confirmed (YES in S163), the conversion processing unit 713 is selected as a unit operable to execute the conversion (S164).

After that, the RGB color data is transported onto the conversion processing unit selected, i.e., the unit 713 in this case (S165).

Upon reception of the RGB color data, the conversion processing unit 713 proceeds to read the conversion formula data that has been stored in the unit 713, and using that formula, the RGB color data is converted into the MCK color image data (S166). When the relevant conversion is completed, resulting image data is outputted to the image memory 704 (S167), and the ongoing process terminates.

If 'NO' is returned in S163, i.e., the matching with the pattern 2 is confirmed (NO in S163), the conversion processing unit 714 is selected (S168), and then, the process goes back to S165. Following the steps S165 through S167, data transfer to the unit 714, MCK conversion, and completed data output are carried out.

As described above, the determination is made on the matching with the pattern 1 or 2. In a case where the image forming units 602 are set in any other patterns, subsequent to the S162, the above-described setting state notification process is carried out. And then, when the setting state of the units 602 is determined to be acceptable because all the units 602 are reset correctly by the user, the relevant process is resumed after S163.

As clarified above, in accordance with the third embodiment of the present invention, a color digital printer includes the image forming units 602 for the M-, C-, and K-type colors only. With this arrangement, it is made possible to form a color image while minimizing the degradation of the color reproducibility. Since the image forming unit 602 of the yellow-type color is not included, down-sizing and low manufacturing costs of the printer are achieved.

In addition, since the unit 602 of the black-type color is included, it is made possible to reproduce letters written in black that are generally used in business documents, more beautifully than reproducing the blackness using the three colors Y, M, and C.

Fourth Embodiment

Although the image forming apparatus in accordance with the third embodiment is one of a tandem type, an image forming apparatus in accordance with a fourth embodiment is one of a transfer drum type. In this respect, these two apparatuses are largely different. Hereinafter, for convenience of explanation, descriptions on the same or similar to the arrangements in the third embodiment will be omitted or provided in short. In the following description, the above-mentioned difference will be the focus.

Figure 37:
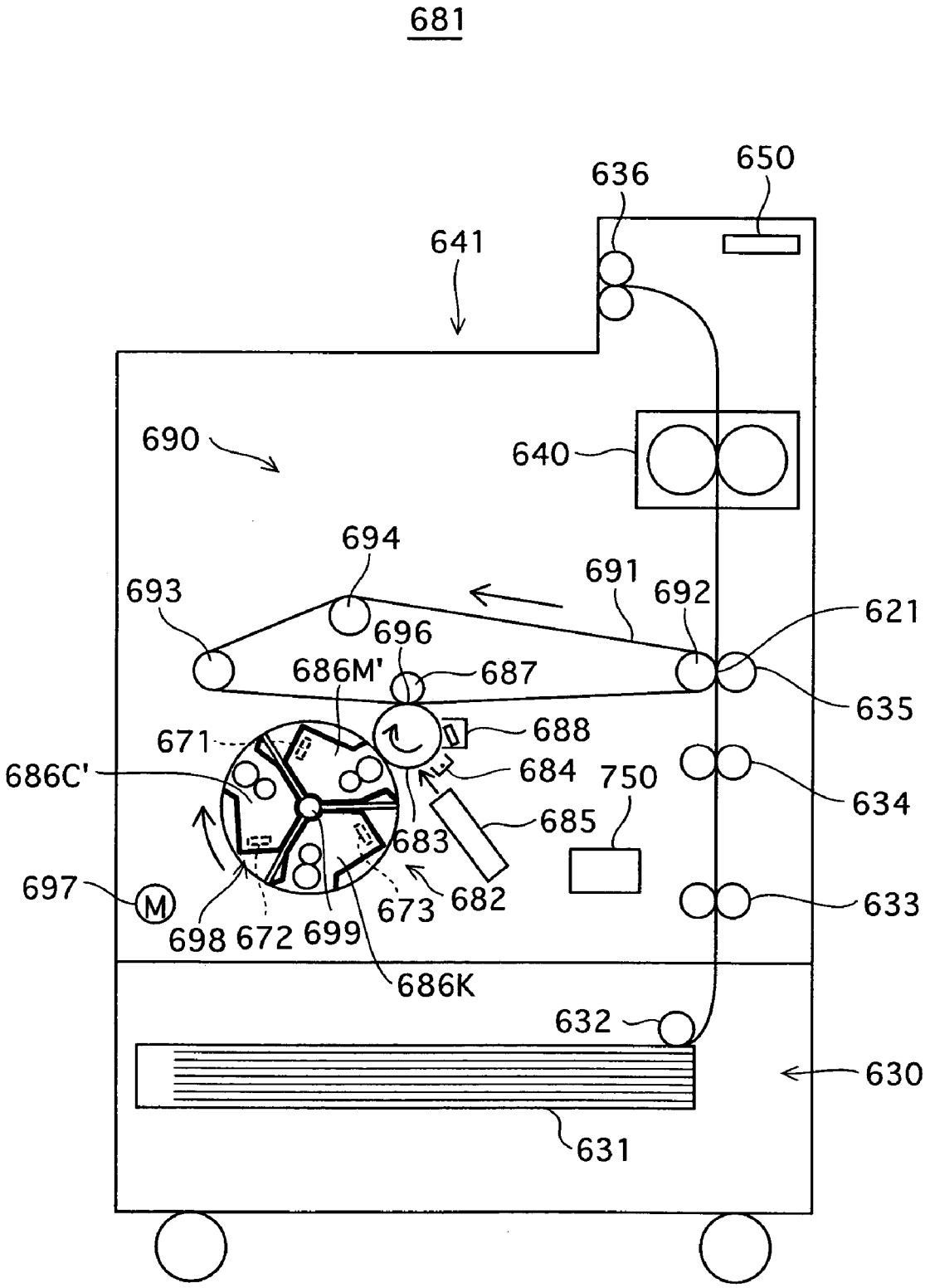
FIG. 37 shows an overall configuration of an image forming apparatus in accordance with a fourth embodiment of the present invention.

Now reference is made to FIG. 37, in which an overall configuration of an image forming apparatus in accordance with the fourth embodiment of the present invention is shown.

As shown in this figure, a printer 68l is largely different from the printer 600 in the third embodiment in terms of an image forming unit 682 and an intermediate transfer unit 690.

The intermediate transfer unit 690 includes: a drive roller 692; a driven roller 693; a tension roller 694; and an intermediate transfer belt that is suspended over the rollers 692, 693, and 694 as a body subjected to toner transfer.

The image forming unit 682 includes: a photoreception drum 683; an electrical charger 684; a light exposure unit 685; developing units 686M', 686C', and 686K; a primary transfer roller 687; and a cleaner 688.

The light exposure unit 685, including a laser diode, exposes a light to a surface of the photoreceptor drum 683 for each color to be reproduced, based on a drive signal from a control unit 750.

Prior to the above-mentioned light exposure, the cleaner 688 cleans toner particles remaining on the surface of the photoreceptor drum 683, and the photoreceptor drum 683 is uniformly charged by the electrical charger 684. When the photoreceptor drum 683 is exposed to the light while being uniformly charged, an electrostatic latent image is formed on the photosensitive surface thereof.

Each of the developing units 686, inserted in a slot (not shown) of a developer rack 698, is rotatably driven in a direction indicated by the arrow in the figure by a developer switching motor 697 around a supporting shaft 699 of the rack 698, and its rotation is controlled by the control unit 750 so that any of the developing units 686 having a toner of a color that is to be reproduced subsequently is brought into a face-to-face position with the photoreceptor drum 683, and thereby, each of the electrostatic latent images on the drum 683 is developed. FIG. 37 shows the developing unit 686M' containing a toner of the M-type color come to a developing position.

Connection terminals 671 to 673 provided on the developer rack 698 have the same functionality as described in the first embodiment. When the developing unit 686 is inserted, each of the connection terminals 671 to 673 is connected to an output terminal (not shown) mounted on each of the developing units 686, and through that output terminal, an identification signal for identifying each of the units 686 (hereinafter, simply called 'ID signal') is sent to the control unit 750. Based on this ID signal, the control unit 750 is able to know which of the developing units 686 is attached at which position of the developer rack 698.

Note that a sensor (not shown) is provided in the main body of the printer for detecting a rotation angle of the developer rack 698, and based on a detection signal from the sensor, the control unit 750 determines which of the developing units 686 is attached at which position.

Toner images formed on the photoreceptor drum 683 are transferred onto the intermediate transfer belt 691, at a primary transfer position 696, by an electric field generated between a primary transfer roller 687 and the photoreceptor drum 683. For the primary transfer, the image forming operation on the drum 683 is carried out by controlling the timing for the light exposure, switching operation of the developing units 686 and the like, so that the toner images of each color are transferred at the same position of the intermediate transfer belt 691 in the order of M-type, C-type, and K-type colors. Those toner images of the M-type, C-type, and K-type colors are overlapped thereby one after another onto the transfer belt 691, resulting in a color toner image.

When the primary transfer of all the toner images to the transfer belt 691 is completed, the resulting toner images are transferred to a recording material such as a recording paper at one time at a secondary transfer position 621, and are fixed to the recording paper in the fixing unit 640. Then, the completed recording paper is ejected to the ejection tray 641.

Figure 38:
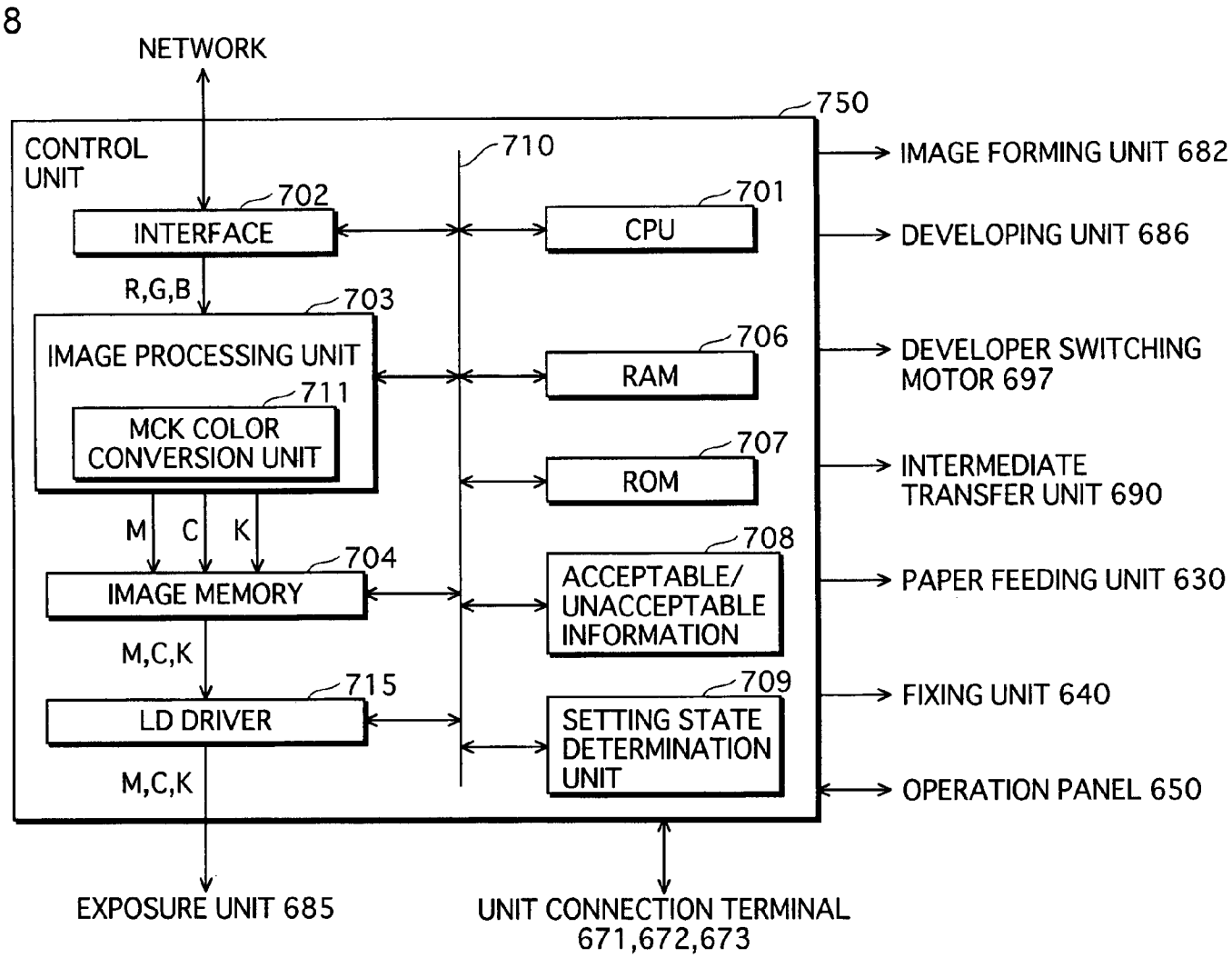
FIG. 38 is a block diagram of a control unit in accordance with the fourth embodiment of the present invention.

Now reference is made to FIG. 38, in which a block diagram of a control unit in accordance with the fourth embodiment is shown.

As shown in this figure, the control unit 750 is basically the same as the control unit 700 in the third embodiment, whereas two differences between the two units 750 and 700 are noted. Specifically, (i) the rotation of the developer switching motor 697 is controlled by the control unit 750, (ii) so that the start of the image forming operation pertinent to a subsequent color is controlled, each time image data is read in the order of M', C', and K in the LD driver, the drive signal is sent to the exposure unit 685.

Note that the image forming units 602 in the third embodiment are attachable and detachable, while this operation is enabled on the basis of the developing unit in the fourth embodiment. The user is able to attach/detach each of the developing units 686 to/from the developer racks 698, holders of the developing units 686. As in the third embodiment, as options for the developing units 686M' and 686C', the developing units 686M and 686C are available that contain the toners of the M-type and C-type colors, respectively, whose chromaticity points are the same as those of the conventional toners. Accordingly, the user is able to select between the developing units 686M' and 686M, and between the developing units 686C' and 686C. In this case, the control over the MCK color conversion unit 711 is the same manner as described in the third embodiment. In short, either of the conversion processing unit 713 or 714 is selected so as to carry out the color conversion in accordance with the combination of the three developing units 686 inserted and the insertion positions thereof.

As clarified above, in accordance with the present invention, color images can be formed using the three colors of the M-type, C-type, and K-type within the image forming apparatuses equipped with the intermediate transfer body. Hence, a particular part involved in the developing operation can be manufactured in smaller size than those employed for the image forming in four colors including the yellow-type color, and as a result, the whole size of the apparatus can be largely reduced.

EXAMPLES OF MODIFICATIONS

The present invention has been explained in detail in the above embodiments. However, the embodiments of the present invention are not limited to the above, and other modifications described below are to be included within the scope of the invention.

(1) In the above embodiments, such an arrangement is adopted that three or four holding units (slots) are provided, each operable to hold the developing unit. However, the number of holding units is not limited, and the provision of five or more holding units is allowed. For example, if six holding units are provided, all of the six developing units of Y, M, M', C, C', and K are held at the same time, hence enabling the image forming operation in various kinds of modes in accordance with the usage of a print without changing the developing units. In addition, if multiple developing units for a color frequently used are held at the same time, a cycle for changing the developing units for that color extends, reducing any trouble for the maintenance operations.

(2) In the above embodiments, all the developing units are attachable/detachable with respect to the holding units. Alternatively, it is feasible that the developing units of M', C', and K are fixedly mounted to the holding units, while the attachment/detachment of the developing units is enabled only with respect to the remaining units. With this arrangement, the pseudo full-color mode is entered without fail, and if the developing unit for the Y is inserted in one of the remaining units, the full-color mode is also enabled in high quality using the four colors of Y, M, C, and K.

(3) With a predetermined arrangement for the best setting of the image forming units and the slots, so that the image forming units are set to the slots in the best manner, a message suggesting, for example, that the image forming units currently held in the slots #1 and #2 be changed with each other is shown on the operation panel, and thereby prompts the user to follow the instruction.

When the image forming apparatus of the electrophotograph type is employed, it should be noted that there is a preferable order of the colors to be overlapped so as to realize excellent image quality. For example, it is preferable to attach the image forming units in the order of K, C, M and Y from the upstream side of the transfer belt. So in case the insertion of the units is not this order, a message or sign prompting the user to change the order of the image forming units may be displayed on the operation panel.

It is not preferable in terms of image quality to use the image forming units for the pseudo full-color mode and the image forming units for the full-color mode in combination. So in case the image forming units for the pseudo full-color mode are inserted in combination with the units for the full-color mode, it is suggested that a message prompting the user to change the units currently held be shown on the operation panel. This is true of a case where the image forming units of Y, M, C', and K are inserted in the slots.

As long as the necessity for replacing the image forming units in the preferable order is notified to the user, any kinds of output other than the message or sign as mentioned above are feasible. For example, the notification is carried out through an audio output, or a message display command that is sent to an external device, a source of a relevant print job so as to display a message on a monitor incorporated in the external device.

(4) In the above embodiments, it is defined that the information indicating the image forming modes executable, if any, is to be displayed on the operation panel. However, as long as which mode is executable is notified to the user, any kinds of output other than the information as described above are feasible. Audio output is one example for this.

(5) In the above embodiments, the cases of using the four slots for inserting the image forming units are described. However, the number of slots to be mounted is not limited, and, for example, it is possible to mount five or more slots. In the case of the five slots, it is feasible to hold one of the image forming unit for the M', two of the image forming units for the C', and two of the image forming units for the K, and by switching the two units for the C' in such a manner as previously described, a cycle for replacing the units for the C' extends, hence reducing any trouble for the maintenance operations.

Moreover, as described above, all the image forming units are attachable/detachable with respect to the slots. Alternatively, for example, it is feasible that the image forming units for the M-type, C-type, and K-type colors are fixedly mounted to the slots while the attachment or detachment of the other units is carried out with respect to the remaining slots in accordance with the user's needs. With this arrangement, at least the pseudo full-color mode is executable, and with the image forming unit for the Y-type color inserted in one of the remaining slots, the full-color mode is also executable. As long as the image forming units are formed in such a manner that they are attachable/detachable with respect to the holding units, the user is able to replace the image forming units one by one, and hence, the replacement becomes easy. On top of that, more variations of combinations of the units are obtained, and any combination suitable for the usage of a print is selectable, accordingly.

(6) In the above embodiments, the cases where the present invention applies to a printer have been discussed. However, an image forming apparatus in accordance with the present invention is not limited to printers, and other applications such as copiers, facsimiles, MFP (Multiple Function Peripheral) or the like are feasible.

Also, the present invention is applicable where any of the above-described embodiments and any of the examples of modifications are combined.

<Image Forming Method>

Implementation of the present invention is not limited to image forming apparatuses, and may include image forming methods for use in the above pseudo full-color mode. Moreover, the present invention may be realized as a computer program that executes those methods. A computer program in accordance with the present invention is recordable in a variety of recording media that are accessible from the computer so as to read the program therein. Such a medium includes: a magnetic disk such as magnetic tape and flexible disk; an optical recording medium such as DVD-ROM, DVD-RAM, CD-ROM, CD-R, MO, and PD; and a flash memory type recording medium. And the computer program may be produced or delivered while being stored in any of the recording media, or may be transferred or distributed through: networks, wireless or wired, including the internet; broadcasting; electronic communication lines; satellite communication; or the like.

Moreover, the computer program in accordance with the present invention does not necessarily include all modules required for the computer to execute the above-described processes. Instead, it is feasible that each process pertinent to the present invention is made executable by the computer, for example, using various kinds of general-purposed programs that maybe installed in another information processing device. Examples for this include a program in a communication program or an operating system. Accordingly, all the modules are not necessarily recorded in the above-described recording medium, and are not necessarily transferred. Furthermore, it may be feasible that predetermined processes are executed by hardware specific thereto.

INDUSTRIAL APPLICABILITY

The present invention is applicable to various devices of an electrophotograph type including copiers, printers, facsimiles, multifunctional compound devices thereof, and the like.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. An image forming apparatus comprising:

a magenta developing unit operable to develop, using a toner of a magenta-type color, an electrostatic latent image corresponding to the toner of the magenta-type color;

a cyan developing unit operable to develop, using a toner of a cyan-type color, an electrostatic latent image corresponding to the toner of the cyan-type color;

a black developing unit operable to develop, using a toner of a black-type color, an electrostatic latent image corresponding to the toner of the black-type color; and an image processing unit operable to execute a pseudo full-color image forming process through which only three toner images of the magenta-type, cyan-type, and black-type colors developed by respective developing units are layered so as to form a color image, wherein the toner of the magenta-type color is for use in the pseudo full-color image forming and has a chromaticity point shifted in a direction closer to a yellow hue when plotted on a chromaticity diagram, in comparison with the toner of a genuine magenta color for use in full-color image forming including a case of using four colors that are the magenta-type, cyan-type, and black-type colors, and a yellow-type color.

2. The image forming apparatus of claim 1, wherein the chromaticity point of the toner of the magenta-type color for use in the pseudo full-color image forming is shifted in a direction closer to a red hue when plotted on the chromaticity diagram, in comparison with the toner of the genuine magenta color for use in the full-color image forming.

3. An image forming apparatus comprising:

a magenta developing unit operable to develop, using a toner of a magenta-type color, an electrostatic latent image corresponding to the toner of the magenta-type color;

a cyan developing unit operable to develop, using a toner of a cyan-type color, an electrostatic latent image corresponding to the toner of the cyan-type color;

a black developing unit operable to develop, using a toner of a black-type color, an electrostatic latent image corresponding to the toner of the black-type color; and an image processing unit operable to execute a pseudo full-color image forming process through which only three toner images of the magenta-type, cyan-type, and black-type colors developed by the respective developing units are layered so as to form a color image, wherein the toner of the cyan-type color is for use in the pseudo full-color image forming and has a chromaticity point shifted in a direction closer to a yellow hue when plotted on a chromaticity diagram, in comparison with the toner of a genuine cyan for use in full-color image forming including a case of using four colors that are the magenta-type, cyan-type, and black-type colors, and a yellow-type color.

4. The image forming apparatus of claim 3, wherein the chromaticity point of the toner of the cyan-type color is shifted in a direction closer to a green hue when plotted on the chromaticity diagram, in comparison with the toner of the genuine cyan for use in the full-color image forming.

5. An image forming method comprising the steps of:

forming respective electrostatic latent images corresponding to each of magenta-type, cyan-type, and black-type colors;

developing the respective electrostatic latent images so as to form toner images of each of the magenta-type, cyan-type, and black-type colors; and layering the toner images so as to form a color image, wherein the toner of the magenta-type color is for use in pseudo full-color image forming and has a chromaticity point shifted in a direction closer to a yellow hue when plotted on a chromaticity diagram, in comparison with a toner of a genuine magenta for use in full-color image forming including a case of using four colors that are the magenta-type, cyan-type, and black-type colors, and a yellow-type color.

6. An image forming method comprising the steps of:

forming respective electrostatic latent images corresponding to each of magenta-type, cyan-type, and black-type colors;

developing the respective electrostatic latent images so as to form toner images of each of the colors;

layering the toner images of each of the colors so as to form a color image, wherein the toner of the cyan-color that is for use in pseudo full-color image forming and has a chromaticity point shifted in a direction closer to a yellow hue when plotted on a chromaticity diagram, in comparison with a toner of a genuine cyan for use in full-color image forming including a case of using four colors that are the magenta-type, cyan-type, and black-type colors, and a yellow-type color.

* * * * *